US005585803A

United States Patent [19]

Miura et al.

[11] Patent Number: 5,585,803

[45] Date of Patent: Dec. 17, 1996

[54] APPARATUS AND METHOD FOR CONTROLLING ARRAY ANTENNA COMPRISING A PLURALITY OF ANTENNA ELEMENTS WITH IMPROVED INCOMING BEAM TRACKING

[75] Inventors: Ryu Miura, Soraku-Gun; Toyohisa Tanaka; Yoshio Karasawa, both of Nara; Isamu Chiba, Fujisawa, all of Japan

[73] Assignee: ATR Optical and Radio Communications Research Labs, Kyoto, Japan

[21] Appl. No.: 521,068

[22] Filed: Aug. 29, 1995

[30] Foreign Application Priority Data

| | | | |
|---|---|---|---|
| Aug. 29, 1994 | [JP] | Japan | 6-203258 |
| May 16, 1995 | [JP] | Japan | 7-117167 |

[51] Int. Cl.[6] ..... H01Q 3/22

[52] U.S. Cl. ..... 342/372; 342/81; 342/157

[58] Field of Search ..... 342/372, 81, 157

[56] References Cited

U.S. PATENT DOCUMENTS

| | | | |
|---|---|---|---|
| 4,204,210 | 5/1980 | Hose | 343/6 R |
| 4,241,351 | 12/1980 | Shreve | 343/100 SA |
| 4,492,962 | 1/1985 | Hansen . | |
| 4,996,532 | 2/1991 | Kirimoto et al. . | |
| 5,087,917 | 2/1992 | Fujisaka et al. . | |
| 5,128,683 | 7/1992 | Freedman et al. | 342/158 |
| 5,181,040 | 1/1993 | Inoue et al. . | |
| 5,283,587 | 2/1994 | Hirshfield et al. . | |
| 5,396,256 | 3/1995 | Chiba et al. . | |

OTHER PUBLICATIONS

"A Phased Array Tracking Antenna for Vehicles", by S. Ohmori et al, Technical Report on Antenna and Propagation, A.P. 90–75, pp. 33–40, The Institute of Electronics Information and Comminication Engineers in Japan, Oct. 1990.

"Phase Detection Scheme in Digital Beam Forming (DBF) Antenna for Mobile Radio Communications", K. Kashiki et al, Technical Report on Antenna propagation study group, The Institute of Electronics, Information and Communication Engineers, Japan A.P. 88–144, Feb. 17, 1989.

"A Phased Array Tracking Antenna for Vehicles", S. Ohmori et al, proceedings of International Mobile Satellite Conference Ottawa, Jun. 1990.

"A Phased Array Tracking Antenna for Vehicles", S. Ohmori et al, Technical Report on Antenna propagation study group, The Institute of Electronics, Information and Communication Engineers, Japan A.P. 90–75, SANE90–41, Oct. 1990.

"A Flexible Processor for a Digital Adaptive Array Radar", K. Teitelbaum, pp. 103–107 Proceedings of the 1991 IEEE National Radar Conference, Mar. 12–13, 1991.

(List continued on next page.)

*Primary Examiner*—Thomas H. Tarcza
*Assistant Examiner*—Dao L. Phan

[57] ABSTRACT

In an apparatus and method for controlling an array antenna comprising a plurality of antenna elements arranged so as to be adjacent to each other in a predetermined arrangement configuration, a plurality of received signals received by the antenna elements is transformed into respective pairs of quadrature baseband signals, using a common local oscillation signal, wherein each pair of quadrature baseband signals is orthogonal to each other. Then predetermined first and second data are calculated based on each pair of transformed quadrature baseband signals, and are filtered using a noise suppressing filter. Respective elements of a transformation matrix for in-phase combining are calculated based on the filtered first and second data, and the received signals obtained from the each two antenna elements are put in phase based on the calculated transformation matrix. Thereafter, a plurality of received signals which are put in phase are combined in phase, and an in-phase combined received signal is outputted.

26 Claims, 37 Drawing Sheets

First Preferred Embodiment

OTHER PUBLICATIONS

"Characteristics of CMA Adaptive Array for Selective Fading Compensation in Digital Land Mobile Radio Communications", T. Ohkane et al, Proceedings of the Institute of the Electronics, Information and Communication Engineers, Japan, vol. J73–B–II, No. 10. pp. 489–497, Oct. 1990.

"Null Beam Forming by Phase Control of Selected Elements in Phased–Array Antennas", I. Chiba et al, Proceedings of the Institute of the Electronics, Information and Communication Engineers, Japan, vol. J74–B–II, No. 1. pp. 35–42, Jan. 1991.

"Design of a Directional Diversity Receiver Using an Adaptive Array Antenna", N. Kuroiwa et al, Proceedings of the Institute of the Electronics, Information and Communication Engineers, Japan vol. J73–B–II, No. 11, pp. 755–763, Nov. 1990.

Fig.1 First Preferred Embodiment

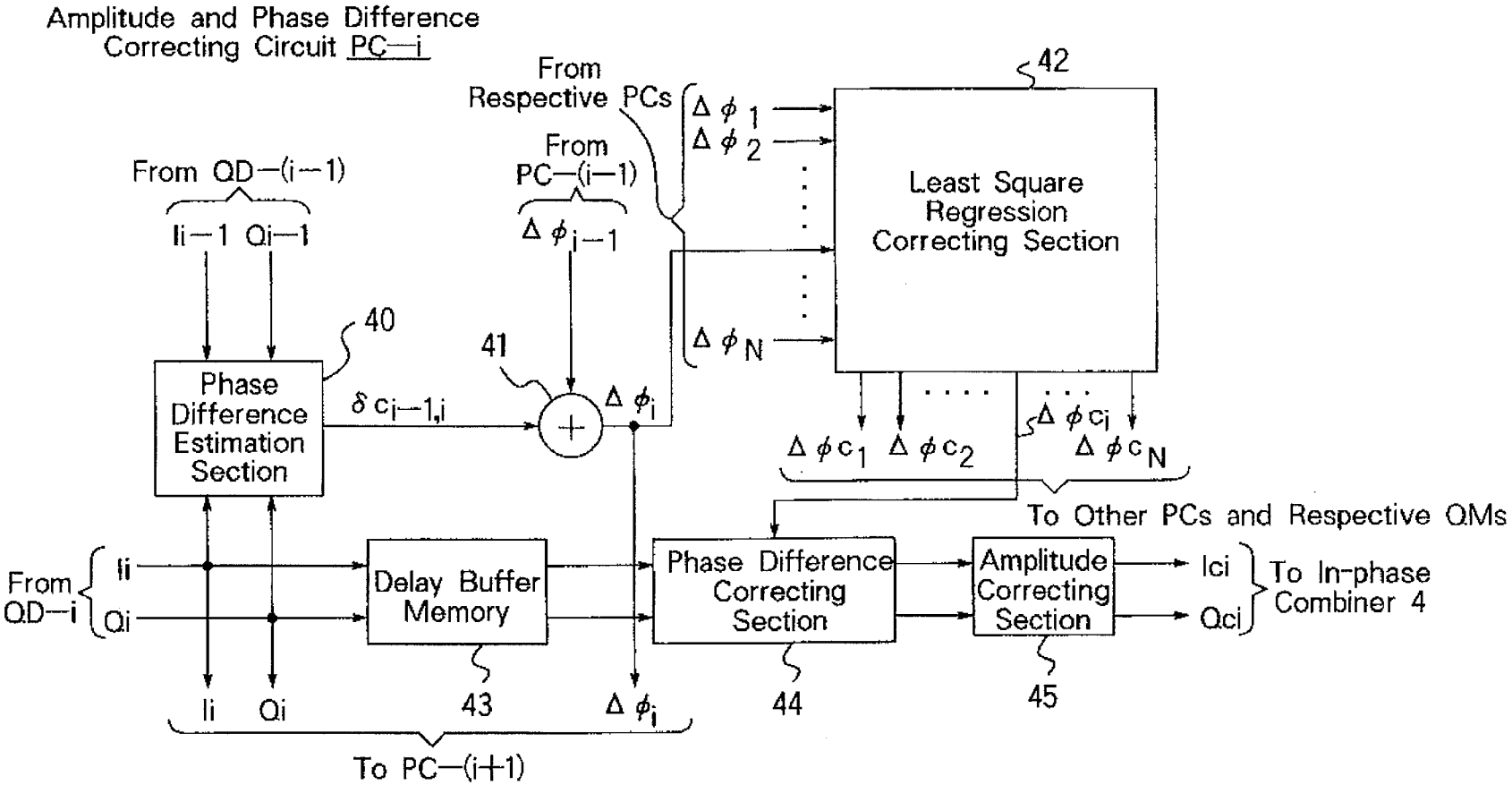
Fig.3
Amplitude and Phase Difference Correcting Circuit PC—i
From Respective PCs
Δφ1
Δφ2
ΔφN
42
Least Square Regression Correcting Section
Δφc1
Δφc2
Δφci
ΔφcN
To Other PCs and Respective QMs
From PC—(i—1)
Δφi—1
41
Δφi
From QD—(i—1)
Ii—1 Qi—1
40
Phase Difference Estimation Section
δci—1,i
Phase Difference Correcting Section
44
Amplitude Correcting Section
45
Ici
Qci
To In-phase Combiner 4
Delay Buffer Memory
43
Ii
Qi
From QD—i
To PC—(i+1)

In the case of C/N = 4dB

In the case of C/N = −2dB

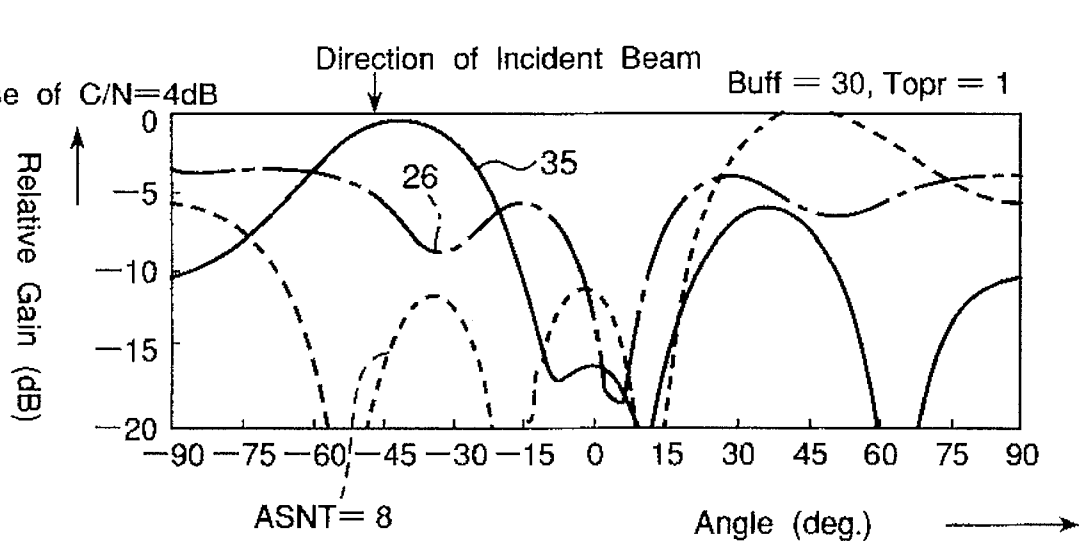
Fig.9A In the case of C/N=4dB
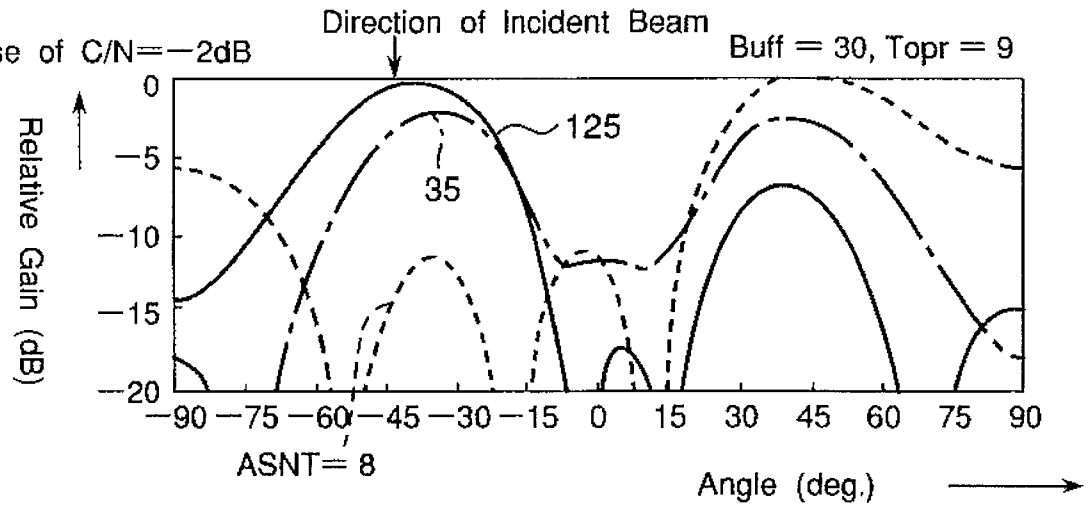
Fig.9B In the case of C/N=−2dB In the case of C/N=4dB In the case of C/N=−2dB From QD-1
From QD-2
From QD-3
From QD-4
From QD-5
From QD-6
From QD-7
From QD-8
From QD-9
Amplitude and Phase Difference Correcting Circuit
PCA-1
PCA-2
PCA-3
PCA-4
PCA-5
PCA-6
PCA-7
PCA-8
In-phase Combiner
81
82
83
84
85
86
87
88
To Demodulator 5

Amplitude and Phase Difference Correcting Circuit PCA-s

Fig.17 Third Preferred Embodiment

Fourth and Fifth Preferred Embodiments

Fourth Preferred Embodiment

Fifth Preferred Embodiment

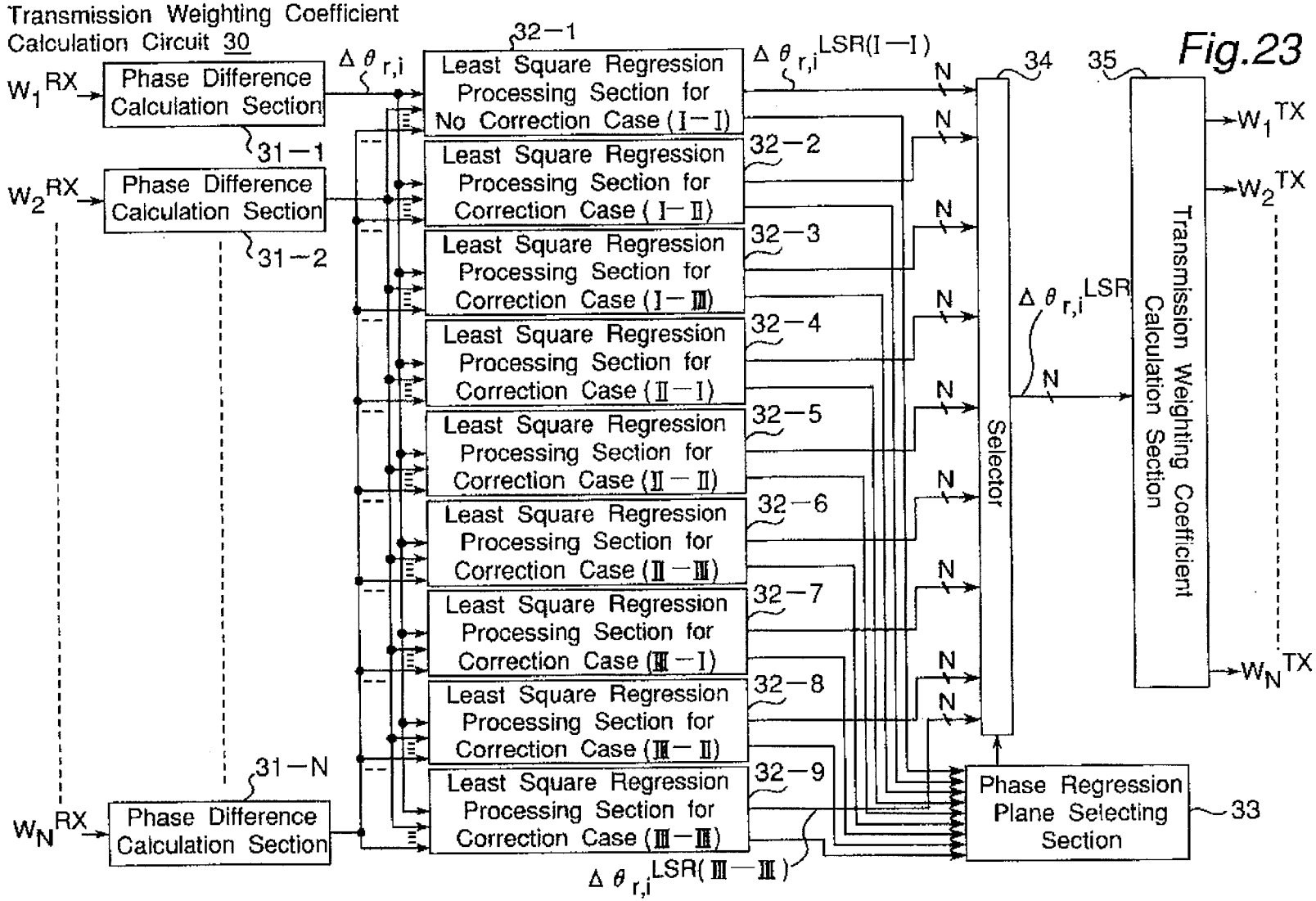
Fig.23
Transmission Weighting Coefficient Calculation Section
35
Selector
34
Phase Regression Plane Selecting Section
33
Transmission Weighting Coefficient Calculation Circuit 30
Phase Difference Calculation Section
31-1
31-2
31-N
Least Square Regression Processing Section for No Correction Case (I-I)
Least Square Regression Processing Section for Correction Case (I-II)
Least Square Regression Processing Section for Correction Case (I-III)
Least Square Regression Processing Section for Correction Case (II-I)
Least Square Regression Processing Section for Correction Case (II-II)
Least Square Regression Processing Section for Correction Case (II-III)
Least Square Regression Processing Section for Correction Case (III-I)
Least Square Regression Processing Section for Correction Case (III-II)
Least Square Regression Processing Section for Correction Case (III-III)
32-1
32-2
32-3
32-4
32-5
32-6
32-7
32-8
32-9
W1 RX
W2 RX
WN RX
W1 TX
W2 TX
WN TX
Δθr,i
Δθr,i LSR(I-I)
Δθr,i LSR(III-III)
Δθr,i LSR
N

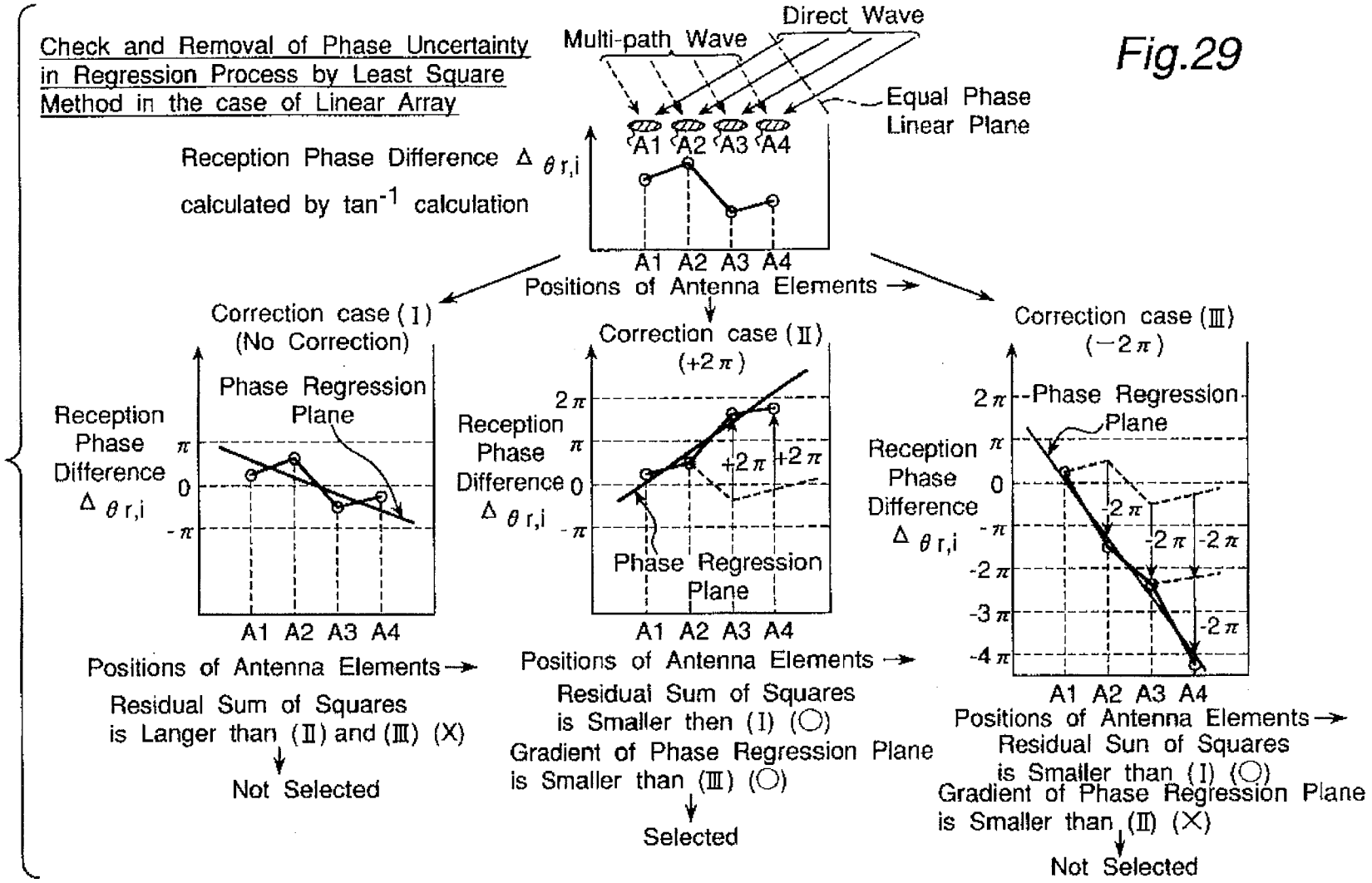
Fig.29
Check and Removal of Phase Uncertainty in Regression Process by Least Square Method in the case of Linear Array
Multi-path Wave
Direct Wave
Equal Phase Linear Plane
A1 A2 A3 A4
Reception Phase Difference Δ θ r,i
calculated by tan-1 calculation
Positions of Antenna Elements
Correction case (I) (No Correction)
Correction case (II) (+2π)
Correction case (III) (−2π)
Phase Regression Plane
Reception Phase Difference Δ θ r,i
2π
π
0
-π
-2π
-3π
-4π
+2π
Positions of Antenna Elements
Residual Sum of Squares is Langer than (II) and (III) (X)
Not Selected
Residual Sum of Squares is Smaller then (I) (○)
Gradient of Phase Regression Plane is Smaller than (III) (○)
Selected
Residual Sum of Squares is Smaller than (I) (○)
Gradient of Phase Regression Plane is Smaller than (II) (X)
Not Selected Setting of Phase Threshold value k in Check of Uncertainty of Reception Phase Fig.37 Transmission Weighting Coefficient Calculation Circuit 30a
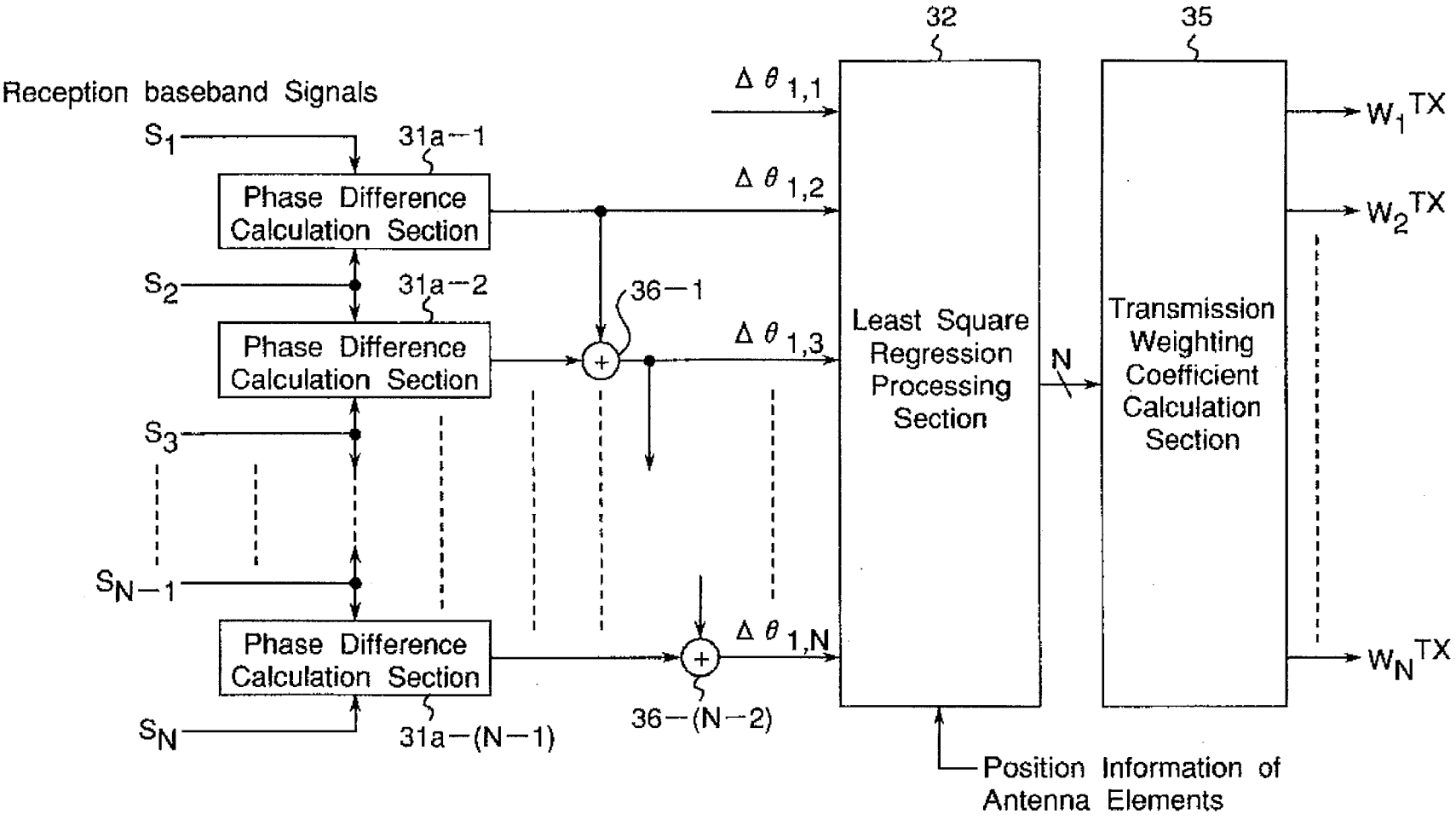

APPARATUS AND METHOD FOR CONTROLLING ARRAY ANTENNA COMPRISING A PLURALITY OF ANTENNA ELEMENTS WITH IMPROVED INCOMING BEAM TRACKING

BACKGROUND OF THE INVENTION

1. Field of the Invention

The present invention relates to an apparatus and method for controlling an array antenna for use in communications, and in particular, to an apparatus and method for controlling an array antenna comprising a plurality of antenna elements with improved incoming beam tracking.

2. Description of the Related Art

There has been produced on trial a phased array antenna for use in satellite communications that is installed in a vehicle or the like and automatically tracks the direction of a geostationary satellite by Communications Research Laboratory of Japanese Ministry of Posts and Telecommunications, wherein the phase array antenna is referred to as the first prior art hereinafter. The phased array antenna of the first prior art is comprised of nineteen microstrip antenna elements, and is equipped with a total of eighteen microwave phase shifters each provided for each element except for one element so as to electrically scan the direction of a beam without any mechanical drive. In this case, there is provided a magnetic sensor that detects the direction of geomagnetism and calculates the direction of the geostationary satellite when seen from a vehicle, of which position has been previously known, serving as a sensor for controlling the directivity of the antenna and tracking the direction of an incoming beam as well as an optical fiber gyro that detects a rotational angular velocity of the vehicle and constantly keeps the direction of the beam with high accuracy. By combining these two sensors, the antenna directivity is directed to a predetermined direction regardless of the presence or absence of an incoming beam, so that the directivity is always kept constantly in an identical direction even when the vehicle moves.

Furthermore, for a digital beam forming antenna for satellite communication using a digital phase modulation, a phase detection method for acquiring and tracking the incoming beam has been proposed by the present applicant, wherein the phase detection method is referred to as the second prior art hereinafter. The second prior art method is a method implemented by providing a carrier wave regenerating circuit employing a costas loop for each antenna element of an array antenna, controlling the phase of a voltage controlled oscillator (VCO) so that all the elements are put in phase, and then obtaining an array output through in-phase combining of the resulting signals. Further, according to the above-mentioned method, a phase uncertainty takes place at each antenna element in the carrier wave regenerating circuit, and consequently a great amount of power loss occurs when the signals are combined as they are. Therefore, a pull-in phase is detected from a baseband output of each antenna element, and a phase correction amount is calculated based on the detected pull-in phase, so that the phase uncertainty is corrected by a phase shifter prior to the above-mentioned in-phase combining process. According to the second prior art method, the directivity of the antenna is automatically directed to the incoming beam so long as a signal to be received is a phase-modulated wave, and therefore, no special sensor is required for perceiving the direction of the incoming beam.

In the case of the phased array antenna of the first prior art, a magnetic sensor capable of detecting an absolute azimuth is used for directing the directivity of the antenna toward the satellite. However, in the case of a vehicle or the like, the body thereof is made of metal and is often magnetized, and this causes an error in the direction of the directivity of the antenna. In order to eliminate the above-mentioned problems, it is necessary to perform a calibration with magnetic data obtained by rotating the antenna by 360 degrees in a broad place free of any magnetized structure and so forth. Even though the calibration is effected satisfactorily for the achievement of acquiring and tracking of the direction of the satellite, the geomagnetism is often disturbed by surrounding buildings, the other vehicles and so forth, and therefore, it is difficult to track the direction of the incoming beam only by means of the magnetic sensor. For the above-mentioned reasons, the tracking is performed principally based on data obtained from the optical fiber gyro after the direction of the satellite is acquired. However, the optical fiber gyro detects only the angular velocity, not the absolute azimuth as performed by the magnetic sensor, and therefore, azimuth angle errors accumulate. In order to eliminate this problem, there is adopted a method of calibrating in a predetermined period the optical fiber gyro based on information obtained from the magnetic sensor, however, the control algorithm therefor becomes complicated, and also no highly accurate control algorithm has been developed yet.

The phased array antenna of the first prior art has another drawback that, though the beam can be directed in the direction of a signal source when the direction of the signal source has been already known regardless of the presence or absence of the incoming beam, when the direction of the signal source has been unknown or the signal source itself moves as in the case of a satellite in a low-altitude earth orbit, the satellite cannot be tracked except for a case where the movement thereof can be estimated. As described above, the acquiring and tracking method utilizing an azimuth sensor has had such a problem that it has a complicated structure and limited capabilities.

Furthermore, in the case of the phase detection method of the second prior art, a directivity is formed by regenerating a carrier wave for each antenna element. Therefore, the above-mentioned method has the advantageous feature that it requires neither an azimuth sensor as provided for the phased array antenna of the first prior art nor a complicated control algorithm. However, the carrier wave regenerating circuit employs a costas loop circuit for effecting phase-synchronized tracking in a closed loop, and this causes a problem that a certain time is required in achieving convergence in an initial stage of acquiring the incoming beam. In particular, when satellite communication is carried out with the antenna installed in a mobile body such as a vehicle, signal interruption frequently occurs due to trees, buildings and so forth, and therefore, the initial acquisition must be performed speedily within several symbols of received data.

The phase detection method of the second prior art has another problem that a received signal-to-noise power ratio per antenna element is reduced when the array antenna has a great number of antenna elements, and therefore, a phase cycle slip occurs at each antenna element, consequently resulting in difficulties in regenerating a carrier wave and utilizing the gain of the array antenna.

SUMMARY OF THE INVENTION

An essential object of the present invention is therefore to provide an apparatus for controlling an array antenna, capable of acquiring and tracking an incoming beam speedily and stably without any mechanical drive nor sensor such as an azimuth sensor even in such a state that a received signal-to-noise power ratio at each antenna element is relatively low.

Another object of the present invention is to provide a method for controlling an array antenna, capable of acquiring and tracking an incoming beam speedily and stably without any mechanical drive nor sensor such as an azimuth sensor even in such a state that a received signal-to-noise power ratio at each antenna element is relatively low.

A further object of the present invention is to provide an apparatus for controlling an array antenna, capable of forming a transmitting beam in a direction of an the incoming beam based on a received signal at each antenna element obtained from an incoming wave transmitted from a signal source without using any azimuth sensor or the like even in such a case that the direction of the remote station of the other party which serves as the signal source has been unknown, and forming a single transmitting main beam only in the direction of a greatest received wave even in an environment in which a plurality of multi-path waves come or in such a case that a phase uncertainty takes place in a reception phase difference.

A still further object of the present invention is to provide an apparatus for controlling an array antenna, capable of forming a transmitting beam in a direction of an incoming beam based on a received signal at each antenna element obtained from an incoming wave transmitted from a signal source without using any azimuth sensor or the like even in such a case that the direction of the remote station of the other party which serves as the signal source has been unknown, and forming a single transmitting main beam only in the direction of a greatest received wave even in an environment in which a plurality of multi-path waves come or in such a case that a phase uncertainty takes place in a reception phase difference.

In order to achieve the above-mentioned objective, according to one aspect of the present invention, there is provided an apparatus for controlling an array antenna comprising a plurality of antenna elements arranged so as to be adjacent to each other in a predetermined arrangement configuration, said apparatus comprising:

transforming means for transforming a plurality of received signals received by said antenna elements of said array antenna into respective pairs of quadrature baseband signals, respectively, using a common local oscillation signal, respective quadrature baseband signals of the pairs of quadrature baseband signals being orthogonal to each other;

in-phase putting means, comprising a noise suppressing filter having a predetermined transfer function, the in-phase putting means using a predetermined first axis and a predetermined second axis which are orthogonal to each other and a transformation matrix for putting in phase received signals obtained from each two antenna elements of each combination of said plurality of antenna elements being expressed by a two-by-two transformation matrix including (a) second data on said second axis proportional to a product of a sine value of a phase difference between the received signals obtained from said each two antenna elements of each combination, and respective amplitude values of the received signals thereof, and (b) first data on said first axis proportional to a product of a cosine value of a phase difference between the received signals obtained from said each two antenna elements of each combination, and respective amplitude values of the received signals thereof, said in-phase putting means calculating said first data and said second data based on each pair of transformed quadrature baseband signals, passing the calculated first data and the calculated second data through said noise suppressing filter so as to filter said first and second data and output filtered first and second data, calculating respective element values of said transformation matrix based on the filtered first data and the filtered second data, and putting in phase said received signals obtained from said each two antenna elements of each combination based on said transformation matrix including said calculated transformation matrix elements; and combining means for combining in phase said plurality of received signals which are put in phase by said in-phase putting means, and outputting an in-phase combined received signal.

In the above-mentioned apparatus, said combining means preferably comprises:

calculating means for calculating respective correction phase amounts such that said plurality of received signals are put in phase based on said filtered first data and said filtered second data filtered by said in-phase putting means;

first phase shifting means for shifting phases of said plurality of received signals respectively based on said respective correction phase amounts calculated by said calculating means; and first in-phase combining means for combining in phase said plurality of received signals whose phases are shifted by said first phase shifting means, and outputting an in-phase combined received signal.

In the above-mentioned apparatus, said combining means preferably further comprises:

correcting means for subjecting said respective correction phase amounts calculated by said calculating means to a regression correcting process so that, based on said arrangement configuration of said array antenna, said respective correction phase amounts are made to regress to a predetermined plane of said arrangement configuration, and outputting respective regression-corrected correction phase amounts, wherein said first phase shifting means shifts the phases of said plurality of received signals respectively by said respective regression-corrected correction phase amounts outputted from said correcting means.

In the above-mentioned apparatus, said combining means preferably comprises:

in-phase transforming means for transforming one of respective two received signals of each combination of said plurality of received signals so that said one of said received signals is put in phase with another one of said received signals thereof, using said transformation matrix including said transformation matrix elements calculated by said in-phase combining means;

second in-phase combining means for combining in phase said respective two received signals of each combination comprised of a received signal which is not transformed by said in-phase transforming means, and another received signal which is transformed by said in-phase transforming means, and outputting an in-phase combined received signal; and control means for repeating the processes of said in-phase transforming means and said second in-phase combining means until one resulting received signal is obtained, and outputting the one resulting received signal combined in phase.

The above-mentioned apparatus preferably further comprises:

multi-beam forming means operatively provided between said transforming means and said in-phase putting means, for calculating a plurality of beam electric field values based on said plurality of received signals received by respective antenna elements of said array antenna, directions of respective main beams of a predetermined plural number of beams to be formed which are predetermined so that a desired wave can be received within a range of radiation angle, and a predetermined reception frequency of said received signals, and outputting a plurality of beam signals respectively having said beam electric field values; and beam selecting means operatively provided between said transforming means and said in-phase putting means, for selecting a predetermined number of beam signals having greater beam electric field values including a beam signal having a greatest beam electric field value among said plurality of beam signals outputted from said multi-beam forming means, and determining said beam signal having the greatest beam electric field value to be a reference received signal, and wherein said in-phase putting means puts in phase with said reference received signal, the other ones of said plurality of received signals selected by said beam selecting means, using said transformation matrix including said calculated transformation matrix elements.

The above-mentioned apparatus preferably further comprises:

amplitude correcting means operatively provided at a stage just before said combining means, for amplifying said plurality of received signals respectively which are put in-phase by said in-phase putting means with a plurality of gains proportional to signal levels of said plurality of received signals, thereby effecting amplitude correction.

In the above-mentioned apparatus, said in-phase putting means preferably calculates elements of said transformation matrix by directly expressing said first data and said second data as the elements of said transformation matrix, and puts the other ones of said plurality of received signals except for one predetermined received signal in phase with said one predetermined received signal, using said transformation matrix including said calculated transformation matrix elements.

In the above-mentioned apparatus, said in-phase putting means preferably calculates elements of said transformation matrix by directly expressing said first data and said second data as the elements of said transformation matrix, and puts respective two received signals of each combination in phase with each other, using said transformation matrix including said calculated transformation matrix elements.

The above-mentioned apparatus preferably further comprises:

distributing means for distributing in phase a transmitting signal into a plurality of transmitting signals;

transmission phase shifting means for shifting phases of said plurality of transmitting signals respectively by either one of said respective correction phase amounts calculated by said calculating means and said respective regression-corrected correction phase amounts outputted from said correcting means; and transmitting means for transmitting said plurality of transmitting signals whose phases are shifted by said transmission phase shifting means, from said plurality of antenna elements.

According to another aspect of the present invention, there is provided a method for controlling an array antenna comprising a plurality of antenna elements arranged so as to be adjacent to each other in a predetermined arrangement configuration, said method including the following steps of:

transforming a plurality of received signals received by said antenna elements of said array antenna into respective pairs of quadrature baseband signals, respectively, using a common local oscillation signal respective quadrature baseband signals of the pairs of quadrature baseband signals being orthogonal to each other;

putting in-phase received signals obtained from each two antenna elements of each combination of said plurality of antenna elements by using a predetermined first axis and a predetermined second axis which are orthogonal to each other and, a transformation matrix being expressed by a two-by-two transformation matrix including (a) second data on said second axis proportional to a product of a sine value of a phase difference between the received signals obtained from said each two antenna elements of each combination, and respective amplitude values of the received signals thereof, and (b) first data on said first axis proportional to a product of a cosine value of a phase difference between the received signals obtained from said each two antenna elements of each combination, and respective amplitude values of the received signals thereof, said step of putting in-phase received signals including calculating said first data and said second data based on each pair of transformed quadrature baseband signals;

filtering the calculated first data and the calculated second data with a predetermined transfer function so as to provide filtered first and second data;

calculating respective element values of said transformation matrix based on the filtered first data and the filtered second data;

putting in phase said received signals obtained from said each two antenna elements of each combination based on said transformation matrix including said calculated transformation matrix elements; and combining in phase said plurality of received signals which are put in phase, and providing an in-phase combined received signal.

In the above-mentioned method, said combining step preferably includes the following steps of:

calculating respective correction phase amounts such that said plurality of received signals are put in phase based on said filtered first data and said filtered second data;

shifting phases of said plurality of received signals respectively by said calculated respective correction phase amounts; and combining in phase said plurality of received signals whose phases are shifted, and providing an in-phase combined received signal.

In the above-mentioned method, said combining step preferably further includes the following steps of:

subjecting said calculated respective correction phase amounts to a regression correcting process so that, based on said arrangement configuration of said array antenna, said respective calculated correction phase amounts are made to regress to a predetermined plane of said arrangement configuration; and providing respective regression-corrected correction phase amounts, wherein said shifting step includes a step of shifting the phases of said plurality of received signals respectively by said respective regression-corrected correction phase amounts.

In the above-mentioned method, said combining step preferably includes the following steps of:

transforming one of respective two received signals of each combination of said plurality of received signals so that said one of said received signals is put in phase with another one of said received signals thereof, using said transformation matrix including said calculated transformation matrix elements;

combining in phase said respective two received signals of each combination comprised of a received signal which is not transformed, and another received signal which is transformed, and providing an in-phase combined received signal; and repeating the processes of said transforming step and said combining step until one resulting received signal is obtained, and providing the one resulting received signal combined in phase.

The above-mentioned method preferably further includes the following steps of:

after the process of said transforming step and before the process of said combining step, calculating a plurality of beam electric field values based on said plurality of received signals received by respective antenna elements of said array antenna, directions of respective main beams of a predetermined plural number of beams to be formed which are predetermined so that a desired wave can be received within a range of radiation angle, and a predetermined reception frequency of said received signals, and providing a plurality of beam signals respectively having said beam electric field values; and after the processes of said transforming step and said calculating step, and before the process of said combining step, selecting a predetermined number of beam signals having greater beam electric field values including a beam signal having a greatest beam electric field value among said plurality of beam signals outputted at said multi-beam forming step, and determining said beam signal having the greatest beam electric field value to be a reference received signal, and wherein said combining step includes a step of putting in phase with said reference received signal, the other ones of said plurality of selected received signals, using said transformation matrix including said calculated transformation matrix elements.

The above-mentioned method preferably further includes the following step of:

just before the process of said combining step, amplifying said plurality of received signals respectively with a plurality of gains proportional to signal levels of said plurality of received signals, thereby effecting amplitude correction.

In the above-mentioned method, said putting in phase step preferably includes the following steps of:

calculating elements of said transformation matrix by directly expressing said first data and said second data as the elements of said transformation matrix; and putting the other ones of said plurality of received signals except for one predetermined received signal in phase with said one predetermined received signal, using said transformation matrix including said calculated transformation matrix elements.

In the above-mentioned method, said putting in phase step preferably includes the following steps:

calculating elements of said transformation matrix by directly expressing said first data and said second data as the elements of said transformation matrix; and putting respective two received signals of each combination in phase with each other, using said transformation matrix including said calculated transformation matrix elements.

The above-mentioned method preferably further includes the following steps of:

distributing in phase a transmitting signal into a plurality of transmitting signals;

shifting phases of said plurality of transmitting signals respectively by either one of said calculated respective correction phase amounts and said respective regression-corrected correction phase amounts; and transmitting said plurality of transmitting signals whose phases are shifted, from said plurality of antenna elements.

According to a further aspect of the present invention, there is provided an apparatus for controlling an array antenna comprising a plurality of antenna elements arranged so as to adjacent to each other in a predetermined arrangement configuration, said apparatus comprising:

transforming means for transforming a plurality of received signals received by said antenna elements of said array antenna into respective pairs of quadrature baseband signals, using a common local oscillation signal, respective quadrature baseband signals of the pairs of quadrature baseband signals being orthogonal to each other;

phase difference calculating means, based on said transformed two quadrature baseband signals transformed by said transforming means, for calculating the following data:

(a) first data proportional to a product of a cosine value of a phase difference between two received signals obtained from a predetermined reference antenna element and another arbitrary antenna element, and respective amplitude values of said two received signals thereof, and (b) second data proportional to a product of a sine value of a phase difference between two received signals obtained from said each two antenna elements of each combination, and respective amplitude values of said two received signals thereof, and for calculating a reception phase difference between said each two antenna elements of each combination based on calculated first data and calculated second data;

correcting means for correcting said reception phase difference so that a phase uncertainty generated such that the calculated reception phase difference between each of said two antenna elements of each combination calculated by said phase difference calculating means is limited within a range from $-\pi$ to $+\pi$ is removed from said reception phase difference, according to a predetermined phase threshold value representing a degree of disorder of a reception phase difference due to a multipath wave, and for converting a corrected reception phase difference into a transmission phase difference by inverting a sign of said corrected reception phase difference; and transmitting means for transmitting a transmitting signal from said antenna elements with the transmission phase difference between said each two antenna elements of each combination converted by said correcting means and with the same amplitudes, thereby forming a transmitting main beam only in a direction of a greatest received signal.

In the above-mentioned apparatus, said correcting means preferably calculates a reception phase difference between adjacent two antenna elements of each combination calculates a plurality of equi-phase linear regression planes corresponding to all proposed phases of the phase uncertainty of the reception phase difference between said two adjacent antenna elements of each combination according to a least square method, removes said phase uncertainty using a sum of squares of a residual between said reception phase difference and each of said equi-phase linear regression planes and a gradient coefficient of each of said equi-phase linear regression planes, and corrects said reception phase difference by specifying only one equi-phase linear regression plane corresponding to the greatest received wave.

In the above-mentioned apparatus, said correcting means preferably derives an equation representing said equi-phase linear regression plane corresponding to all the proposed phases of said phase uncertainty by solving a Wiener-Hopf equation according to the least square method using a matrix comprised of reception phase differences corresponding to all the proposed phases of the phase uncertainty of the reception phase difference between said two adjacent antenna elements of each combination and a matrix comprised of position coordinates of the plurality of antenna elements of said array antenna, and calculates the plurality of equi-phase linear regression planes corresponding to all the proposed phases of said phase uncertainty.

In the above-mentioned apparatus, said correcting means preferably determines a transmission phase difference by multiplying a reception phase difference calculated from said equi-phase linear regression plane from which said phase uncertainty is removed by a ratio of a transmission frequency to a reception frequency, thereby converting said reception phase difference into said transmission phase difference.

According to a still further aspect of the present invention, there is provided a method for controlling an array antenna comprising a plurality of antenna elements arranged so as to adjacent to each other in a predetermined arrangement configuration, said method including the following steps of:

transforming a plurality of received signals received by said antenna elements of said array antenna into respective pairs of quadrature baseband signals, using a common local oscillation signal, respective quadrature baseband signals of the pairs of quadrature baseband signals being orthogonal to each other;

based on said transformed two quadrature baseband signals, calculating the following data:

(a) first data proportional to a product of a cosine value of a phase difference between two received signals obtained from a predetermined reference antenna element and another arbitrary antenna element, and respective amplitude values of said two received signals thereof, and (b) second data proportional to a product of a sine value of a phase difference between two received signals obtained from said each two antenna elements of each combination, and respective amplitude values of said two received signals thereof;

calculating a reception phase difference between said each two antenna elements of each combination based on calculated first data and calculated second data;

correcting said reception phase difference so that a phase uncertainty generated such that the calculated reception phase difference between each of said two antenna elements of each combination is limited within a range from $-\pi$ to $+\pi 0$ is removed from said reception phase difference, according to a predetermined phase threshold value representing a degree of disorder of a reception phase difference due to a multi-path wave;

converting a corrected reception phase difference into a transmission phase difference by inverting a sign of said corrected reception phase difference; and transmitting a transmitting signal from said antenna elements with said converted transmission phase difference between said each two antenna elements of each combination and with the same amplitudes, thereby forming a transmitting main beam only in a direction of a greatest received signal.

In the above-mentioned method, said correcting step preferably includes the following steps of:

calculating a reception phase difference between adjacent two antenna elements of each combination based on said calculated reception phase difference between said two antenna elements of each combination;

calculating a plurality of equi-phase linear regression planes corresponding to all proposed phases of the phase uncertainty of the reception phase difference between said two adjacent antenna elements of each combination according to a least square method;

removing said phase uncertainty using a sum of squares of a residual between said reception phase difference and each of said equi-phase linear regression planes and a gradient coefficient of each of said equi-phase linear regression planes; and correcting said reception phase difference by specifying only one equi-phase linear regression plane corresponding to the greatest received wave.

In the above-mentioned method, said correcting step preferably includes the following steps of:

deriving an equation representing said equi-phase linear regression plane corresponding to all the proposed phases of said phase uncertainty by solving a Wiener-Hopf equation according to the least square method using a matrix comprised of reception phase differences corresponding to all the proposed phases of the phase uncertainty of the reception phase difference between said two adjacent antenna elements of each combination and a matrix comprised of position coordinates of the plurality of antenna elements of said array antenna; and calculating the plurality of equi-phase linear regression planes corresponding to all the proposed phases of said phase uncertainty.

In the above-mentioned method, said correcting step preferably includes a step of determining a transmission phase difference by multiplying a reception phase difference calculated from said equi-phase linear regression plane from which said phase uncertainty is removed by a ratio of a transmission frequency to a reception frequency, thereby converting said reception phase difference into said transmission phase difference.

Accordingly, the first present invention have distinctive advantageous effects as follows.

(1) Since no such feedback loop as in the second prior art is included, even when the carrier signal power to noise power ratio C/N per antenna element is relatively low, the incoming signal beam of a radio signal can be acquired automatically and rapidly without using any specific direction sensor, position data of the remote station of the other party, nor the like. Therefore, if a momentary interruption of the signal beam due to an obstacle or the like takes place, data to be lost can be suppressed in amount to the minimum. Further, in a burst mode communication system such as packet communication, a reduced preamble length can be achieved. Furthermore, for example, a received signal modulated with communication data can be directly used. Therefore, neither special training signal nor reference signal for effecting phase control is required, allowing the system construction to be simplified.

(2) Since no such feedback loop as in the second prior art is included, even when the carrier signal power to noise power ratio C/N per antenna element is relatively low and the direction of an incoming signal beam changes rapidly, no phase slip occurs. Furthermore, since no such azimuth sensor as in the first prior art is provided, the apparatus is free of influence of external disturbance due to disarray of environmental lines of magnetic force and accumulation of tracking error. Therefore, an incoming signal beam of a radio signal can be tracked stably with high accuracy and, for example, quality of mobile communication can be improved. Furthermore, not only when the self-station moves but also when the remote station of the other party moves, the remote station of the other party can be tracked without any special information about the position of the remote station of the other party. Furthermore, in a burst mode communication system such as packet communication, a change of the direction of the incoming beam cannot be tracked in the course of burst according to a tracking system using a training signal (preamble). However, for example, a received signal modulated with communication data can be directly used in the present control apparatus, and therefore real-time tracking can be achieved even in the course of burst.

Furthermore, based on the arrangement configuration of the array antenna, the calculated correction phase amount is subjected to the regression correction process so that the calculated correction phase amount is made to regress to the plane of the arrangement configuration, and the phases of the plurality of received signals are each shifted by the correction phase amount based on the correction phase amount obtained through the regression correction process. With the above-mentioned arrangement, the spatial information of the array antenna can be effectively utilized, so that the influence of the reduction of the carrier signal power to noise power ratio C/N per antenna element, which is problematic when a great number of antenna elements are employed, can be suppressed, thereby preventing the possible deterioration of the tracking characteristic and quality of communication.

Furthermore, when the plurality of received signals are combined in phase to output the resulting received signal, by transforming one of two received signals of the plurality of received signals so that it is put in phase with the other received signal by means of a transformation matrix including the calculated transformation matrix elements, combining in phase two received signals of each combination of the received signal that is not transformed and the received signal that is transformed, and repeating the above-mentioned calculation, transformation and in-phase combining processes until the received signal obtained through the in-phase combining process is reduced in number to one, then the one received signal combined in phase is outputted. That is, the in-phase combining process is effected between the two element systems in advance without calculating a phase difference between adjacent antenna elements. Therefore, if there is an antenna element having a low reception level or a defective antenna element, the above-mentioned defect can be prevented from affecting the in-phase combining in the other antenna element systems. Therefore, it can be said that the present apparatus of the present invention has a tolerance to failure or the like of the antenna elements and the circuit devices connected thereto.

Furthermore, just before the first data and the second data are calculated based on two transformed quadrature baseband signals of each combination, based on the plurality of received signals received by the antenna elements of the array antenna, the direction of each main beam of the predetermined plural number of beams to be formed predetermined so that the desired wave can be received within a predetermined range of radiation angle, and the predetermined reception frequency of the received signals, the following operations are performed. The plurality of beam electric field values are calculated so as to output a plurality of beam signals having the respective beam electric field values, and a predetermined number of beam signals having greater beam electric field values including the beam signal having the greatest beam electric field value among the plurality of outputted beam signals are selected. Then, the beam signal having the greatest beam electric field value is used as a reference received signal, a plurality of other selected received signals are put in phase with the reference received signal by means of a transformation matrix including the calculated transformation matrix elements, and the plurality of received signals are combined in phase with each other so as to output the resulting received signal. That is, the phase difference correction is effected after a beam signal having a high received signal to noise power ratio is formed through multi-beam formation and beam selection. Therefore, no influence is exerted on the phase difference correction accuracy even if the received signal to noise power ratio of each antenna element is relatively low, this means that there is theoretically no upper limit in number of antenna elements. Furthermore, when an intense interference wave or the like comes in another direction, such waves are spatially separated to a certain extent through beam selection, and this produces the effect that the apparatus is less susceptible to the interference waves.

Furthermore, by amplifying the plurality of received signals with a plurality of gains direct proportional to the signal levels of the plurality of received signals before the in-phase combining process, there is effected amplitude correction or automatic amplitude correction. Therefore, the received signal having a deteriorated signal quality contributes less to the in-phase combining process. Therefore, even when there is a difference in received signal intensity between antenna elements owing to shadowing due to obstacles, fading due to reflection from buildings and the like, the possible lowering of the received signal to noise power ratio after the in-phase combining process can be suppressed, and deterioration in quality of communication can be prevented.

Further, the first data and the second data are directly expressed as elements of the transformation matrix, and the elements of the transformation matrix are calculated. Otherwise, other received signals of the plurality of received signals except for one predetermined received signal are further put in phase with the one predetermined received signal by means of a transformation matrix including the calculated transformation matrix elements, the predetermined one received signal is combined in phase with the plurality of received signals put in phase, and the resulting received signal is outputted. With the above-mentioned operation or calculation, calculation of the elements of the transformation matrix used in effecting the in-phase combining process is remarkably simplified with a simplified circuit construction, thereby allowing the control apparatus to be compacted and reduced in weight.

Furthermore, the transmitting signal is distributed in phase into a plurality of transmitting signals, and the phases of the plurality of transmitting signals are shifted by the respective calculated correction phase amounts or the regression-corrected correction phase amounts, and the resulting transmitting signals are transmitted from the plurality of antenna elements. Therefore, the transmitting beam can be automatically directed to the direction of the incoming beam, so that a transmitting antenna use beam forming apparatus can be simply constructed.

Furthermore, the first present invention have further distinctive advantageous effects as follows.

(1) The above-mentioned operations or calculations can be effected no matter whether the intervals of the arrangement of the antenna elements are regular intervals or irregular intervals and no matter whether the antenna plane is a flat plane or a curved plane. Accordingly, there is a great degree of freedom in regard to the arrangement of the antenna elements, so that an array antenna construction conforming to the configuration of each mobile body can be achieved.

(2) The above-mentioned acquisition and tracking operations are all effected on the received signals by signal processing such as digital signal processing. The above-mentioned arrangement obviates the need of any such devices as microwave shifters corresponding in number to the antenna elements, sensors for acquisition and tracking and a motor for mechanical drive, thereby allowing the control apparatus to be compacted and inexpensive.

Further, the second present invention has distinctive advantageous effects as follows.

(1) Since neither a special azimuth sensor nor position data of the remote station of the other party as in the first prior art is required, the present apparatus receives no influence of the environmental magnetic turbulence, accumulation of azimuth detection errors and the like. Further, when the remote station of the other party moves, a transmitting beam can be automatically formed in the direction of the incoming wave transmitted from the remote station of the other party, while allowing downsizing and cost reduction to be achieved.

(2) Instead of directly frequency-converting the reception phase difference of the reception antenna to make it a transmission phase difference as in the second prior art, the removal of the phase uncertainty is effected based on the least square method and the influence of the multi-path waves except for the greatest received wave is removed. Therefore, even when the greatest received wave comes in whichever direction in the multi-path wave environment, the transmitting beam can be surely formed in the direction in which the greatest received wave comes. Furthermore, even when there is a difference between the transmission frequency and the reception frequency, the possible interference exerted on the remote station of the other party can be reduced.

(3) There can be achieved a construction free of any mechanical drive section for the antenna and any feedback loop in forming the transmitting beam. Therefore, upon obtaining a received baseband signal, the transmission weight can be immediately decided, so that the transmitting beam can be formed rapidly in real time.

(4) The determination of the transmission weight can be executed in a digital signal processing manner. Therefore, by executing the transmitting beam formation in a digital signal processing manner, the baseband processing including modulation can be entirely integrated into a digital signal processor. When a device having a high degree of integration is used, the entire system can be compacted with cost reduction.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which:

FIG. 3 is a block diagram of an amplitude and phase difference correcting circuit shown in FIG. 1;

FIG. 9A is a graph showing a transition in time of an antenna pattern in a beam acquiring time under the same conditions as those of FIG. 8A;

FIG. 9B is a graph showing a transition in time of an antenna pattern in a beam acquiring time under the same conditions as those of FIG. 8B;

FIG. 23 is a block diagram of a transmitting weighting coefficient calculation circuit 30 shown in FIG. 18;

FIG. 29 is an explanatory view of check and removal of phase uncertainty in the transmitting weighting coefficient calculation circuit 30 shown in FIG. 23;

FIG. 37 is a block diagram of a transmitting weighting coefficient calculation circuit 30*a* of a modification of the preferred embodiment.

DETAILED DESCRIPTION OF THE PREFERRED EMBODIMENTS

Preferred embodiments of the present invention will be described below with reference to the accompanying drawings.

First preferred embodiment

Figure 1:
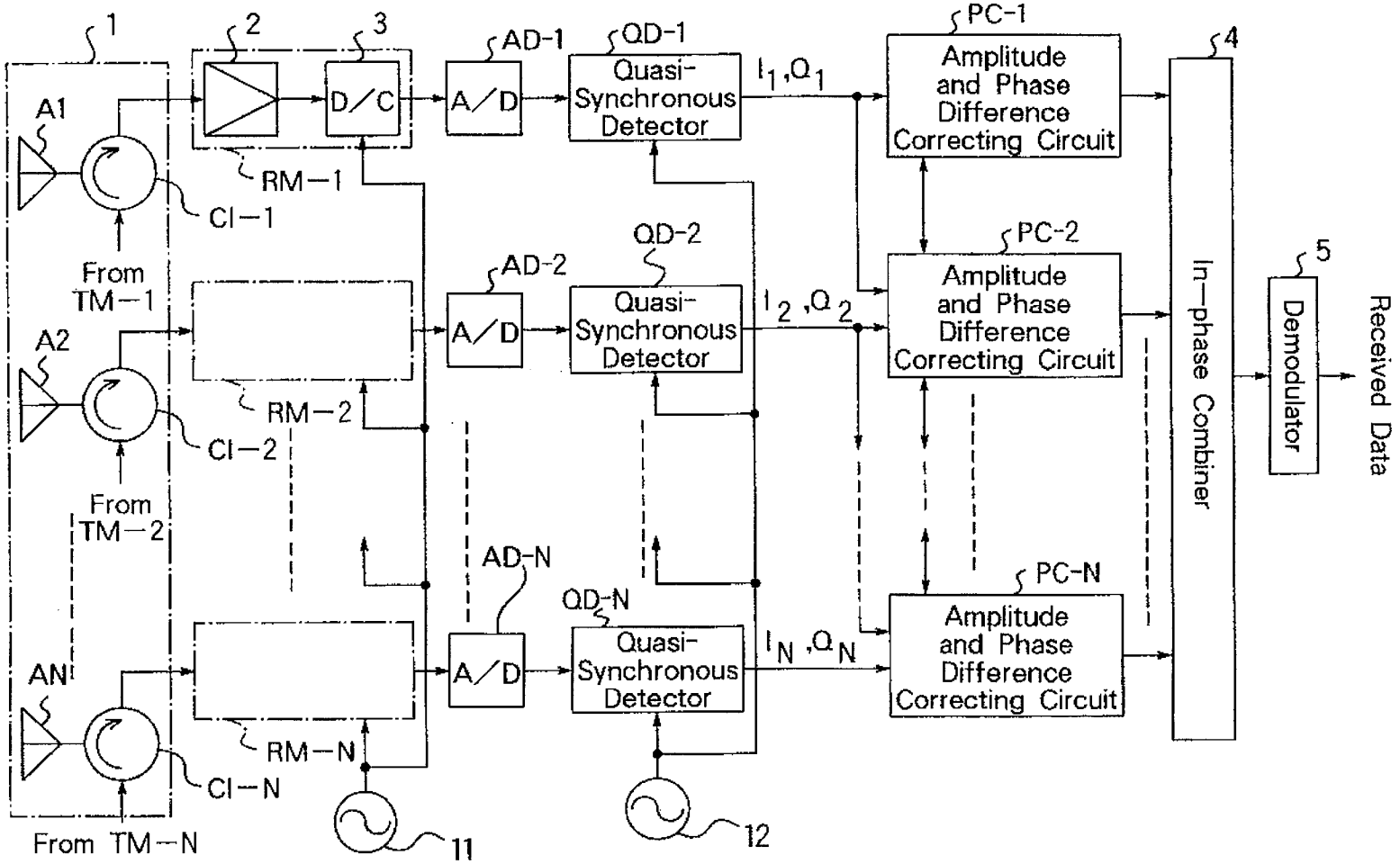
FIG. 1 is a block diagram of a receiver section of an automatic beam acquiring and tracking apparatus of an array antenna for use in communications according to the first preferred embodiment of the present invention.

FIG. 1 is a block diagram of a receiver section of an automatic beam acquiring and tracking apparatus of an array antenna for use in communications according to the first preferred embodiment of the present invention.

Referring to FIG. 1, according to the automatic beam acquiring and tracking apparatus of the array antenna for use in communications of the present preferred embodiment, a directivity of an array antenna 1 comprised of a plurality of N antenna elements A1, A2, . . . , Ai, . . . , AN arranged adjacently at predetermined intervals in an arbitrary flat plane or a curved plane is rapidly directed to a direction in which a radio signal wave such as a digital phase modulation wave or an unmodulated wave comes so as to perform tracking. In this case, in particular, the acquiring and tracking apparatus of the present preferred embodiment is characterized in comprising quasi-synchronous detectors QD-1 through QD- N and amplitude and phase difference correcting circuits PC-1 through PC-N.

As shown in FIG. 1, the array antenna 1 is provided with N antenna elements A1 through AN and circulators CI-1 through CI-N which serve as transmission and reception separators. Further, each of receiver modules RM-1 through RM-N comprises a low-noise amplifier 2 and a down converter (D/C) 3 which frequency-converts a radio signal having a received radio frequency into an intermediate frequency signal having a predetermined intermediate frequency by means of a common first local oscillation signal outputted from a first local oscillator 11.

The receiver section of the acquiring and tracking apparatus further comprises:

(a) N analog-to-digital converters (referred to as A/D converters hereinafter) AD-1 through AD-N;

(b) N quasi-synchronous detectors QD-1 through QD-N, each of which subjects each intermediate frequency signal obtained through an analog-to-digital conversion process (referred to an A/D conversion process hereinafter) to a quasi-synchronous detection process by means of a common second local oscillation signal outputted from a second local oscillator 12, and then converts the resulting signal into a pair of baseband signals orthogonal to each other, wherein a pair of baseband signals is referred to as quadrature baseband signals hereinafter;

(c) N amplitude and phase difference correcting circuits PC-1 through PC-N, each of which calculates a phase difference estimation value between adjacent antenna elements of each combination and an intensity of a signal received by each of the antenna elements A1 through AN by means of the converted quadrature baseband signals, and then, executes an amplitude and phase correcting process for each of the antenna elements A1 through AN so as to effect weighting on all baseband signals so as to put the signals in phase;

an in-phase combiner 4 which combines in phase output signals from the amplitude and phase difference correcting circuits PC-1 through PC-N; and a demodulator 5 which effects synchronous detection or delayed detection on a baseband signal outputted from the in-phase combiner 4 in a predetermined baseband demodulation process, extracts desired digital data therefrom, and then outputs the digital data as received data.

In the above-mentioned receiver section, lines extending from the antenna elements A1 through AN of the array antenna 1 to the amplitude and phase difference correcting circuits PC-1 through PC-N are connected in series every antenna element system. The signal processings for respective antenna element systems of the receiver section are executed in a similar manner to that of one another, and therefore, the processing of the radio signal wave received by the antenna element Ai will be described.

The radio signal wave received by the antenna element Ai is inputted to the down converter 3 via the circulator CI-i and the low-noise amplifier 2 of the receiver module RM-i. The down converter 3 of the receiver module RM-i frequency-converts the inputted radio signal into an intermediate frequency signal having the predetermined intermediate frequency using the common first local oscillation signal outputted from the first local oscillator 11, and then outputs the resulting signal to the quasi-synchronous detector QD-i via the A/D converter AD-i. The quasi-synchronous detector QD-i subjects the inputted intermediate frequency signal obtained through the A/D conversion process to a quasi-synchronous detection process using the common second local oscillation signal outputted from the second local oscillator 12 so as to convert the signal into each pair of quadrature baseband signals $I_i$ and $Q_i$ orthogonal to each other, and then outputs the signals to the amplitude and phase difference correcting circuit C-i and the adjacent amplitude and phase difference correcting circuit PC-(i+1). The amplitude and phase difference correcting circuit PC-i calculates a phase difference estimation value $\delta c_{i-1,i}$ between adjacent antenna elements and the intensity of the signal received by each of the antenna elements A1 through AN by means of the inputted quadrature baseband signals $I_i$ and $Q_i$ and quadrature baseband signals $I_{i-1}$ and $Q_{i-1}$ of an antenna element A-(i−1), and executes an amplitude and phase correcting process for the antenna element Ai by effecting phase difference correction (or phase shift) based on the above-mentioned calculated phase difference estimation value so that all the baseband signals are put in phase, and then effecting weighting on each baseband signal with an amplification gain proportional to the calculated received signal intensity. The baseband signals obtained through the above-mentioned processes are inputted to the in-phase combiner 4.

A circuit processing of the amplitude and phase difference correcting circuit PC-i will be described in detail hereinafter.

The in-phase combiner 4 combines in phase the baseband signals inputted from the amplitude and phase difference correcting circuits PC-1 through PC-N every channel, and thereafter, outputs the resulting signal to the demodulator 5. The demodulator 5 effects synchronous detection or delayed detection on each inputted baseband signal in a predetermined baseband demodulation process, extracts the desired digital data therefrom, and then, outputs the digital data as received data.

Figure 2:
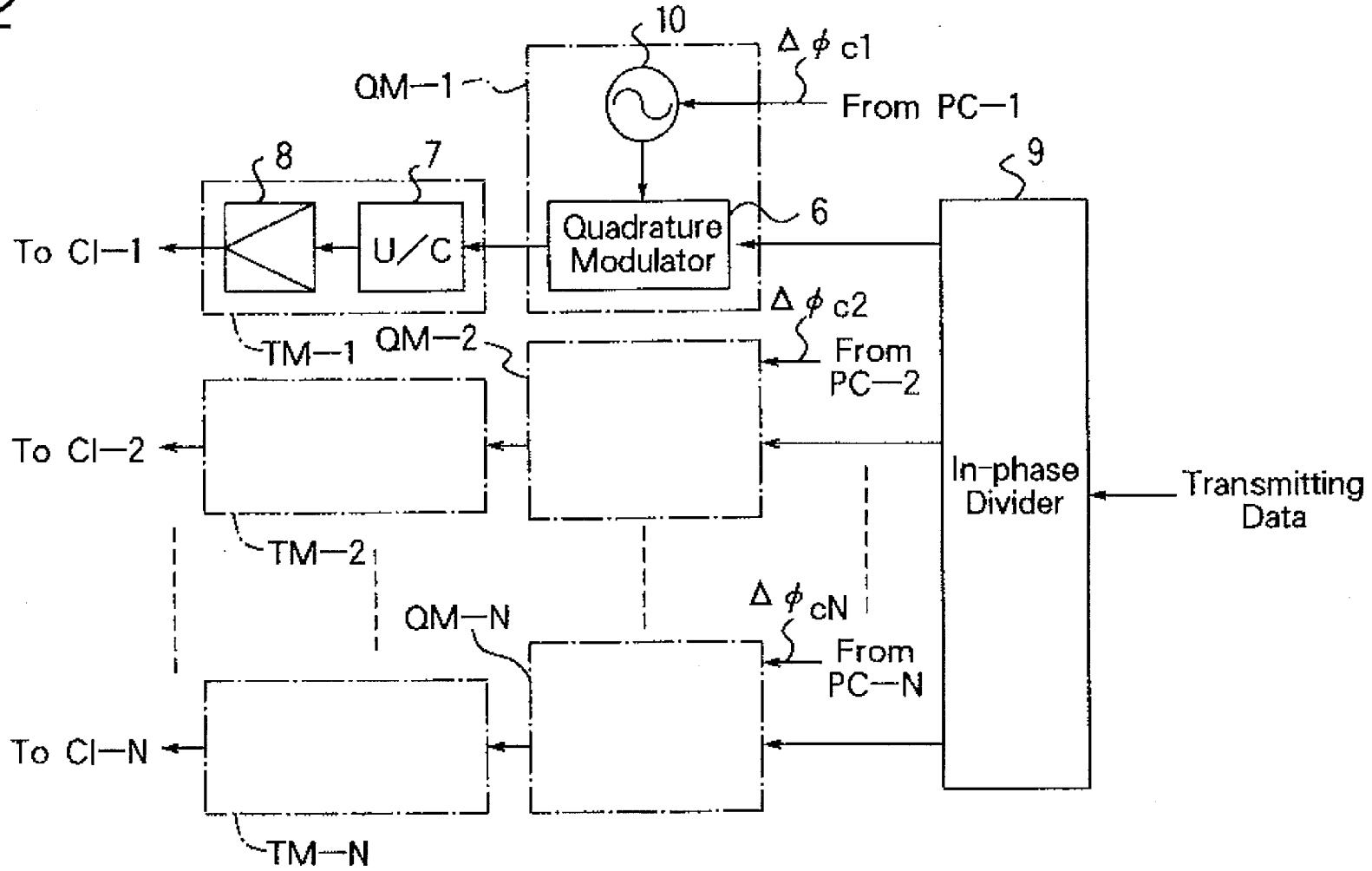
FIG. 2 is a block diagram of a transmitter section of the automatic beam acquiring and tracking apparatus shown in FIG. 1.

FIG. 2 is a block diagram of a transmitter section of the above-mentioned automatic beam acquiring and tracking apparatus.

Referring to FIG. 2, the transmitter section comprises N transmitter modules TM-1 through TM-N, N quadrature modulator circuits QM-1 through QM-N, and an in-phase divider 9. In the present case, each of the quadrature modulator circuits QM-1 through QM-N comprises a quadrature modulator 6 and a transmission local oscillator 10, while each of the transmitter modules TM-1 through TM-N comprises an up-converter (U/C) 7 for frequency-converting the inputted intermediate frequency signal into a transmitting signal having a predetermined transmitting radio frequency, and a transmission power amplifier 8. In the present case, the transmission local oscillator 10 in each of the quadrature modulator circuits QM-1 through QM-N is implemented by, for example, an oscillator employing a DDS (Direct Digital Synthesizer) driven with an identical clock, and operates to generate a transmitting local oscillation signal having a phase corresponding to each phase correction amount based on phase correction amounts $\Delta\phi_{c1}$ through $\Delta\phi_{cN}$ inputted from a least square regression correcting section 42.

The baseband signal, or the transmitting data is inputted to the in-phase divider 9, and thereafter, the input signal is distributed in phase into a plurality of N baseband signals, which are inputted to the quadrature modulator 6 of each of the quadrature modulator circuits QM-1 through QM-N. For instance, the quadrature modulator 6 of the quadrature modulator circuit QM-1 effects a quadrature modulation such as a QPSK or the like on the transmitting local oscillation signal according to the transmitting baseband signal inputted from the in-phase divider 9. Thereafter, the intermediate frequency signal obtained through the quadrature modulation is inputted as a transmitting radio signal to the circulator CI-1 of the array antenna 1 via the up-converter 7 and the transmission power amplifier 8 of the transmitter module TM-1. Then, the transmitting radio signal is radiately transmitted from the antenna element A1. Further, similar signal processing is executed in each system of the transmitter section connected to the antenna elements A2 through AN.

FIG. 3 shows a block diagram of one system corresponding to the i-th antenna element Ai (i=1, 2, 3, . . . , N) of the amplitude and phase difference correcting circuits PC-1 through PC-N shown in FIG. 1.

Referring to FIG. 3, the amplitude and phase difference correcting circuit PC-i is a circuit for estimating and determining a phase difference $\delta c_{i-1,i}$ between adjacent antenna elements of a received radio signal composed of a digital phase modulation wave, an unmodulated wave or the like, making the phase difference zero, i.e., effecting phase correction for each antenna element so as to put the signals in phase, and then, effecting amplification every system with a gain proportional to the signal intensity of the received radio signal so as to improve the received signal to noise power ratio when a plurality of N baseband signals are combined in phase.

As shown in FIG. 3, the amplitude and phase difference correcting circuit PC-i comprises a phase difference estimation section 40, an adder 41, a least square regression correcting section 42, a delay buffer memory 43, a phase difference correcting section 44, and an amplitude correcting section 45. In the amplitude and phase difference correcting circuit PC-1, $\Delta\phi_1$ is set to zero without providing the phase difference estimation section 40 and the adder 41.

The quadrature baseband signals $I_i$ and $Q_i$, or the received signals inputted from the quasi-synchronous detector QD-1 (hereinafter, $I_i$ is referred to as an I-channel baseband signal, and $Q_i$ is referred to as a Q-channel baseband signal) are inputted to the phase difference estimation section 40 and the delay buffer memory 43. The phase difference estimation section 40 operates based on the quadrature baseband signals (sample values) $I_i$ and $Q_i$ and $I_{i-1}$ and $Q_{i-1}$ outputted respectively from the quasi-synchronous detectors QD-i and QD-(i−1) of two adjacent antenna elements Ai and Ai-1 to estimate the phase difference $\delta c_{i-1,i}$ between the systems of the two adjacent antenna elements Ai and Ai-1 at each sampling timing, and then output the estimated value to the adder 41. The adder 41 adds the estimated phase difference $\delta c_{i-1,i}$ inputted from the phase difference estimation section 40 to an accumulative correction phase amount $\Delta\phi_{i-1}$ outputted from the adder 41 of the amplitude and phase difference correcting circuit PC-(i−1), and then, outputs the resulting accumulative correction phase amount $\Delta\phi_i$ through the addition to the least square regression correcting section 42 and to the adder 41 of the next amplitude and phase difference correcting circuit PC-(i+1).

The least square regression correcting section 42 outputs phase correction amounts $\Delta\phi_{c1}$ through $\Delta\phi_{cN}$ of a reception phase difference relevant to the antenna elements A1 through AN for suppressing noises taking advantageous effects of a spatial characteristic of the array antenna based on the accumulative correction phase amounts $\Delta\phi_1$ through $\Delta\phi_N$ of each antenna element obtained by successively accumulating the estimated phase difference $\delta_{ci-1,i}$ by means of the adder 41 every antenna element system to the phase difference correcting sections 44 of the amplitude and phase difference correcting circuits PC-1 through PC-N, and then, outputs the same phase correction amounts $\Delta\phi_{c1}$ through $\Delta\phi_{cN}$ to the transmission local oscillators 10 inside the quadrature modulator circuits QM-1 through QM-N. The least square regression correcting section 42 is provided singly in the receiver section, and implemented by, for example, a DSP (Digital Signal Processor).

On the other hand, the delay buffer memory 43 delays the quadrature baseband signals $I_i$ and $Q_i$ by a delay time for phase difference estimation corresponding to a time of operations or calculations of the phase difference estimation section 40, the adder 41, and the least square regression correcting section 42, and then, outputs the resulting signals to the phase difference correcting section 44. Subsequently, the phase difference correcting section 44 operates based on the correction amount $\Delta\phi_{ci}$ of the reception phase difference outputted from the least square regression correcting section 42 to correct the phases of the quadrature baseband signals outputted from the delay buffer memory 43 by rotating the phases of the signals each by a phase shift amount corresponding to the correction amount $\Delta\phi_{ci}$, and then outputs the resulting signal to the amplitude correcting section 45. Thereafter, the amplitude correcting section 45 amplifies the quadrature baseband signals outputted from the phase difference correcting section 44 with gains proportional to the signal intensity of the quadrature baseband signals, and then, outputs the resulting signals as quadrature baseband signals $Ic_i$ and $Qc_i$ to the in-phase combiner 4.

Assuming now that sample values of the quadrature baseband signals at a certain time point after the quasi-synchronous detection process of the adjacent two antenna elements Ai-1 and Ai are respectively $I_{i-1}$ and $Q_{i-1}$ and $I_i$ and $Q_i$, then an instantaneous phase difference $\delta_{i-1,i}$ calculated by the phase difference estimation section 40 is expressed by an angle made by two vectors $(I_{i-1}, Q_{i-1})$ and $(I_i, Q_i)$ in a phase plane. In the case of digital phase modulation, $I_{i-1}$, $Q_{i-1}$, $I_i$ and $Q_i$ are expressed by the following Equations (1) through (4).

$$I_{i-1}=a_{i-1}\cos(\theta) \quad (1)$$

$$Q_{i-1}=a_{i-1}\sin(\theta) \quad (2)$$

$$I_i=a_i\cos(\theta+\delta_{i-1,i}) \quad (3)$$

$$Q_i=a_i\sin(\theta+\delta_{i-1,i}) \quad (4)$$

where $a_{i-1}$ and $a_i$ represent the amplitudes of the baseband signals, and $\theta$ represents an arbitrary phase angle of each baseband signal varying according to modulated phase data. Therefore, by performing a baseband processing as expressed by the following Equations (5) and (6), values that are proportional to the sine and cosine of the phase difference $\delta_{i-1,i}$ and that do not at all depend on the modulated phase data can be obtained.

$$I_{i-1}\cdot I_i+Q_{i-1}\cdot Q_i=a_{i-1}a_i\cos\delta_{i-1,i} \quad (5)$$

$$I_{i-1}\cdot Q_i-I_i\cdot Q_{i-1}=a_{i-1}a_i\sin\delta_{i-1,i} \quad (6)$$

According to the above-mentioned Equations, the instantaneous phase difference $\delta_{i-1,i}$ of the adjacent two antenna elements Ai–1 and Ai is expressed by the following Equation (7) to be calculated.

$$\delta_{i-1,i}=\tan^{-1}\frac{I_{i-1}\cdot Q_i-I_i\cdot Q_{i-1}}{I_{i-1}\cdot I_i+Q_{i-1}\cdot Q_i}, \quad (7)$$

$$i=2, 3, 4, \ldots, N$$

The above-mentioned Equations depend neither on the modulated phase data of each signal nor the amplitudes $a_{i-1}$ and $a_i$. Therefore, the phase difference $\delta_{i-1,i}$ can be calculated independently of the modulation. In the present case, the transformation from Equations (1) through (4) to Equation (7) represents a transformation from the I-axis and the Q-axis that are perpendicular to each other into two axes that are perpendicular to each other for defining the phase difference $\delta_{i-1,i}$, and this means a rotation of coordinates around an axial center. In the Equation (7), data of the denominator of the fraction of the right hand member is the left hand member of the Equation (5), and is directly proportional to the cosine of the phase difference $\delta_{i-1,i}$ as shown in the Equation (5). On the other hand, in the Equation (7), data of the numerator of the fraction of the right hand member is the left hand member of the Equation (6), and is directly proportional to the sine of the phase difference $\delta_{i-1,i}$ as shown in the Equation (6).

In order to obtain a more correct phase difference by suppressing noises (which are mainly thermal noises of the receiver) included in the received radio signal, the two pieces of data obtained according to the Equation (5) and the Equation (6) are each passed or put through a predetermined digital filter included in the phase difference estimation section 40 to be filtered. In the present case, the filtering is effected prior to the calculating operations of division and $\tan^{-1}$ for the purpose of preventing the possible increase of errors in the calculations. A phase difference $\delta c_{i-1,i}$ obtained through the filtering process is estimated according to the following Equation (8).

$$\delta c_{i-1,i}=\tan^{-1}\frac{F(I_{i-1}\cdot Q_i-I_i\cdot Q_{i-1})}{F(I_{i-1}\cdot I_i+Q_{i-1}\cdot Q_i)}, \quad (8)$$

$$i=2, 3, 4, \ldots, N$$

where F(·) represents a transfer function of the digital filter. The digital filter can be implemented by any of a variety of filters such as a simple cyclic adder and a transversal filter provided with an adaptive tap coefficient. The phase difference estimation section 40 calculates the phase difference $\delta c_{i-1,i}$ obtained through the filtering process according to the Equation (8), and then, outputs the resultant to the adder 41.

Figure 4:
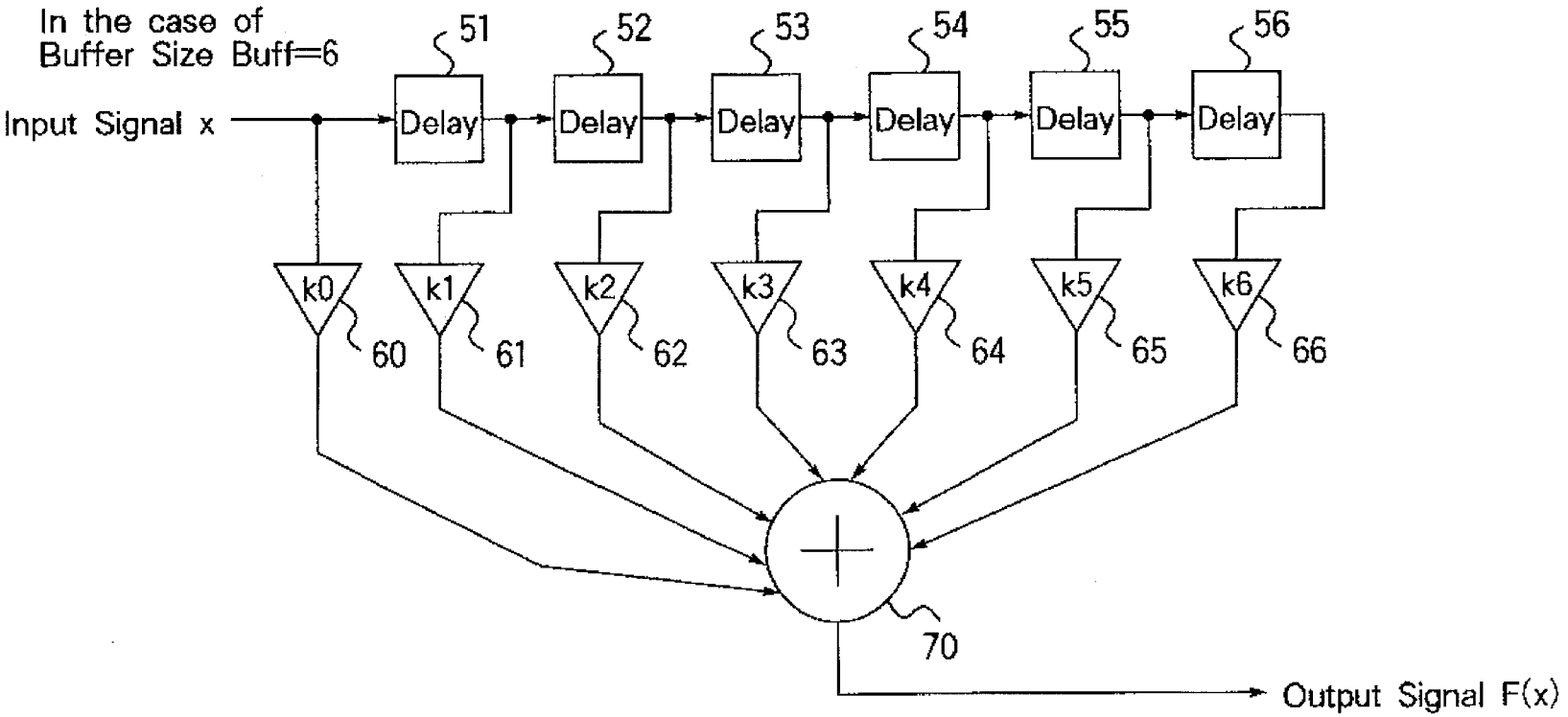
FIG. 4 is a block diagram of a transversal filter included in a phase difference estimation section shown in FIG. 3.

FIG. 4 shows a construction of an exemplified FIR (Finite Impulse Response) filter provided with fixed tap coefficients included in the phase difference estimation section 40. In the example shown in FIG. 4, the buffer size Buff=7.

Referring to FIG. 4, an input signal x is inputted to an adder 70 via a tap coefficient multiplier 60, and also the input signal x is inputted to an input terminal of six delay circuits 51 through 56 connected in series. Signals outputted from the delay circuits 51 through 56 are inputted to the adder 70 via tap coefficient multipliers 61 through 66, respectively. In the present case, the multipliers 60 through 66 have respective tap coefficients k0 through k6, respectively, which are multiplication coefficients, and then outputs the inputted signals to the adder 70 by multiplying the signals with the respective tap coefficients. The adder 70 sums up all the signals inputted thereto, and then, outputs the resultant sum signal as an output signal F(x).

Assuming that the tap coefficients k0 through k6 are all one, the filter is a simple cyclic adder. The buffer size of each of the filters will be referred to merely as a buffer size Buff.

Based-on the estimated phase difference $\delta c_{i-1,i}$ calculated according to the Equation (8), the amount of phase to be corrected in each antenna element system (referred to as a correction phase amount hereinafter) $\Delta\phi_i$ (i=1, 2, . . . , i, . . . , N) is expressed by the following Equations (9) and is calculated by the adder 41.

$$\Delta\phi_1=0$$

$$\Delta\phi_2=\Delta\phi_1+\delta c_{1,2}$$

$$\Delta\phi_3=\Delta\phi_2+\delta c_{2,3} \text{ - - -}$$

$$\Delta\phi_i=\Delta\phi_{i-1}+\delta c_{i-1} \text{ - - -}$$

$$\Delta\phi_N=\Delta\phi_{N-1}+\delta c_{N-1,N} \quad (9)$$

In the Equations (9), it is assumed that the antenna element A1 is used as a phase reference (phase zero), and the phases of all the antenna elements A1 through AN are made to coincide with the phase of the antenna element A1. There can be selected several methods of setting an order for calculating the correction phase amounts as follows.

Figure 5A:
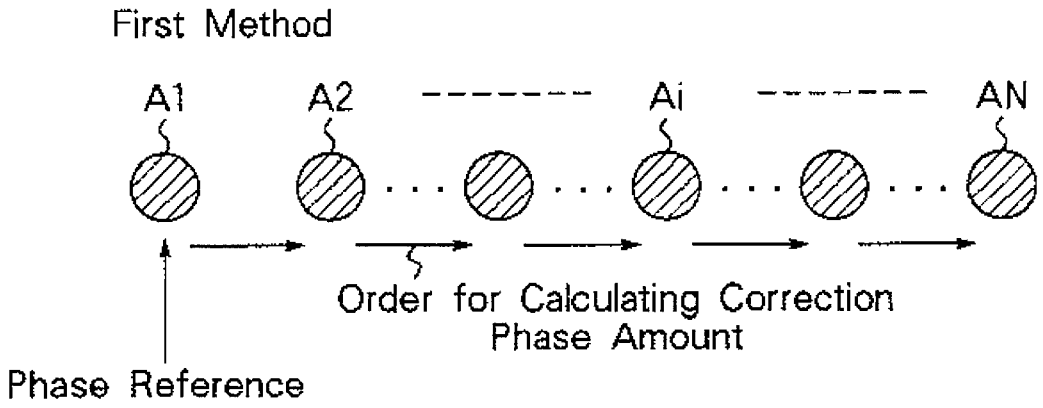
FIG. 5A is a front view of antenna elements showing an order for calculating a correcting phase amount according to the first method for the antenna elements of the array antenna.
Figure 5B:
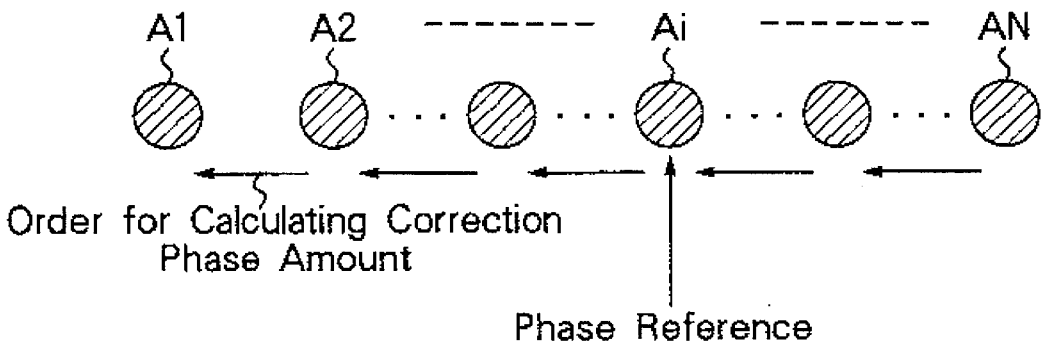
FIG. 5B is a front view of antenna elements showing an order for calculating a correcting phase amount according to the second method for the antenna elements of the array antenna.

In the case where the antenna elements A1 through AN are arranged in a linear array, there are a first method of using an antenna element A1 located at either end as a phase reference and executing calculation sequentially therefrom as shown in FIG. 5(*a*), and a second method of using a certain antenna element Ai (1<i<N) as a phase reference and executing calculation parallel towards both ends thereof. The latter method achieves a higher calculation speed since the parallel processing that diverges into two branches is executed, however, two outputs are necessary at the element that serves as the phase reference.

Figure 6:
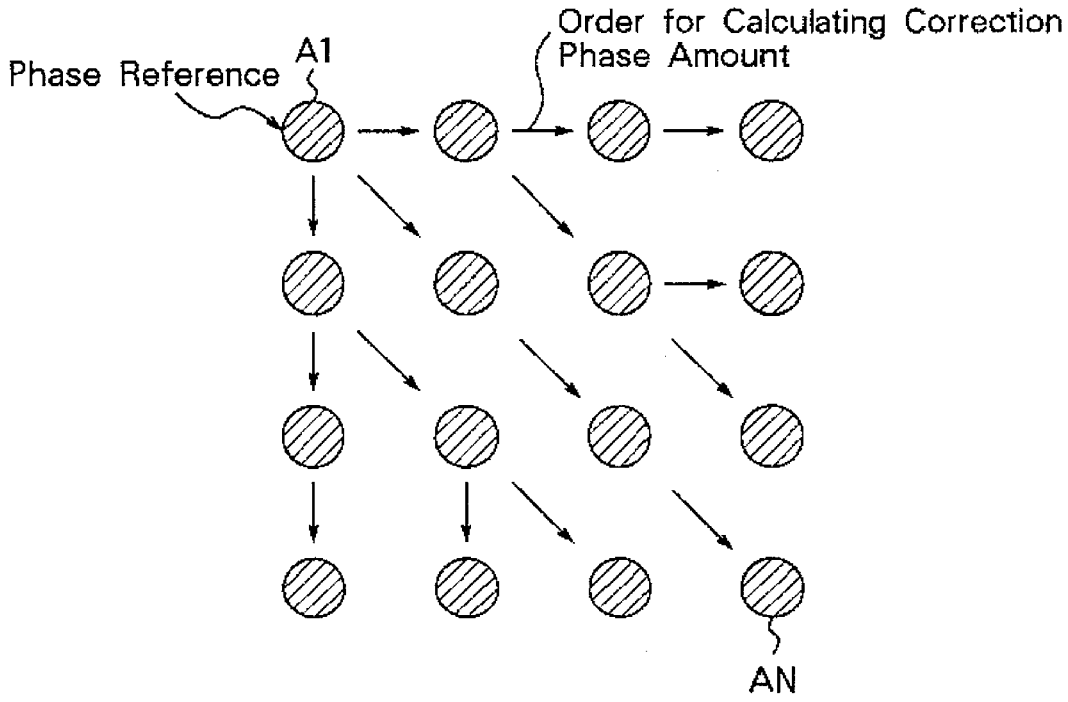
FIG. 6 is a front view of antenna elements showing an order for calculating a correcting phase amount according to the third method for the antenna elements of the array antenna.

In the case where the antenna elements A1 through AN are arranged in a two-dimensional matrix array, assuming that input and output ports (referred to as an I/O ports hereinafter) are limited in number to three in total per element, there can be exemplified a method of using an antenna element A1 located diagonally at one end as a phase reference and summing up phase differences in a manner of divergence into branches as shown in FIG. 6. According to this method, there are executed three of accumulative additions in every branch. In a case where the antenna elements are arranged in another arbitrary array form, a speedy calculation can be achieved in a parallel calculation manner in accordance with the practices of the above-mentioned examples.

In regard to the calculated correction phase amount $\Delta\phi_i$, noise components are suppressed by a digital filter of the phase difference estimation section 40 in each antenna element system. However, when a cut-off characteristic of the filter is made excessively steep, this results in an increased response delay, and accordingly, there is a limit in suppressing the noises by the filter. Therefore, by effecting linear, flat or curved plane regression correction on the correction phase amounts in array space signal processing by means of least square method as described below in the least square regression correcting section 42, the noise characteristic on the receiver side is improved.

Figure 7:
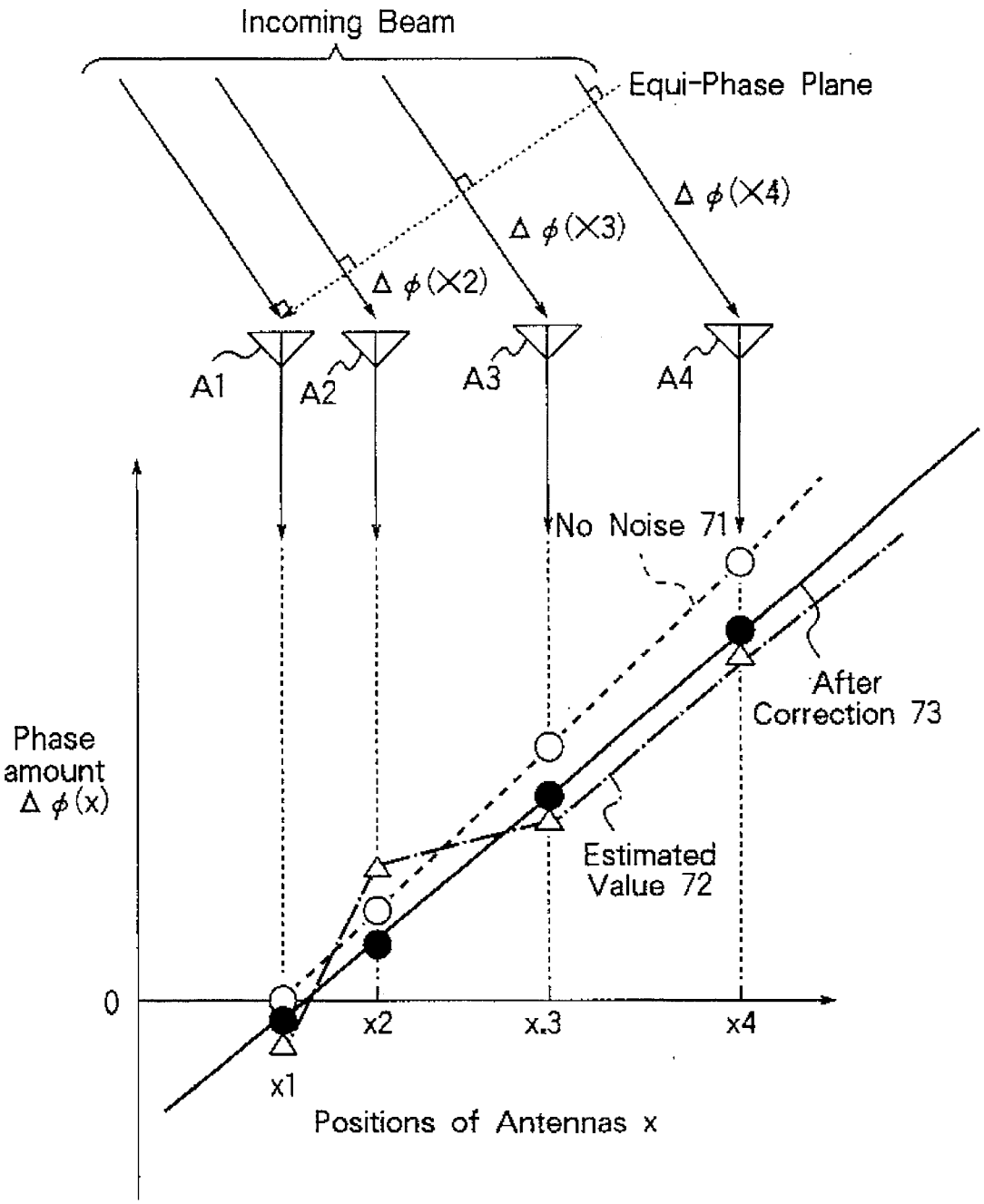
FIG. 7 is a schematic view showing a relationship between an incoming beam and each antenna element with a graph showing a relationship between a position of each antenna element and a phase amount.

For simplicity, assuming that four antenna elements A1 through A4 are arranged at arbitrary intervals in line and one incoming beam of a radio signal wave is received in a certain direction, reception phases of the antenna elements A1 through A4 are as shown in FIG. 7. It is to be noted that no original noise is included in the incoming beam. In the present case, each reception phase can be obtained correctly if no receiver noise exists, and therefore, as indicated by a reference numeral 71 in FIG. 7, a reception relative phase amount $\Delta\phi_i(x)$ of the i-th antenna element located in a position x becomes a linear function relative to the positions of antennas x. However, practically there are independent receiver noises (mainly thermal noises) in each of the systems of the antenna elements A1 through AN, and therefore, the phase amount (estimated value) $\Delta\phi_i(x)$ to be calculated is as indicated by a reference numeral 72 in FIG. 7. In the present case, when a correction is effected by obtaining a regression line $\Delta\phi_{ci}(x)$ such that it minimizes a sum of errors of squares resulting from the reception relative phase amount (estimated value) $\Delta\phi_i(x)$ as indicated by a reference numeral 73 in FIG. 7, the receiver noises can be suppressed.

The above-mentioned regression correcting process of phase amount can be managed similarly in a case where the antenna array is two-dimensional, and is applicable not only to a case where the antenna array is in a flat plane but also to a case where the antenna array is in an arbitrary curved plane. In the latter case, the curved plane is obtained from the configuration of the plane of the antenna array. Although the least square method is used in the regression correcting process, the present invention is not limited to this, and there may be used a numerical calculating method for obtaining an approximated line or curved plane through regression to one line or curved plane.

An example of the calculation will be shown below when the antenna element array is in a linear plane. It is assumed that a position of an arbitrary natural number i-th antenna element ($1 \leqq i \leqq N$) is expressed by (x, y) in an x-y plane, and an equi-phase regression plane $\Delta\phi_{ci}(x, y)$ when an evaluation function J given by the following equation (10) becomes the minimum is calculated according to the following Equation (10).

$$J = \sum_x \sum_y \{\Delta\phi_i(x,y) - \Delta\phi_{ci}(x,y)\}^2 \tag{10}$$

where $\Delta\phi_i(x, y)$ is an estimated value (corresponding to the reference numeral 72 in FIG. 7) of the correction phase amount prior to the least square regression process. In the present case, it is assumed that the antenna element array is an equal-interval matrix array of $x_{max} \times Y_{max}$, and a natural number N ($=x_{max} \times y_{max}$) antenna elements are arranged at intersections of axes of $x=1, 2, \ldots, x_{max}$ and $y=1, 2, \ldots, y_{max}$. The antenna plane is a flat plane, and therefore, the phase plane, i.e., the least square regression plane of correction phase amount is also a flat plane, and the regression plane $\Delta\phi_{ci}(x, y)$ of the correction phase amount can be expressed by the following Equation (11).

$$\Delta\phi_{ci}(x, y) = ax + by + c,\ x=1, 2, \ldots, x_{max};\ y=1, 2, \ldots, y_{max} \tag{11}$$

where, a, b and c are parameters for determining the position of the plane.

In the present case, a normalization equation which provides a condition for minimizing the evaluation function J is expressed by the following Equations (12).

$$\partial J/\partial a = 0$$

$$\partial J/\partial b = 0$$

$$\partial J/\partial c = 0 \tag{12}$$

Then the Equations (12) can be transformed into the following Equation (13).

$$A \begin{bmatrix} a \\ b \\ c \end{bmatrix} = \Phi \tag{13}$$

From the Equation (13), the following Equation (14) is derived.

$$\begin{bmatrix} a \\ b \\ c \end{bmatrix} = A^{-1}\Phi \tag{14}$$

where a matrix A and a matrix $\Phi$ are expressed by the following Equation (15).

$$A = \begin{bmatrix} \sum_x \sum_y x^2 & \sum_x \sum_y xy & \sum_x \sum_y x \\ \sum_x \sum_y xy & \sum_x \sum_y y^2 & \sum_x \sum_y y \\ \sum_x \sum_y x & \sum_x \sum_y y & \sum_x \sum_y 1 \end{bmatrix} \quad \Phi = \begin{bmatrix} \sum_x \sum_y x\Delta\phi_i(x,y) \\ \sum_x \sum_y y\Delta\phi_i(x,y) \\ \sum_x \sum_y \Delta\phi_i(x,y) \end{bmatrix} \tag{15}$$

In the present case, the matrix A is a coefficient matrix depending on only the position coordinates of the antenna elements A1 through AN, and therefore, the inverse matrix $A^{-1}$ can be preparatorily calculated, and this means that no real time calculation is required. For instance, when $x_{max} = y_{max} = 4$, the inverse matrix $A^{-1}$ can be expressed by the following Equation (16).

$$A^{-1} = \begin{bmatrix} 0.05 & 0 & -0.125 \\ 0 & 0.05 & -0.125 \\ -0.125 & -0.125 & 0.6875 \end{bmatrix} \tag{16}$$

Therefore, the parameters a, b and c for determining the position of the plane are expressed by the following Equation (17).

$$\begin{bmatrix} a \\ b \\ c \end{bmatrix} = \begin{bmatrix} 0.05 & 0 & -0.125 \\ 0 & 0.05 & -0.125 \\ -0.125 & -0.125 & 0.6875 \end{bmatrix} \begin{bmatrix} \sum_x \sum_y x\Delta\phi_i(x,y) \\ \sum_x \sum_y y\Delta\phi_i(x,y) \\ \sum_x \sum_y \Delta\phi_i(x,y) \end{bmatrix} \tag{17}$$

Therefore, the regression plane $\Delta\phi_{ci}(x, y)$ is determined by means of the estimated value $\Delta\phi_i(x, y)$ of the correction phase amount, and correction phase amounts $\Delta\phi_{c1}$ ($=\Delta\phi_{c1}(1, 1)$) through $\Delta\phi_{CN}$ ($=\Delta\phi_{CN}(x_{max}, y_{max})$) obtained through the regression correcting process for the respective systems of the antenna elements A1 through AN can be calculated by the least square regression correcting section 42. The above-mentioned calculation example is provided on an assumption that the antenna plane is a linear plane, however, the calculation can be applied to the case of a two-dimensional curved plane or the like.

The above-mentioned process according to the least square method can be skipped while determining the correction phase amount $\Delta\phi_{ci}(x, y) = \Delta\phi_i(x, y)$ when there is a small margin in operating speed. By using the thus obtained correction phase amount $\Delta\phi_{ci}(=\Delta\phi_{ci}(x, y))$, the quadrature baseband signals are each subjected to a phase correcting process in all the antenna element systems according to the following Equation (18) wherein it is assumed that $\Delta\phi_{ci} = \Delta\phi_{ci}(x, y)$.

$$\begin{bmatrix} I'i \\ Q'i \end{bmatrix} = \begin{bmatrix} \cos\Delta\phi_{ci} & \sin\Delta\phi_{ci} \\ -\sin\Delta\phi_{ci} & \cos\Delta\phi_{ci} \end{bmatrix} \begin{bmatrix} Ii \\ Qi \end{bmatrix}, \quad i = 1, 2, \ldots, N \tag{18}$$

where the left hand member of the Equation (18) is a matrix representing a vector of a received baseband signal of the i-th antenna element obtained through the phase correcting process, the first term of the right hand member of the Equation (18) is a phase rotation transformation matrix for effecting phase correction in order to put all the received baseband signals in phase, i.e., a transformation matrix for putting the signals in phase, and the second term of the right hand member is a matrix representing a vector of the received baseband signal prior to the phase correcting process.

When there is a case where a reduction in power of a received signal occurs at some antenna elements due to multi-path fading or interruption, according to an equal-gain in-phase combining process for combining signals of all the antenna elements through equal weighting, a signal having a good quality and a signal having a degraded quality are summed up through equal weighting, and therefore, the signal to noise power ratio deteriorates after the in-phase combining process. In order to suppress the deterioration, the received baseband signals in the systems of the antenna elements A1 through AN are amplified with respective gains G directly proportional to the reception intensities of the signals in the amplitude correcting section 45 as expressed by the following Equations (19). The above-mentioned arrangement is intended to make each signal having a good quality contribute more and make each signal having a degraded quality contribute less.

$$\begin{bmatrix} Ici \\ Qci \end{bmatrix} = G \cdot \begin{bmatrix} I'i \\ Q'i \end{bmatrix}, \quad G = k \cdot Ave\left(\sqrt{I'i^2 + Q'i^2}\right), \quad i = 1, 2, \ldots, N \tag{19}$$

where k represents a proportional constant, and Ave ( ) represents an average value in time.

When the signals obtained through the amplitude correcting process are combined in phase in all the systems of the antenna elements A1 through AN, relative in-phase combining outputs of the quadrature baseband signals are expressed by the following Equations (20).

$$I_c = \sum_i I_{ci} \qquad Q_c = \sum_i Q_{ci} \tag{20}$$

In regard to the amplitude correcting process effected by the amplitude correcting section 45, when differences in power between the antenna elements A1 through AN have no serious problem, the gain G is set to 1 and the process can be skipped. When the in-phase combining output signal is inputted to an arbitrary baseband processing type demodulator 5, a desired digital data can be obtained.

On the other hand, the weight for controlling the directivity of the transmitting array antenna does not include an amplitude component and is required to have only a phase component. Therefore, the correction phase amount $\Delta\phi_{ci}$ calculated by the least square regression correcting section 42 can be directly used as a weight for controlling the directivity of the transmitting array antenna, thereby allowing the transmitting beam to be automatically directed to the direction of the incoming beam. It is to be noted that, depending on cases, it is required to perform a simple transformation process at need in a manner as described below.

For instance, in a case where the array antenna 1 is used commonly for transmission and reception when there is a difference in radio wavelength between transmission and reception, a phase shift amount $\Delta\phi_{Ti}(x, y)$ in each transmitting antenna element system is expressed by the following Equation (21).

$$\Delta\phi_{Ti} = \frac{\lambda_T}{\lambda_R} \cdot \Delta\phi_{ci} \tag{21}$$

It is to be noted that $\lambda_T$ and $\lambda_R$ are free space wavelengths in transmission and reception, respectively. The above-mentioned transformation is not necessary when independent antenna elements are used for transmission and reception and the intervals between the elements are the same in terms of wavelength or when the antenna elements are commonly used for transmission and reception but the transmission and reception frequencies are equal to each other.

The following will describe a calculation result of a simulation carried out to confirm effects produced in receiving an incoming beam by means of the automatic beam acquiring and tracking apparatus for array antenna of the present preferred embodiment having the above-mentioned construction. Conditions for the simulation are shown in Table 1.

TABLE 1

| | |
|---|---|
| Modulation system | QPSK |
| Bit rate | 16 kbps |
| Modulation frequency | 32 kHz |
| Sampling rate | 128 kHz |
| Added noise | Gauss noise |
| Array antenna | 4-element linear array with a point radiation source |
| Antenna element interval | Half wavelength |
| Transmission low-pass filter | 10-tap FIR filter, cut-off frequency = 8 kHz |
| Transmission band-pass filter | 51-tap FIR filter, cut-off frequency = 16 kHz |
| Reception band-pass filter | 51-tap FIR filter, cut-off frequency = 16 kHz |
| Reception low-pass filter | 10-tap FIR filter, cut-off frequency = 8 kHz |
| Remarks | Neither interference wave nor frequency fluctuation occurs |

A digital filter for use in estimating a correction phase amount is a simple cyclic adder (FIR filter having each tap coefficient=1), and an addition buffer size Buff corresponding to the number of taps of the filter was changed so as to examine the effects. It is to be noted that powers received by the antenna elements are same, and no amplitude correction is effected. Further, no least square regression is effected.

Further, in the simulation, the phase difference correcting operation is not effected every sample, however, the frequency of effecting the operation is reduced to a frequency of once in nine samples. With the above-mentioned arrangement, not only an operation load of DSP (Digital Signal Processor) is reduced but also a correlation of noise signals between the calculation samples is reduced, and therefore, more effective noise suppression by means of the digital filter can be achieved.

Figure 8A:
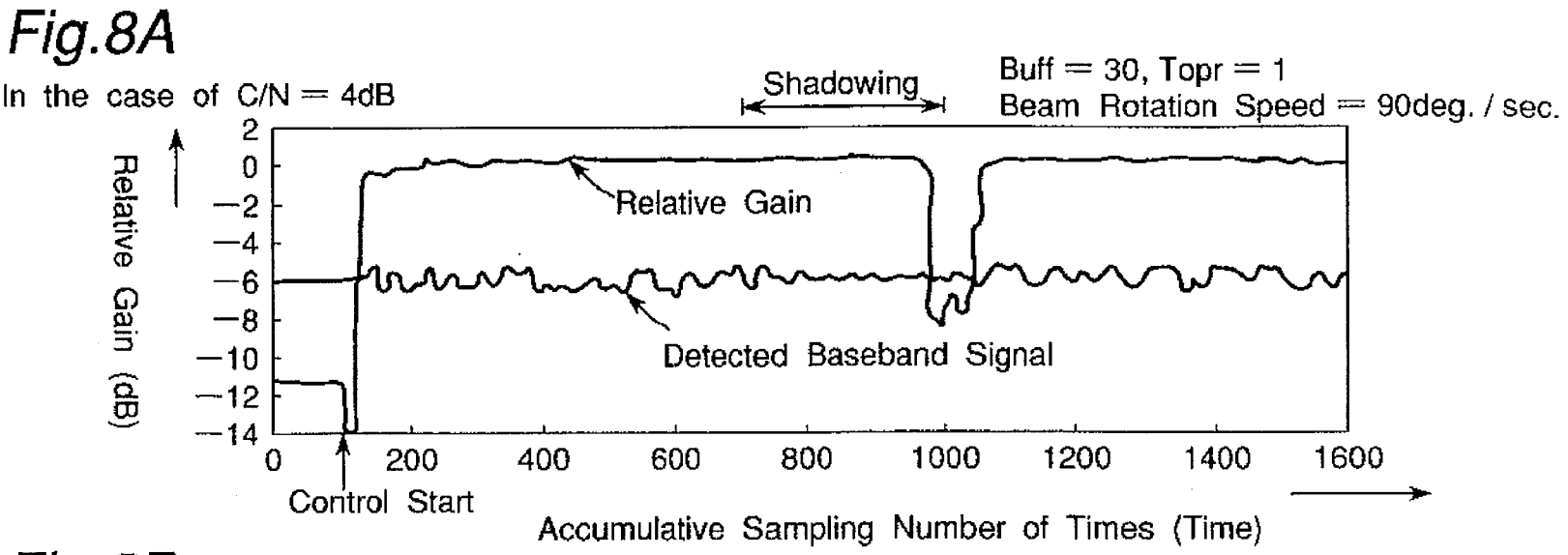
FIG. 8A is a graph showing a transition in time of an antenna relative gain in the case of C/N=4 dB in a direction in which a signal comes when the direction of an incoming signal beam is rotated at a beam rotation speed of 90°/sec in the automatic beam acquiring and tracking apparatus shown in FIG. 1 together with a demodulated baseband signal of a channel I.
Figure 8B:
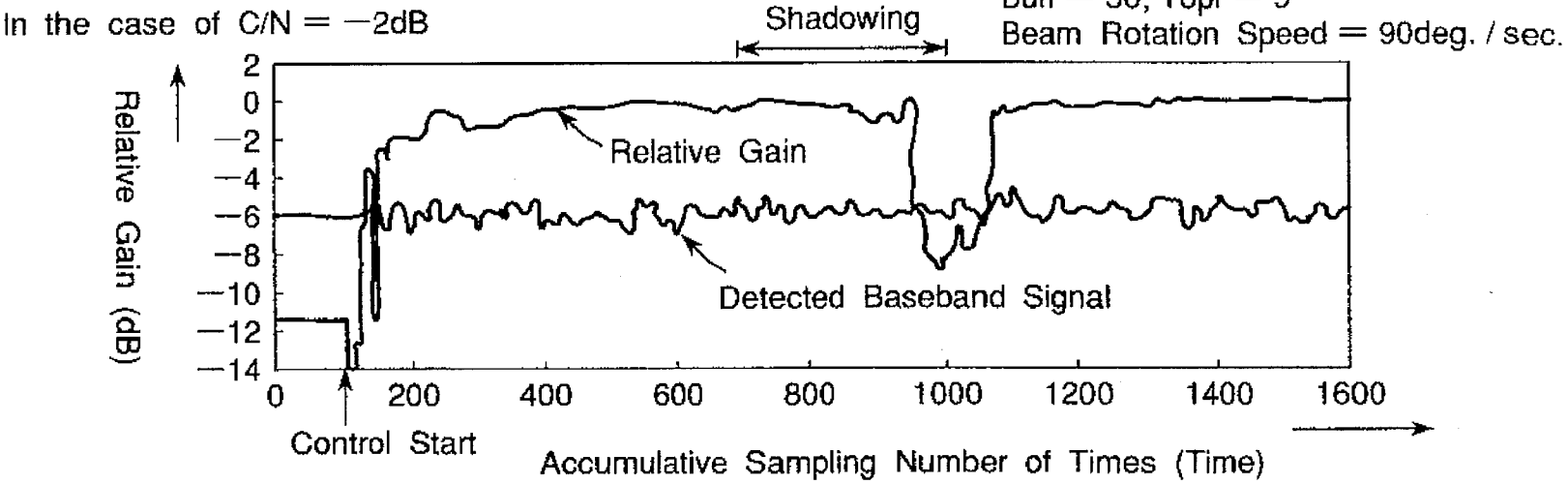
FIG. 8B is a graph showing a transition in time of an antenna relative gain in the case of C/N=−2 dB in a direction in which a signal comes when the direction of an incoming signal beam is rotated at a beam rotation speed of 90°/sec in the automatic beam acquiring and tracking apparatus shown in FIG. 1 together with a demodulated baseband signal of a channel I.

FIGS. 8A and 8B each show a variation in time of an antenna relative gain in a direction in which a signal beam comes when a phase difference estimating operation or calculation is performed every sampling (sampling frequency =128 kHz) together with an I-channel modulation baseband signal (modulation data). In the present case, FIG. 8A shows a case where a reception C/N per antenna element is 4 dB, while FIG. 8B shows a case where C/N is −2 dB. In this regard, C/N represents a ratio of a carrier signal power to noise power (referred to as a carrier signal power to noise power ratio hereinafter).

As shown in FIGS. 8A and 8B, it is assumed that generation of an output of a transmitting signal starts when an accumulative sampling number of times=0, input and calculation of the transmitting signal starts when the accumulative sampling number of times=100, the signal is subjected to a shadowing process (which is interruption of the reception signal) when the accumulative sampling number of times=700 to 1000, and the direction of the incoming signal beam varies at an angle of 90°/sec.

Assuming herein that an operation from the start of the calculation to a time when the antenna relative gain exceeds −3 dB is referred to as "rough acquisition" and an operation to a time when the antenna relative gain exceeds −0.5 dB is referred to as "precise acquisition" the accumulative sampling number of times required for the precise acquisition is about 80 in the case of FIG. 8A, and about 300 in the case of FIG. 8B. Therefore, the accumulative sampling number of times required for the precise acquisition depends on the carrier signal power to noise power ratio C/N. On the other hand, the accumulative sampling number of times required for the rough acquisition does not significantly depend on the carrier signal power to noise power ratio C/N, and the incoming signal beam is acquired when the accumulative sampling number of times is 30 to 50. After the acquisition, as shown in FIG. 8B, the variation of the antenna relative gain increases when the carrier signal power to noise power ratio C/N is low. That is, it can be found that the incoming signal beam is stably tracked in both the cases of FIGS. 8A and 8B. The reason why such fast acquisition and stable tracking are achieved even when the reception carrier signal power to noise power ratio C/N is low is that a phase control of the systems of the antenna elements A1 through AN are effected in a feedforward manner.

FIGS. 9A and 9B each show a variation in time of an antenna pattern when a signal beam is acquired under the same conditions as those of FIGS. 8A and 8B. In FIGS. 9A and 9B, dotted lines indicate an antenna pattern when the accumulative sampling number of times is 8, one-dot chain lines indicate an antenna pattern when the accumulative sampling number of times is 26, and solid lines indicate an antenna pattern when the accumulative sampling number of times is 35 (in the case of FIG. 9A) or 125 (in the case of FIG. 9B).

As is apparent from FIGS. 9A and 9B, the antenna pattern rapidly converges when the antenna pattern changes its state from a random state (when the accumulative sampling number of times is 8) to a state in which a signal beam incident at an angle of −45° is acquired (when the accumulative sampling number of times is 35 (in the case of FIG. 9A) or 125 (in the case of FIG. 9B)).

Figure 10A:
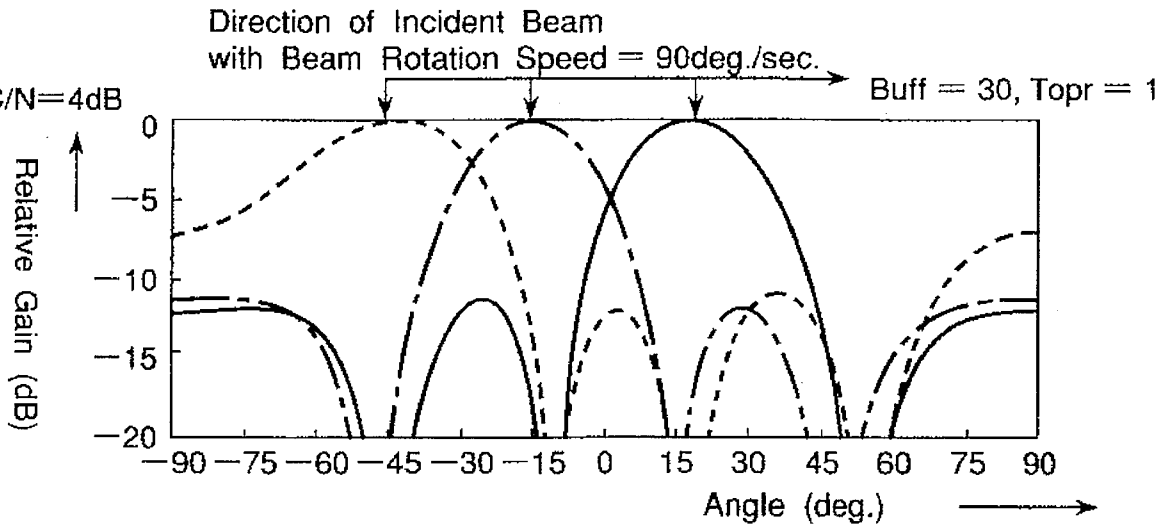
FIG. 10A is a graph showing a transition in time of an antenna pattern when the direction of an incoming signal beam is rotated at a beam rotation speed of 90°/sec under the same conditions as those of FIG. 8A.
Figure 10B:
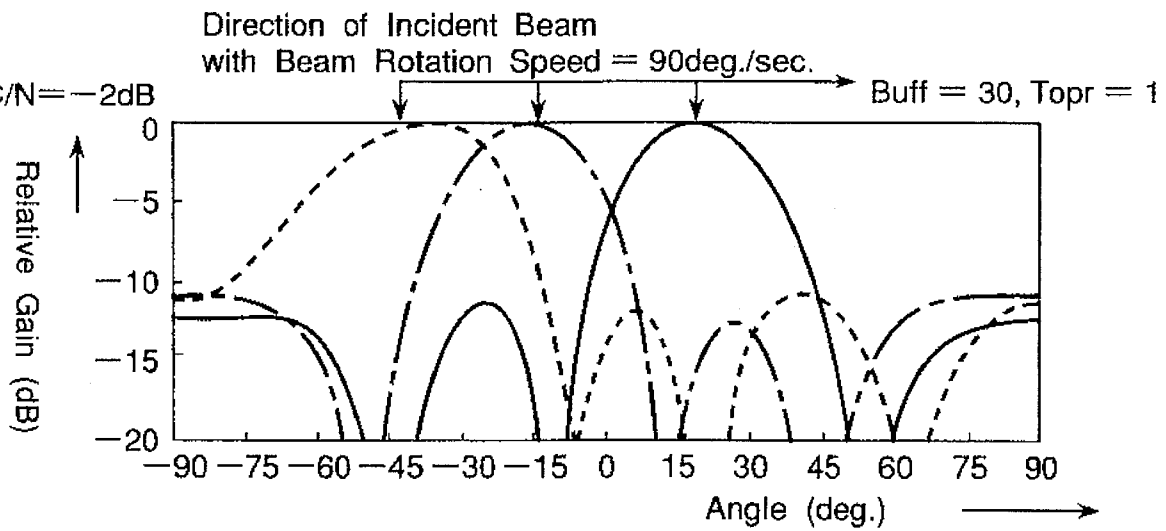
FIG. 10B is a graph showing a transition in time of an antenna pattern when the direction of an incoming signal beam is rotated at a beam rotation speed of 90°/sec under the same conditions as those of FIG. 8B.

FIGS. 10A and 10B each show a variation in time of an antenna pattern based on an assumption that an estimated maximum rotation speed in a normal land mobile body or the like is 90 degrees per second under the same conditions as those of FIGS. 8A and 8B, where the antenna pattern varies with a change in direction of an incoming signal beam. In FIGS. 10A and 10B, each antenna pattern indicated by one-dot chain lines is obtained after an elapse of ⅓ second from the antenna pattern indicated by dotted lines, and each antenna pattern indicated by solid lines is obtained after an elapse of ⅓ second from the antenna pattern indicated by the one-dot chain lines.

As is apparent from FIGS. 10A and 10B, it can be found that the main beam of the array antenna is approximately correctly tracking the incoming signal beam even when the direction of the incoming signal beam changes.

Figure 11:
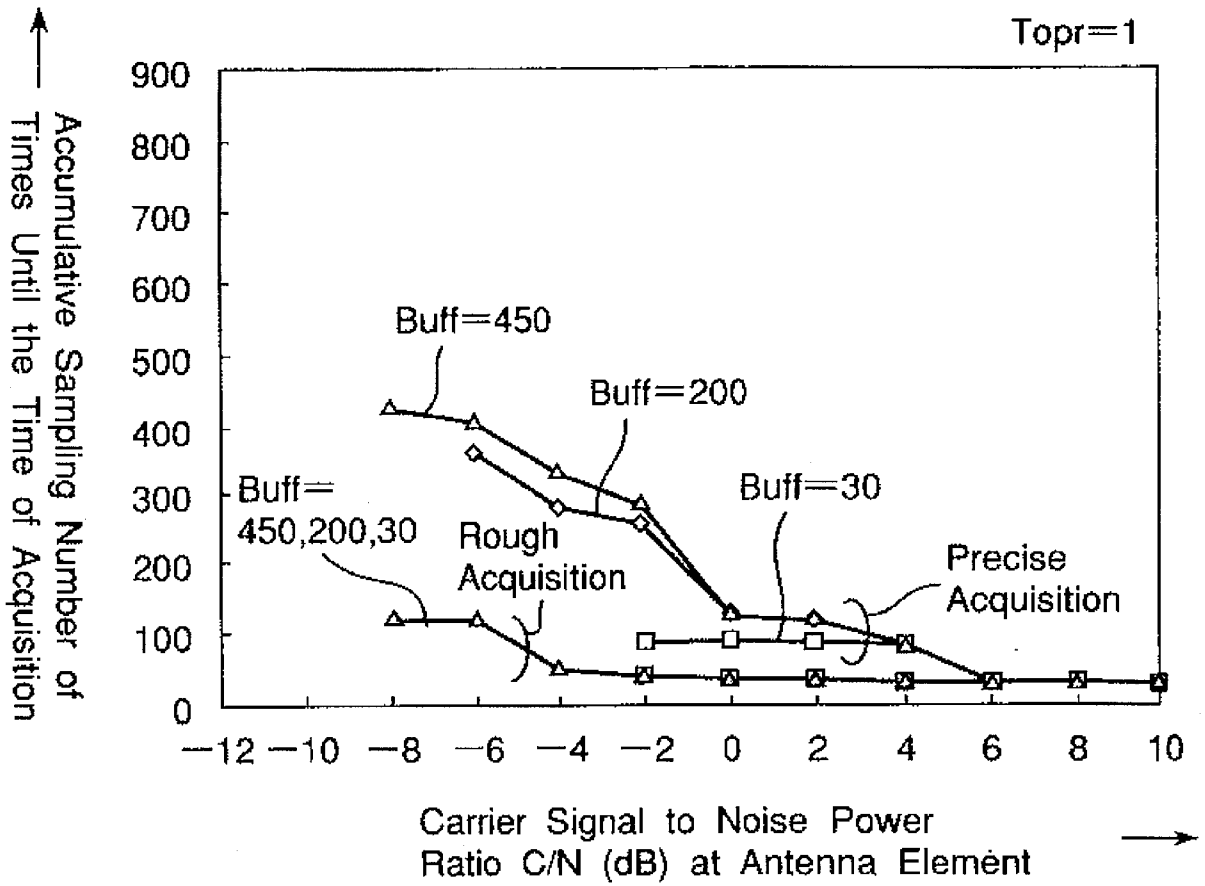
FIG. 11 is a graph showing an accumulative sampling number of times to the time of acquisition relative to a beam acquiring time with respect to a carrier signal power to noise power ratio C/N when a buffer size Buff is used as a parameter in the automatic beam acquiring and tracking apparatus shown in FIG. 1.

FIG. 11 shows tracking characteristics in the times of rough acquisition and precise acquisition of the incoming signal beam with respect to the carrier signal power to noise power ratio C/N when the buffer size Buff is used as a parameter. In the present case, the calculation period Topr is fixed to 1.

As is apparent from FIG. 11, it can be found that the rough acquisition depends scarcely on the carrier signal power to noise power ratio C/N and the buffer size Buff, and is able to constantly obtain a stable acquisition characteristic. On the other hand, in regard to the precise acquisition, the accumulative sampling number of times to the achievement of acquisition increases with promotion of deterioration of the carrier signal power to noise power ratio C/N. That is, a time required for the achievement of acquisition increases resulting in a dull acquisition, and then this means that the precise acquisition depends greatly on the carrier signal power to noise power ratio C/N. In the present case, a faster acquisition can be achieved with a smaller buffer size Buff, however, as described in detail hereinafter, the tracking becomes unstable. Therefore, in selecting the buffer size Buff, there is required a trade-off (consideration for picking up and discarding several conditions that cannot be concurrently satisfied) between acquisition and tracking taking actual communication conditions into account.

Figure 12:
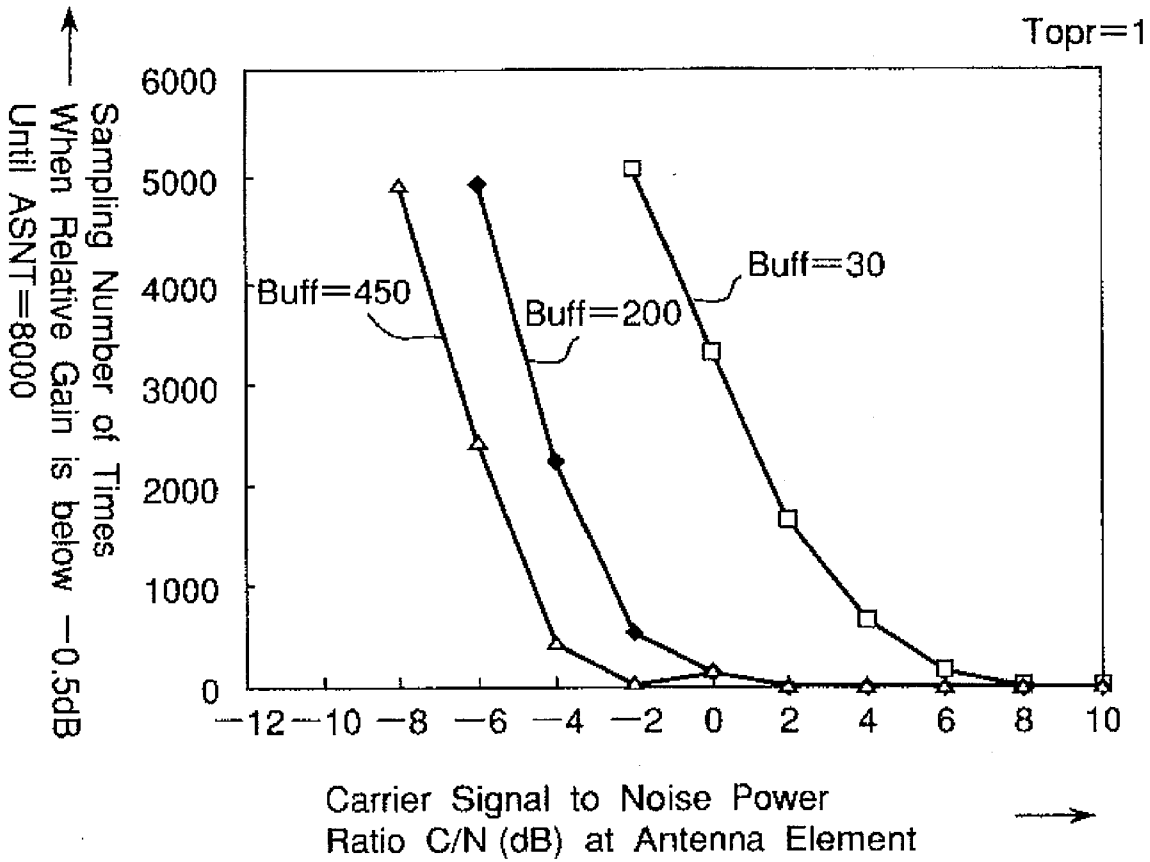
FIG. 12 is a graph showing a tracking characteristic with respect to the carrier signal power to noise power ratio C/N when a buffer size Buff is used as a parameter in the automatic beam acquiring and tracking apparatus shown in FIG. 1.

FIG. 12 shows a tracking characteristic with respect to the carrier signal power to noise power ratio C/N when the buffer size Buff is used as a parameter, where the axis of ordinates represents the sampling number of times that are effective when the relative gain of the array antenna becomes below −0.5 dB until the accumulative sampling number of times becomes 8000, and indicates the frequency of occurrence of a formed main beam deviating from the intended direction. In the present case, the calculation period Topr is fixed to 1.

As is apparent from FIG. 12, it can be found that the stability of tracking at a relatively low carrier signal power to noise power ratio C/N is remarkably improved by increasing the buffer size Buff.

Figure 13:
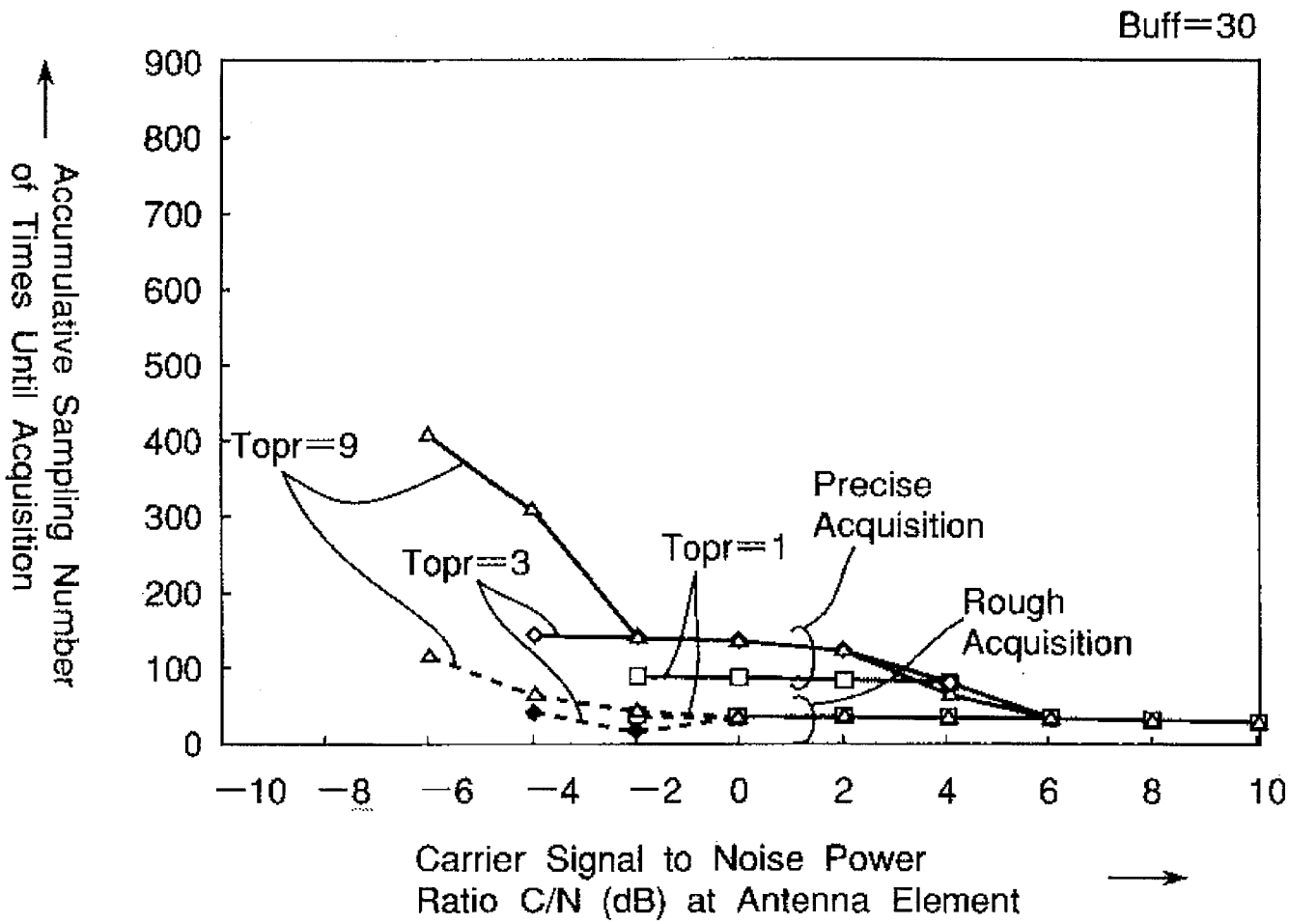
FIG. 13 is a graph showing tracking characteristics in times of precise acquisition and rough acquisition with respect to the carrier signal power to noise power ratio C/N when a calculation period Topr is used as a parameter in the automatic beam acquiring and tracking apparatus shown in FIG. 1.

FIG. 13 shows tracking characteristics in times of precise acquisition and rough acquisition with respect to the carrier wave signal to noise power ratio C/N when the calculation period Topr is used as a parameter. In the present case, the buffer size Buff is fixed to 30.

As is apparent from FIG. 13, the tracking characteristic of the rough acquisition depends scarcely on the calculation period Topr, whereas, in regard to the precise acquisition, it can be found that the smaller the calculation period Topr is, the faster the acquisition is. However, in this case, the tracking becomes unstable as described in detail hereinafter. Therefore, in selecting the calculation period Topr, there is required a trade-off between acquisition and tracking taking actual communication conditions into account.

Figure 14:
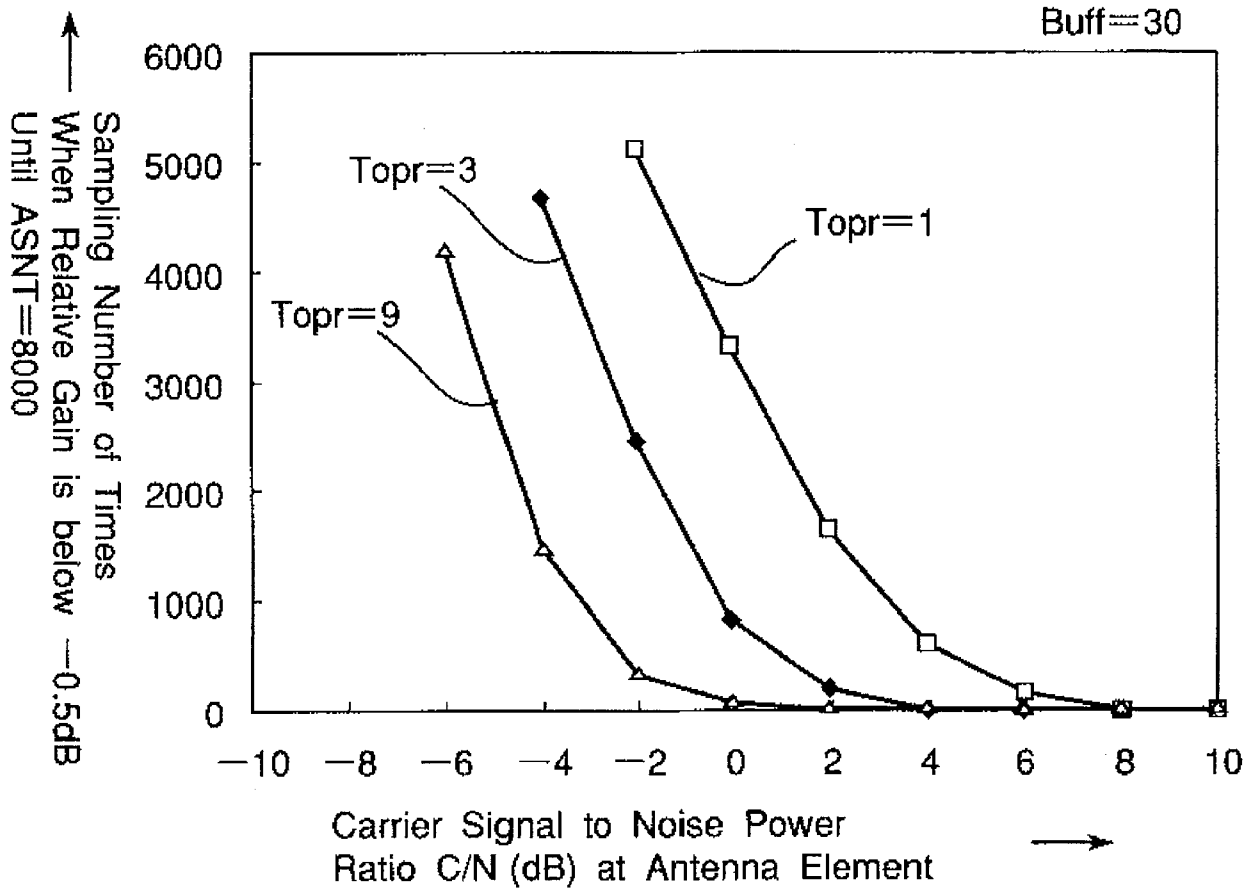
FIG. 14 is a graph showing a tracking characteristic with respect to the carrier signal power to noise power ratio C/N when a calculation period Topr is used as a parameter in the automatic beam acquiring and tracking apparatus shown in FIG. 1.

FIG. 14 shows a tracking characteristic with respect to the carrier signal power to noise power ratio C/N when the calculation period Topr is used as a parameter, where the axis of ordinates represents the sampling number of times that are effective when the relative gain of the array antenna becomes below −0.5 dB until the accumulative sampling number of times becomes 8000, and indicates the frequency of occurrence of a formed main beam deviating from the intended direction. In the present case, the buffer size Buff is fixed to 30.

As is apparent from FIG. 14, it can be found that the stability of tracking at a relatively low carrier signal power to noise power ratio C/N is remarkably improved by increasing the calculation period Topr similarly to the case where the buffer size Buff is increased (See FIG. 12). It is to be noted that, when the calculation period Topr is excessively prolonged, this results in a slow response to the change of the direction of the incoming signal beam, and this leads to an increase of tracking errors.

From the above-mentioned simulation results in connection with the automatic beam acquiring and tracking apparatus of the present preferred embodiment, it can be understood that a more stable tracking characteristic can be obtained by setting both the buffer size Buff and the calculation period Topr to relatively small values so as to increase the speed of acquisition under a radio communication line condition in which the carrier signal power to noise power ratio C/N is relatively high, and setting both the buffer size Buff and the calculation period Topr to relatively great values under a radio communication line condition in which the carrier signal power to noise power ratio C/N is relatively low.

As described above, the automatic beam acquiring and tracking apparatus of the present preferred embodiment produces the following distinctive effects.

(1) An incoming beam is acquired by correcting the phase difference between the received signals received at the antenna elements A1 through AN in a feedforward manner instead of including a feedback loop as in the second prior art. Therefore, the incoming beam of a radio signal comprised of a digital phase modulation wave, an unmodulated wave or the like can be acquired automatically and rapidly even when the carrier signal power to noise power ratio C/N is relatively low, so that a delay time for convergence as in the second prior art can be remarkably reduced while obviating the need of a training signal or a reference signal for executing phase control. Therefore, a simple system construction can be achieved.

(2) The incoming beam is tracked by correcting the phase difference between the received signals received at the antenna elements A1 through AN in a feedforward manner, instead of including a feedback loop as in the second prior art. Therefore, the incoming beam of a radio signal comprised of a digital phase modulation wave, an unmodulated wave or the like can be tracked stably with high accuracy even when the carrier signal power to noise power ratio C/N is relatively low and the direction of the incoming signal beam changes rapidly. Therefore, the present apparatus is almost free of phase slip, influence of external interference due to the surrounding electromagnetic environment, and accumulation of tracking errors as seen in the prior art method.

(3) Spatial information of the array antenna can be effectively utilized by further effecting least square regression correction on the correction phase amount in each antenna element system. Therefore, influence of the reduction of the carrier signal power to noise power ratio C/N per antenna element, which is problematic when there are many antenna elements, can be suppressed.

(4) The above-mentioned acquisition and tracking are all effected on the received signals by, for example, signal processing such as digital signal processing. Therefore, the present apparatus does not require at all any microwave shifter, sensor for the acquisition and tracking, motor for mechanical movement or the like as in the phased array antenna of the first prior art.

A modification example of the first preferred embodiment will be described below based on a case where the regression correction according to the least square method is not effected in the first preferred embodiment. In the present case, instead of obtaining a phase difference between adjacent antenna elements according to the Equation (8), the numerator and the denominator of the Equation (8) are calculated with respect to a predetermined reference antenna element, and the numerator of the Equation (8) is substituted into $\sin\Delta\phi_{ci}$ in the Equation (18), and the denominator of the Equation (8) is similarly substituted into $\cos\Delta\phi_{ci}$ in the Equation (18) for processing. With the above-mentioned operation or calculation, the left hand member of the Equation (18) can be obtained without calculating $\tan^{-1}$ in the Equation (8) on the reception side, so that the amount of calculation can be reduced, and amplitude correction for not only phase correction but also maximum ratio combining can be automatically effected. In the present case, an equation for effecting phase correction of the quadrature baseband signals is expressed by the following Equation (22).

$$\begin{bmatrix} I'i \\ Q'i \end{bmatrix} = \begin{bmatrix} F(I_1 \cdot I_i + Q_1 \cdot Q_i) & F(I_1 \cdot Q_i - I_i \cdot Q_1) \\ -F(I_1 \cdot Q_i - I_i \cdot Q_1) & F(I_1 \cdot I_i + Q_1 \cdot Q_i) \end{bmatrix} \begin{bmatrix} Ii \\ Qi \end{bmatrix}, \quad i = 2, 3, \ldots, N \tag{22}$$

where the left hand member of the Equation (22) is a matrix representing a vector of the received baseband signal of the i-th antenna element obtained through the phase correcting process, the first term of the right hand member thereof is a phase rotation transformation matrix for the phase correction process, i.e., a transformation matrix for putting the signals in phase, and the second term of the right hand member is a matrix representing a vector of the received baseband signal prior to the phase correcting process. It is to be noted that, in the modification example, a calculating operation is not effected between adjacent two antenna elements but effected in a manner as follows. That is, by assuming that an antenna element to be used as a phase reference is, for example, A1, and effecting a calculating operation between a received signal of the antenna element A1 and a received signal of each of the other antenna elements A2 through AN so as to execute processing between the signals. Although the reference antenna element is assumed to be A1 in the present modification example, the present invention is not limited to this, and another antenna element may be used as the reference antenna element.

An advantageous effect in executing the above-mentioned processing operation or calculation is that the calculation of the Equation (22) is capable of performing not only phase transformation but also amplitude transformation so that the maximum ratio combining is executed at the same time. In other words, the Equation (22) can be approximated to the following Equation (23) according to the Equation (5) and the Equation (6) by means of approximation expressions (24).

$$\begin{bmatrix} I'i \\ Q'i \end{bmatrix} = F(a_1) \cdot F(a_i) \begin{bmatrix} F(\cos\delta_{1,i}) & F(\sin\delta_{1,i}) \\ -F(\sin\delta_{1,i}) & F(\cos\delta_{1,i}) \end{bmatrix} \begin{bmatrix} Ii \\ Qi \end{bmatrix}, \quad i = 2, 3, \ldots, N \tag{23}$$

As is apparent from the Equation (23), a product of the third term and the fourth term of the right hand member of Equation (23) is multiplied by a product $F(a_1) \cdot F(a_i)$ of the filtered amplitude coefficients. In the present case, when the amplitude coefficient $a_1$, amplitude coefficient $a_i$ and the cosine value $\cos\delta_{1,i}$ of the phase difference can be assumed in a short term to be mutually independent variables that vary at random in time about a certain average value due to thermal noise, the following Expressions (24) can be obtained.

$$F(a_1a_i\cos\delta_{1,i})\approx F(a_1)\cdot F(a_i)\cdot F(\cos\delta_{1,i})\ F(a_1a_i\sin\delta_{1,i})\approx F(a_1)\cdot F(a_i)\cdot F(\sin\delta_{1,i}) \quad (24)$$

The Expressions (24) hold for a reason as follows. Assuming now that variables u and v are independent variables that vary at random in time and average values of the respective variables are avr(u) and avr(v), the variables can be expressed by the following Equations (25).

$$u=avr(u)+eu$$
$$v=avr(v)+ev \quad (25)$$

where eu and ev are random components each expressing a component that vary at random in time about an average value of 0. When the above-mentioned digital filter is, for example, a predetermined low-pass filter, then F(·) is a transfer function of the low-pass filter, and therefore, the following Expressions (26) can be derived from Equations (25).

$$F(u)\approx avr\ (u)$$
$$F(v)\approx avr\ (v)$$
$$F(eu)\approx 0$$
$$F(ev)\approx 0 \quad (26)$$

When the following Expression (27) holds between the variables u and v, the Expressions (24) can hold.

$$F(u\cdot v)\approx F(u)\cdot F(v) \quad (27)$$

When the Equations (25) are substituted into the left hand member of the Expression (27) and then the Expression (27) is transformed by means of the Expressions (26), the following Expression (28) can be obtained.

$$\begin{aligned} F(u\cdot v) &= F((avr(u)+eu)\cdot(avr(v)+ev)) \quad (28)\\ &= F\,(avr(u)\cdot avr(v)+ev\cdot avr(u)+ eu\cdot avr(v)+eu\cdot ev)\\ &= F(avr(u)\cdot avr(v))+F(ev\cdot avr(u))+ F(eu\cdot avr(v))+F(eu\cdot ev)\\ &= avr(u)\cdot avr(v)+avr(u)\cdot F(ev)+ avr(v)\cdot F(eu)+F(eu\cdot ev)\\ &\approx F(u)\cdot F(v)+F(eu\cdot ev) \end{aligned}$$

In the above-mentioned Expressions, the random components eu and ev can be assumed to be mutually independent and have no correlation and a mutual correlation function R(τ) is always zero. Therefore, by assuming that τ=0, the following Equation (29) holds.

$$R(0)=\lim_{T\to\infty}\frac{1}{2T}\int_{-T}^{T}(eu\cdot ev)dt=0 \quad (29)$$

The Equation (29) means that a time average of (eu·ev) is approximately zero. Therefore, F(eu·ev)≈0, and according to this expression and the Expression (28), there hold Expression (27) and Expressions (24). It is to be noted that Expressions (24) hold with high accuracy in particular in a case of a constant envelope modulation system where the envelope is constant. When the envelope varies depending on information symbols, this results in a deteriorated approximation accuracy.

Otherwise, assuming that the calculating operation of the Equation (22) is effected within the system of the reference antenna element A1 itself, the following Expression (30) holds when the received signal to noise power ratio S/N is sufficiently high.

$$\begin{bmatrix} I_1' \\ Q_1' \end{bmatrix}=\begin{bmatrix} F(I_1^2+Q_1^2) & 0 \\ 0 & F(I_1^2+Q_1^2) \end{bmatrix}\begin{bmatrix} I_1 \\ Q_1 \end{bmatrix}= F(a_1^2)\begin{bmatrix} I_1 \\ Q_1 \end{bmatrix}\approx F^2(a_1)\begin{bmatrix} I_1 \\ Q_1 \end{bmatrix} \quad (30)$$

As is apparent from the Equation (23) and the Expression (30), it can be found that amplitude transformation coefficients of received signals at the antenna elements are directly proportional to filter outputs $F(a_i)$ (i=1, 2, . . . , N) of the amplitudes of the respective received signals. Combining the results of calculating operations of the Equation (22) and the Expression (30) according to the Equations (20) is consequently the same operation as the operation of effecting the maximum ratio combining, and therefore, the received signal to noise power ratio achieved through combining a plurality of received signals can be remarkably improved. In the present case, the calculating operation as expressed by the Equations (19) is unnecessary, so that the phase difference correcting section 44 and the amplitude correcting section 45 shown in FIG. 3 can be integrated with each other. It is to be noted that, when a random component of the amplitude coefficient $a_1$ is assumed to be eal and a calculation of a filter output $F(a_1^2)$ is performed similarly to the Expression (28), the following Equation (31) is obtained.

$$f(a_1^2)=F^2(a_1)+F(ea_1^2) \quad (31)$$

That is, as is apparent from the Equation (31), the second term of the right hand member of the Equation (31) cannot be ignored when the received signal power to noise power ratio S/N is low, and therefore, this causes a problem that the approximation error of the Expression (30) increases. When there is no multi-path and no regression correction when the least square method is effected, the same result is obtained when the Equation (8) and the Equation (18) are used and when the Equation (22) and the Expression (30) are used.

Second preferred embodiment

Figure 15:
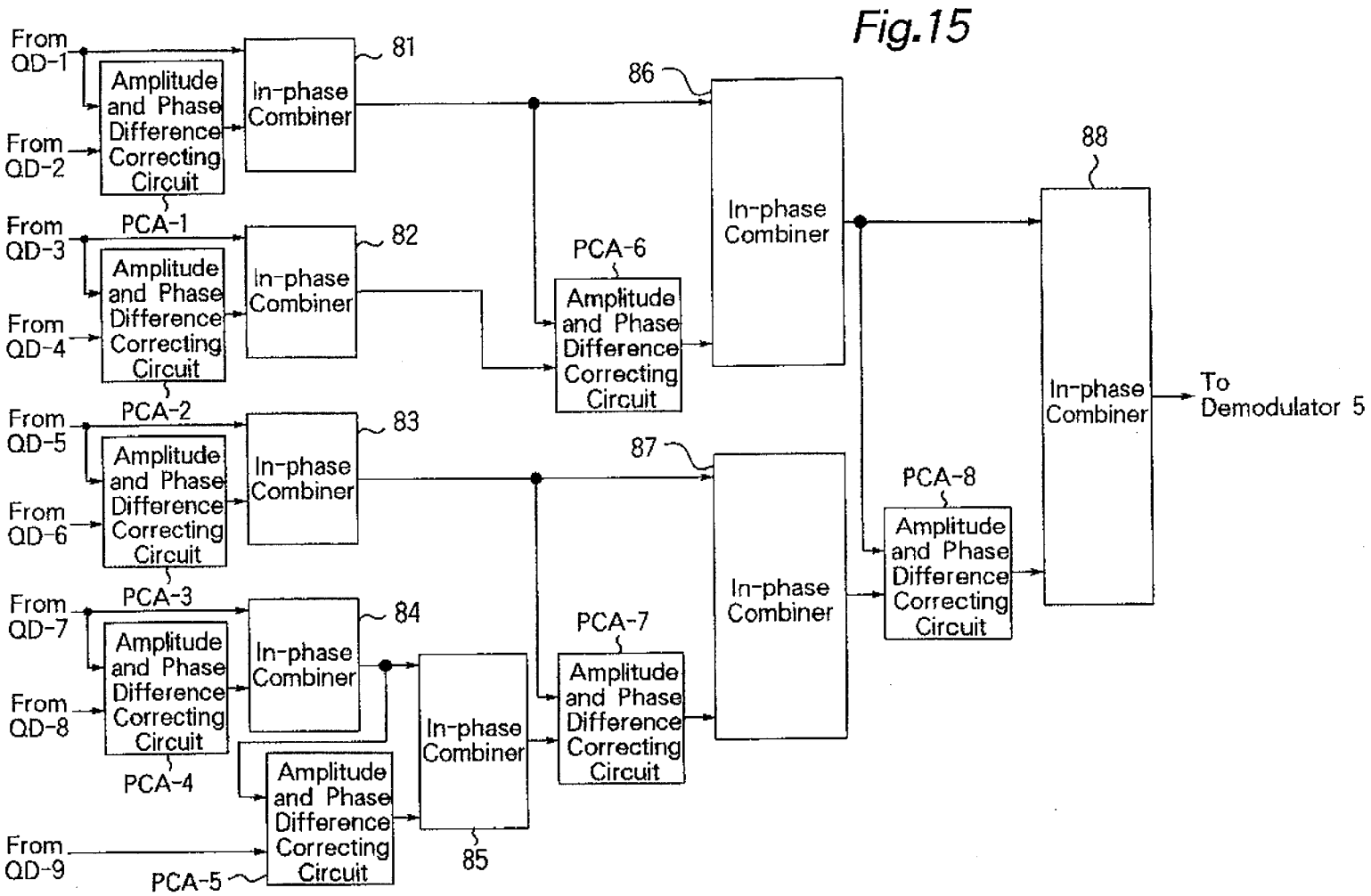
FIG. 15 is a block diagram of a part of the receiver section of an automatic beam acquiring and tracking apparatus of an array antenna for use in communications according to the second preferred embodiment of the present invention.

FIG. 15 is a block diagram of a part of a receiver section of an automatic beam acquiring and tracking apparatus of an array antenna for use in communications according to the second preferred embodiment of the present invention.

In the second preferred embodiment, adjacent two antenna element systems are paired, and an amplitude and phase difference correcting process is effected so that quadrature baseband signals obtained therefrom are put in phase with each other. Thereafter, a process of in-phase combining (i.e., maximum ratio combining) between two antenna element systems of each pair is effected, resulting adjacent outputs are paired, and then, an amplitude and phase difference correcting process and a process of in-phase combining (maximum ratio combining) of the paired outputs are effected again. By repeating the above-mentioned operations, there is eventually obtained only one array antenna output formed by combining in phase at the maximum ratio the signals received by all the antenna elements. Consequently, the array antenna performs acquisition and tracking of an incoming signal beam. An amount of calculation required for the amplitude and phase difference correction process and the in-phase combining process are substantially equal to that of the first preferred embodiment. In the present case, the maximum ratio combining or the maximum ratio in-phase combining is to combine the signals in phase so that the obtained received signal to noise power ratio is maximized.

FIG. 15 shows a construction in a case where the present apparatus has nine quasi-synchronous detector circuits QD-1 through QD-9, including stages that are subsequent to the quasi-synchronous detector circuits QD-1 through QD-9 and prior to the demodulator 5.

Referring to FIG. 15, quadrature baseband signals $I_1$ and $Q_1$ relevant to the antenna element A1 outputted from the quasi-synchronous detector circuit QD-1 are inputted to an in-phase combiner 81 and an amplitude and phase difference correcting circuit PCA-1. Quadrature baseband signals $I_2$ and $Q_2$ relevant to the antenna element A2 outputted from the quasi-synchronous detector circuit QD-2 are inputted to the amplitude and phase difference correcting circuit PCA-1. Similarly, quadrature baseband signals $I_3$ and $Q_3$ relevant to the antenna element A3 outputted from the quasi-synchronous detector circuit QD-3 are inputted to an in-phase combiner 82 and an amplitude and phase difference correcting circuit PCA-2. Quadrature baseband signals $I_4$ and $Q_4$ relevant to the antenna element A4 outputted from the quasi-synchronous detector circuit QD-4 are inputted to the amplitude and phase difference correcting circuit PCA-2. On the other hand, quadrature baseband signals $I_5$ and $Q_5$ relevant to the antenna element A5 outputted from the quasi-synchronous detector circuit QD-5 are inputted to an in-phase combiner 83 and an amplitude and phase difference correcting circuit PCA-3. Quadrature baseband signals $I_6$ and $Q_6$ relevant to the antenna element A6 outputted from the quasi-synchronous detector circuit QD-6 are inputted to the amplitude and phase difference correcting circuit PCA-3. On the other hand, quadrature baseband signals $I_7$ and $Q_7$ relevant to the antenna element A7 outputted from the quasi-synchronous detector circuit QD-7 are inputted to an in-phase combiner 84 and an amplitude and phase difference correcting circuit PCA-4. Quadrature baseband signals $I_8$ and $Q_8$ relevant to the antenna element A8 outputted from the quasi-synchronous detector circuit QD-8 are inputted to the amplitude and phase difference correcting circuit PCA-4. On the other hand, quadrature baseband signals $I_9$ and $Q_9$ relevant to the antenna element A9 outputted from the quasi-synchronous detector circuit QD-9 are inputted to an amplitude and phase difference correcting circuit PCA-5.

The amplitude and phase difference correcting circuit PCA-1 calculates transformation matrix elements (which are transformation matrix elements of the Equation (22)) for putting in phase two received signals of adjacent antenna elements by means of the quadrature baseband signals $I_1$ and $Q_1$ relevant to the antenna element A1 outputted from the quasi-synchronous detector circuit QD-1, the quadrature baseband signals $I_2$ and $Q_2$ relevant to the adjacent antenna element A2 and a specific filter for removing noises. Based on the transformation matrix (See the Equation (22)) including the calculated transformation matrix elements, the detector circuit PCA-1 effects phase difference correction (or phase shift) so that the baseband signals of the antenna elements A1 and A2 are put in phase with each other. Further, by effecting weighting with an amplification gain directly proportional to the calculated received signal intensity similarly to the amplitude correcting section 45 of the first preferred embodiment, the detector circuit PCA-1 executes the amplitude and phase difference correcting process, and then, outputs the baseband signal obtained through the above-mentioned processes to the in-phase combiner 81. The in-phase combiner 81 combines in phase the quadrature baseband signals $I_1$ and $Q_1$ relevant to the antenna element A1 with a quadrature baseband signal outputted from the amplitude and phase difference correcting circuit PCA-1 every channel, and then, outputs the resulting signal to the in-phase combiner 86 and an amplitude and phase difference correcting circuit PCA-6. It is to be noted that the in-phase combiners 81 through 88 each combine in phase two pairs of inputted baseband signals every channel.

The amplitude and phase difference correcting circuit PCA-2 executes an amplitude and phase difference correcting process similarly to the amplitude and phase difference correcting circuit PCA-1 by means of the quadrature baseband signals $I_3$ and $Q_3$ relevant to the antenna element A3 inputted from the quasi-synchronous detector circuit QD-3 and the quadrature baseband signals $I_4$ and $Q_4$ relevant to the adjacent antenna element A4, and then, outputs the baseband signal obtained through the above-mentioned processes to the in-phase combiner 82. The in-phase combiner 82 combines in phase the quadrature baseband signals $I_3$ and $Q_3$ relevant to the antenna element A3 with a quadrature baseband signal outputted from the amplitude and phase difference correcting circuit PCA-2, and then, outputs the resulting signal to the amplitude and phase difference correcting circuit PCA-6.

The amplitude and phase difference correcting circuit PCA-3 executes an amplitude and phase difference correcting process similarly to the amplitude and phase difference correcting circuit PCA-1 by means of the quadrature baseband signals $I_5$ and $Q_5$ relevant to the antenna element A5 inputted from the quasi-synchronous detector circuit QD-5 and the quadrature baseband signals $I_6$ and $Q_6$ relevant to the adjacent antenna element A6, and then, outputs the baseband signal obtained through the above-mentioned processes to the in-phase combiner 83. The in-phase combiner 83 combines in phase the quadrature baseband signals $I_5$ and $Q_5$ relevant to the antenna element A5 with a quadrature baseband signal outputted from the amplitude and phase difference correcting circuit PCA-3, and then, outputs the resulting signal to the in-phase combiner 87 and the amplitude and phase difference correcting circuit PCA-7.

The amplitude and phase difference correcting circuit PCA-4 executes an amplitude and phase difference correcting process similarly to the amplitude and phase difference correcting circuit PCA-1 by means of the quadrature baseband signals $I_7$ and $Q_7$ relevant to the antenna element A7 inputted from the quasi-synchronous detector circuit QD-7 and the quadrature baseband signals $I_8$ and $Q_8$ relevant to the adjacent antenna element A8, and then, outputs the baseband signal obtained through the above-mentioned processes to the in-phase combiner 84. The in-phase combiner 84 combines in phase the quadrature baseband signals $I_7$ and $Q_7$ relevant to the antenna element A7 with a quadrature baseband signal outputted from the amplitude and phase difference correcting circuit PCA-4, and then, outputs the resulting signal to the in-phase combiner 85 and the amplitude and phase-difference correcting circuit PCA-5.

The amplitude and phase difference correcting circuit PCA-5 executes an amplitude and phase difference correcting process similarly to the amplitude and phase difference correcting circuit PCA-1 by means of a quadrature baseband signal outputted from the in-phase combiner 84 and the quadrature baseband signals $I_9$ and $Q_9$ relevant to the antenna element A9 inputted from the quasi-synchronous detector circuit QD-9, and then, outputs the baseband signal obtained through the above-mentioned processes to the in-phase combiner 85. The in-phase combiner 85 combines in phase the quadrature baseband signal outputted from the in-phase combiner 84 with the quadrature baseband signal outputted from the amplitude and phase difference correcting circuit PCA-5, and then, outputs the resulting signal to the amplitude and phase difference correcting circuit PCA-7.

The amplitude and phase difference correcting circuit PCA-6 executes an amplitude and phase difference correcting process similarly to the amplitude and phase difference correcting circuit PCA-1 by means of the quadrature baseband signal outputted from the in-phase combiner 81 and the quadrature baseband signal outputted from the in-phase combiner 82, and then, outputs the baseband signal obtained through the above-mentioned processes to the in-phase combiner 86. The in-phase combiner 86 combines in phase the quadrature baseband signal outputted from the in-phase combiner 81 with a quadrature baseband signal outputted from the amplitude and phase difference correcting circuit PCA-6, and then, outputs the resulting signal to the in-phase combiner 88 and the amplitude and phase difference correcting circuit PCA-8.

The amplitude and phase difference correcting circuit PCA-7 executes an amplitude and phase difference correcting process similarly to the amplitude and phase difference correcting circuit PCA-1 by means of the quadrature baseband signal outputted from the in-phase combiner 83 and a quadrature baseband signal outputted from the in-phase combiner 85, and then, outputs the baseband signal obtained through the above-mentioned processes to the in-phase combiner 87. The in-phase combiner 87 combines in phase the quadrature baseband signal outputted from the in-phase combiner 83 with a quadrature baseband signal outputted from the amplitude and phase difference correcting circuit PCA-7, and then, outputs the resulting signal to the amplitude and phase difference correcting circuit PCA-8.

The amplitude and phase difference correcting circuit PCA-8 executes an amplitude and phase difference correcting process similarly to the amplitude and phase difference correcting circuit PCA-1 by means of a quadrature baseband signal outputted from the in-phase combiner 86 and a quadrature baseband signal outputted from the in-phase combiner 87, and then, outputs the baseband signal obtained through the above-mentioned processes to the in-phase combiner 88. The in-phase combiner 88 combines in phase the quadrature baseband signal outputted from the in-phase combiner 86 with a quadrature baseband signal outputted from the amplitude and phase difference correcting circuit PCA-8, and then, outputs the resulting signal to the demodulator 5. In the present case, the quadrature baseband signal outputted from the in-phase combiner 88 is a quadrature baseband signal that corresponds to the quadrature baseband signal outputted from the in-phase combiner 4 of the first preferred embodiment shown in FIG. 1, and is obtained by executing the amplitude and phase difference correcting process based on all the quadrature baseband signals relevant to all the antenna elements.

Figure 16:
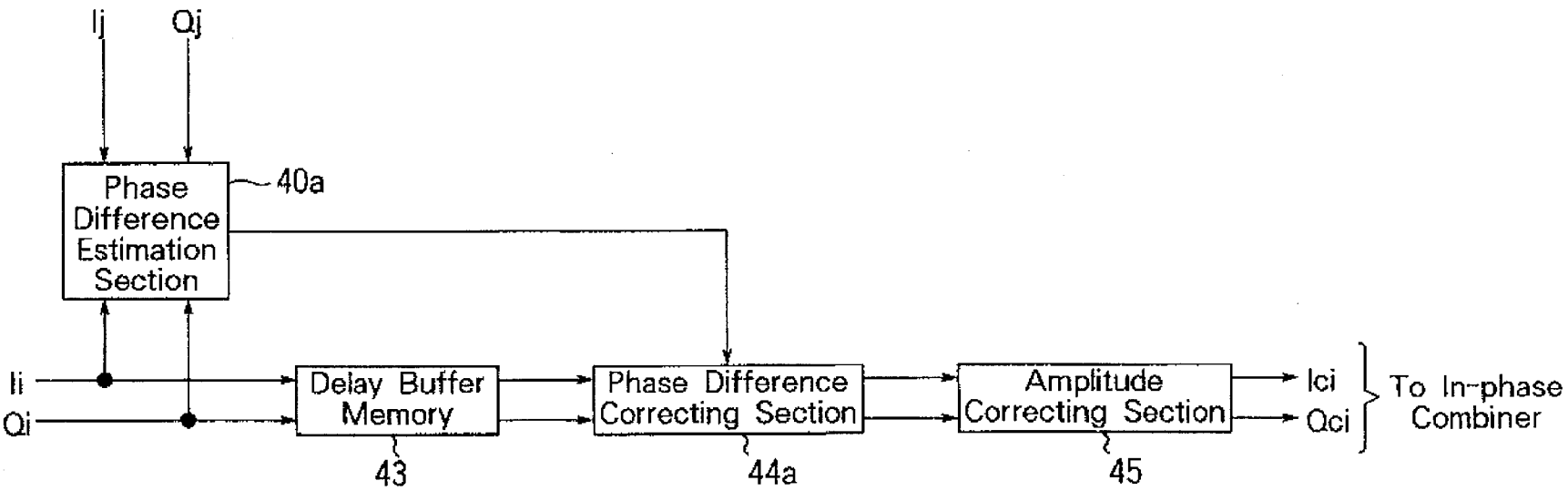
FIG. 16 is a block diagram of an amplitude and phase difference correcting circuit shown in FIG. 15.

FIG. 16 is a block diagram of the amplitude and phase difference correcting circuit PCA-s (s=1, 2, . . . , 8) shown in FIG. 15. The amplitude and phase difference correcting circuit PCA-s of the second preferred embodiment shown in FIG. 16 differs from the amplitude and phase difference correcting circuit PCA-i of the first preferred embodiment shown in FIG. 3 in the following points.

(1) A phase difference estimation section 40*a* calculates transformation matrix elements (which are the transformation matrix elements of the Equation (22)) from which noises are removed for putting in phase received signals of two antenna elements i and j based on the quadrature baseband signals $I_i$ and $Q_i$ and $I_j$ and $Q_j$ relevant to the two antenna elements i and j, and then outputs the transformation matrix including the calculated transformation matrix elements to a phase difference correcting section 44*a*.

(2) The phase difference correcting section 44*a* corrects the phase difference by shifting the phase of the quadrature baseband signal inputted from a delay buffer memory 43 based on the transformation matrix inputted from the phase difference estimation section 40*a*, and then outputs the resulting signals to an amplitude correcting section 45.

(3) Neither adder 41 nor the least square regression correcting section 42 is provided.

It is to be noted that the delay buffer memory 43 and the amplitude correcting section 45 operate similarly to those of the first preferred embodiment.

Therefore, the amplitude and phase difference correcting circuit PCA-s shown in FIG. 15 calculates transformation matrix elements (which are the transformation matrix elements of the Equation (22)) for putting in phase two received signals of adjacent antenna elements by means of the quadrature baseband signals $I_i$ and $Q_i$ relevant to the antenna element Ai inputted from the quasi-synchronous detector circuit QD-i, the quadrature baseband signals $I_j$ and $Q_j$ relevant to the adjacent antenna element Aj and a specific filter for removing noises. Thereafter, based on the transformation matrix including the calculated transformation matrix elements, the circuit PCA-s effects phase difference correction, or phase shift so that the two baseband signals of the antenna elements Ai and Aj are put in phase with each other. Further, by effecting weighting with an amplification gain directly proportional to the calculated received signal intensity similarly to the amplitude correcting section 45 of the first preferred embodiment, the circuit PCA-s executes the amplitude and phase difference correcting process, and then, outputs baseband signals $Ic_i$ and $Qc_i$ obtained through the above-mentioned processes to an in-phase combiner (one of the in-phase combiners 81 through 88).

In the above-mentioned amplitude and phase difference correcting circuit PCA-s of the second preferred embodiment, when a transformation operation using the transformation matrix for putting the signals in phase is performed according to the Equation (22) and the Expression (30) in the amplitude and phase difference correcting circuits PCA-1 through PCA-8 shown in FIG. 15, the phase difference correcting section 44*a* and the amplitude correcting section 45 shown in FIG. 16 can be integrated with each other. According to the integrated arrangement, a phase difference correcting process for putting the signals in phase and an amplitude correcting process can be simultaneously achieved, with which a plurality of received signals received by the array antenna 1 can be combined at the maximum ratio and corrected in amplitude, so that one combined received signal can be outputted.

As a modification example of the second preferred embodiment, there may be a construction as follows similarly to the processing in the first preferred embodiment. The phase difference estimation section 40*a* estimates an instantaneous phase difference $\delta_{i,j}$ of the received signal received by the two antenna elements i and j based on the quadrature baseband signals $I_i$ and $Q_i$ and $I_j$ and $Q_j$ relevant to the two antenna elements i and j according to the Equation (7), removes noises, and then, outputs an estimated phase difference $\delta_{ci,j}$ obtained through the removal of noises (See the Equation (8)) to the phase difference correcting section 44*a*. Then, the phase difference correcting section 44*a* corrects the phase difference by shifting the quadrature baseband signals inputted from the delay buffer memory 43 by the estimated phase difference $\delta_{ci,j}$ based on the estimated phase difference $\delta_{ci,j}$ inputted from the phase difference estimation section 40*a*, and then, outputs the resulting signals to the amplitude correcting section 45.

The second preferred embodiment has advantageous effects as follows in comparison with the first preferred embodiment. In the first preferred embodiment, the phase at each antenna element system relative to the reference antenna is calculated by summing up the phase differences between adjacent antenna element systems of all the combinations, and maximum ratio in-phase combining is finally effected collectively. Therefore, if there is an antenna element having a low reception level or a defective antenna element, there are not only the possibility that the estimation of phase relevant to the antenna element cannot be effected but also the possibility that it affects the estimation of phase of the other antenna element systems. In contrast to the above, in the second preferred embodiment, instead of summing up the phase differences between adjacent antenna elements of all the combinations, the signals are combined in phase at the maximum ratio between the two element systems in advance. Therefore, if there is an antenna element having a low reception level or a defective antenna element, the above-mentioned defect can be prevented from affecting the in-phase combining in the other antenna element systems. Therefore, it can be found that the second preferred embodiment has a greater tolerance to failures or the like of the antenna elements and the circuit devices connected thereto than the first preferred embodiment. It is to be noted that the phase difference correction can be effected in a parallel processing manner in all the antenna element systems in the first preferred embodiment, whereas the second preferred embodiment requires a serial processing to be effected by a number of times corresponding to approximately $\log_2$ (the number of antenna elements), resulting in a long calculating operation time.

Third preferred embodiment

Figure 17:
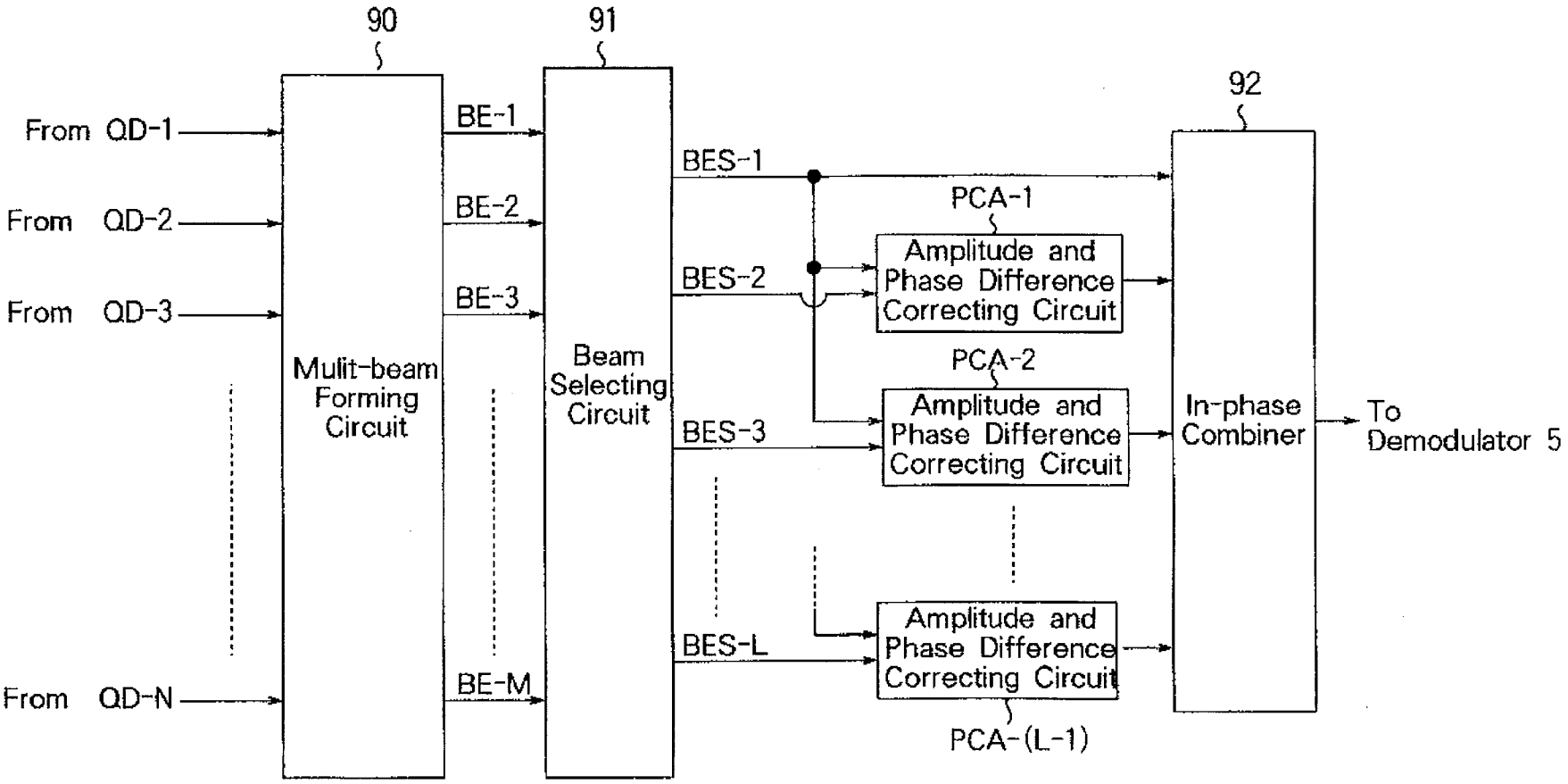
FIG. 17 is a block diagram of a part of the receiver section of an automatic beam acquiring and tracking apparatus of an array antenna for use in communications according to the third preferred embodiment of the present invention.

FIG. 17 is a block diagram of a part of a receiver section of an automatic beam acquiring and tracking apparatus according to the third preferred embodiment of the present invention.

In the third preferred embodiment, received signals of antenna elements are inputted to a multi-beam forming circuit 90 which operates based on two-dimensional fast Fourier transform (FFT) or discrete Fourier transform (DFT). Among a plurality of obtained M beam signals BE-1 through BE-M, a predetermined plural number of L beam signals BES-1 through BES-L are selected by a beam selecting circuit 91 in order of magnitude of signal intensity from a beam signal having the greatest signal intensity, i.e., the greatest sum of squares of beam electric field values. Thereafter, an amplitude and phase difference correcting process is effected between the beam signals BES-1 through BES-L in amplitude and phase difference correcting circuits PCA-1 through PCA-(L−1) and then the resulting signals are subjected to an in-phase combining (maximum ratio combining) process in an in-phase combiner 92. As a result, the array antenna performs acquisition and tracking of an incoming beam.

Referring to FIG. 17, the multi-beam forming circuit 90 calculates beam electric field values $EI_m$ and $EQ_m$ (m=1, 2, . . . , M) comprised of a plurality of M beams based on received quadrature baseband signals $I_i$ and $Q_i$ (i=1, 2, . . . , N) based on the quasi-synchronous detector circuits QD-1 through QD-N, a direction vector $d_m$ representing the direction of each main beam of a predetermined plural number of M beam signals to be formed predetermined so that a desired wave can be received within a range of radiation angle, and a reception frequency fr of the received signal, and then outputs beam signals having the beam electric field values $EI_m$ and $EQ_m$ to the beam selecting circuit 91. That is, the plurality of M directions of beams of a multi-beam to be formed are predetermined in correspondence with the incoming direction of the desired wave, and the directions are expressed by direction vectors $d_1, d_2, \ldots, d_M$ (represented by reference character $d_m$ hereinafter) viewed from a predetermined origin. In the present case, M represents the number of the direction vectors $d_m$ which is set so that the desired wave can be received by means of the array antenna 1, the number being preferably not smaller than four and not greater than the number of the antenna elements A1 through AN. Further, position vectors $r_1, r_2, \ldots, r_N$ (represented by reference character $r_n$ hereinafter) of the antenna elements A1 through AN of the array antenna 1 are predetermined as the direction vectors viewed from the predetermined origin. Then, according to the following Equation (32) and Equation (33), the multi-beam forming circuit 90 calculates a plurality of 2N beam electric field values $EI_n$ and $EQ_n$ corresponding to the direction vectors $d_n$ expressed by respective combinatorial electric fields, and then, outputs beam signals having the beam electric field values $EI_n$ and $EQ_n$ to the beam selecting circuit 91.

$$EI_m = \sum_{n=1}^{N} \exp[j(a_{mn})] \cdot I_n, \qquad m = 1, 2, \ldots, M \tag{32}$$

$$EQ_m = \sum_{n=1}^{N} \exp[j(a_{mn})] \cdot Q_n, \qquad m = 1, 2, \ldots, M \tag{33}$$

where $$a_{mn} = -(2\pi \cdot fr/c) \cdot (d_m \cdot r_n), \tag{34}$$

where c is the velocity of light, $(d_m \cdot r_n)$ is the inner product of the direction vector $d_m$ and the position vector $r_n$. Therefore, the phase $a_{mn}$ is a scalar quantity.

Then, the beam selecting circuit 91 calculates a sum of squares $EI_m^2+EQ_m^2$ (m=1, 2, . . . , M) of the plurality of M beam electric field values $EI_m$ and $EQ_m$ of the beam signals BE-1 through BE-M outputted from the multi-beam forming circuit 90, selects a predetermined plural number of L beam signals BES-1 through BES-L having greater sums of squares of beam electric field values in the order of magnitude from the beam signal having the greatest sum of squares of beam electric field values, and thereafter, outputs the plurality of beam signals BES-1 through BES-L to the in-phase combiner 92 and (L−1) amplitude and phase difference correcting circuits PCA-1 through PCA-(L−1). In the present case, L is a natural number not greater than the plural number of M and is predetermined. It is to be noted that the beam selecting circuit 91 is provided for the purpose of removing a received signal having an extremely low level and a deteriorated S/N. The sum of squares of the beam electric field values is calculated in the above-mentioned calculating operation, however, the present invention is not limited to this. It is acceptable to calculate a square root of the sum of squares of the beam electric field values corresponding to the absolute values of the beam electric field values.

A quadrature baseband signal of the beam signal BES-1 which has the sum of squares of the greatest beam electric field values and serves as a reference beam signal is inputted to the in-phase combiner 92 and the amplitude and phase difference correcting circuit PCA-1. A quadrature baseband signal of the beam signal BES-2 which has the sum of squares of the second greatest beam electric field values is inputted to the amplitude and phase difference correcting circuit PCA-1. A quadrature baseband signal of the beam signal BES-3 which has the sum of squares of the third greatest beam electric field values is inputted to the amplitude and phase difference correcting circuit PCA-2. Likewise, a quadrature baseband signal of the beam signal BES-L which has the sum of squares of the L-th greatest beam electric field values is inputted to the amplitude and phase difference correcting circuit PCA-(L–1). In the present case, the amplitude and phase difference correcting circuit PCA-s (s=1, 2, . . . , L–1) is constructed in a manner similar to that of the amplitude and phase difference correcting circuits PCA-s of the second preferred embodiment shown in FIG. 16.

In the third preferred embodiment, the amplitude and phase difference correcting circuit PCA-1 uses the quadrature baseband signal of the reference greatest beam signal BES-1 and a specific filter for removing noises to calculate transformation matrix elements for putting the two beam signals in phase with each other, and effects phase difference correction so that the baseband signals of the two beam signals are put in phase with each other based on a transformation matrix including the calculated transformation matrix elements, i.e., effects phase shift. The circuit PCA-1 further executes an amplitude and phase difference correcting process by effecting weighting with an amplitude gain directly proportional to the calculated received signal intensity similarly to the amplitude correcting section 45 of the first preferred embodiment, and then, outputs the processed baseband signal to the in-phase combiner 92. The amplitude and phase difference correcting circuit PCA-2 uses the quadrature baseband signal of the reference greatest beam signal BES-1 and the quadrature baseband signal of the beam signal BES-3 to execute an amplitude and phase difference correcting process similarly to the amplitude and phase difference correcting circuit PCA-1, and then, outputs the processed baseband signal to the in-phase combiner 92. Likewise, the amplitude and phase difference correcting circuit PCA-(L–1) uses the quadrature baseband signal of the reference greatest beam signal BES-1 and the quadrature baseband signal of the beam signal BES-L to execute an amplitude and phase difference correcting process similarly to the amplitude and phase difference correcting circuit PCA-1, and then, outputs the processed baseband signal to the in-phase combiner 92. The in-phase combiner 92 combines in phase the inputted plurality of L baseband signals every channel, and then, outputs the resulting signal to the demodulator 5.

In the third preferred embodiment, all the selected beam signals are put in phase with the beam signal having the greatest signal intensity. In other words, the beam signal having the greatest signal intensity is used as a reference received signal, and the phases of the other selected beam signals are corrected with respect to the reference signal. In the present third preferred embodiment, the amplitude and phase difference correcting process and the in-phase combining process are each permitted to be effected "(the number L of the selected beams) –1" times. However, it is required to incorporate the multi-beam forming circuit 90 and the beam selecting circuit 91.

In the amplitude and phase difference correcting circuits PCA-s of the third preferred embodiment, when a transforming calculation using a transformation matrix for the in-phase combining process is executed according to the Equation (22) and Expression (30) in the amplitude and phase difference correcting circuits PCA-1 through PCA-(L–1) shown in FIG. 7, the phase difference correcting section 44*a* and the amplitude correcting section 45 shown in FIG. 16 can be integrated with each other. According to the integrated construction, the phase difference correction for the in-phase combining process and the amplitude correction can be effected simultaneously, by which the plurality of received signals received by the array antenna 1 can be combined at the maximum ratio and the combined one received signal can be outputted.

Further, as a modification example of the third preferred embodiment, there may be a construction as follows similarly to the processing operations of the first preferred embodiment. The phase difference estimation section 40*a* estimates an instantaneous phase difference $\delta_{i,j}$ of the received signals received by two antenna elements i and j based on the quadrature baseband signals $I_i$ and $Q_i$ and $I_j$ and $Q_j$ relevant to the two antenna elements i and j according to the Equation (7), removes noises, and then outputs an estimated phase difference $\delta_{ci,j}$ (See FIG. 8) from which the noises are removed to the phase difference correcting section 44*a*. Then, the phase difference correcting section 44*a* corrects the phase difference by shifting the quadrature baseband signals inputted from the delay buffer memory 43 by the estimated phase difference $\delta_{ci,j}$ based on the estimated phase difference $\delta_{ci,j}$ inputted from the phase difference estimation section 40*a*, and then, outputs the resultant to the amplitude correcting section 45.

The third preferred embodiment has advantageous effects as follows in comparison with the first and second preferred embodiments. In the first and second preferred embodiments, the received signal to noise power ratio per antenna element is reduced accordingly as the number of the antenna elements constituting the array antenna increases resulting in a deteriorated accuracy in the phase difference correcting process, and then there is a limitation in the number of antenna elements. In contrast to the above, according to the third preferred embodiment, the amplitude and phase difference correcting process is effected after a beam having a high received signal to noise power ratio is formed by the multi-beam forming circuit 90 and the beam selecting circuit 91. Therefore, no influence is exerted on the phase difference correction accuracy even if the received signal to noise power ratio of each antenna element is relatively low, this means that there is theoretically no limitation on the number of antenna elements. Furthermore, when an intense interference wave or the like comes in another direction, the first and second preferred embodiments try to combine all the signals including the interference wave, and therefore, the combined received signal is sometimes distorted or disturbed in regard to its directivity. However, in the third preferred embodiment, such waves are spatially separated to a certain extent through beam selection, and therefore, the apparatus is less susceptible to the interference waves. However, in the first and second preferred embodiments, the beam formation is effected by making effective use of the received signals inputted from all the antenna elements so that the maximum gain can be achieved in the direction of the incoming beam in the first and second preferred embodiments, and therefore, the tracking operation is effected with the maximum gain maintained even when the direction of the incoming beam changes. In contrast to the above, there is a power loss in the time of beam selection when there is a reduced number of beams in the third preferred embodiment, and this causes a problem that a fluctuation is generated in the gain when the direction of the incoming beam changes.

Fourth preferred embodiment

Figure 18:
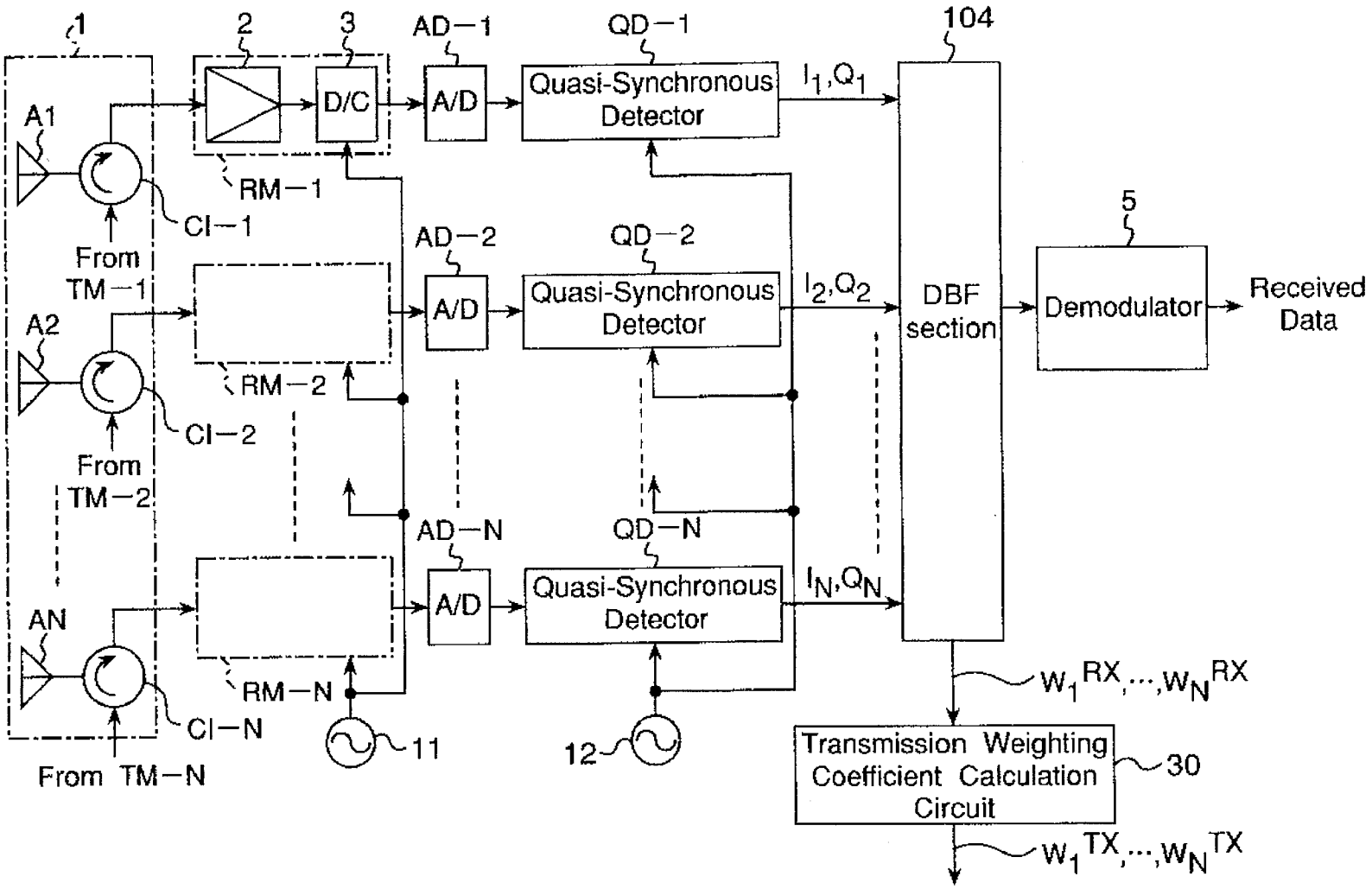
FIG. 18 is a block diagram of a receiver section of an automatic beam acquiring and tracking apparatus of an array antenna for use in communications according to the fourth preferred embodiment of the present invention.

FIG. 18 is a block diagram of a receiver section of an automatic beam acquiring and tracking apparatus of an array antenna for use in communications according to the fourth preferred embodiment of the present invention.

Referring to FIG. 18, in the automatic beam acquiring and tracking apparatus of the array antenna for use in communications of the present preferred embodiment, a directivity of an array antenna 1 comprised of a plurality of N antenna elements A1, A2, . . . , Ai, . . . , AN arranged adjacently at predetermined intervals of, for example, either one half of the wavelength of a reception frequency, one half of the wavelength of a transmission frequency or one half of an average value of the wavelength of a reception frequency and the wavelength of a transmission frequency in an arbitrary flat plane or a curved plane is rapidly directed to a direction in which a radio signal wave such as a digital phase modulation wave or an unmodulated wave comes so as to perform tracking. In this arrangement, in particular, the acquiring and tracking apparatus of the present preferred embodiment is characterized in comprising a digital beam forming section (referred to as a DBF section hereinafter) 104 and a transmission weighting coefficient calculation circuit 30. Even when the azimuth of the remote station of the other party serving as a signal source has been unknown, a transmitting beam is formed in a direction of the incoming wave based on a baseband signal of each antenna element obtained from the incoming wave transmitted from the signal source. Further, in an environment or state in which a plurality of multi-path waves come, or in a case where a phase uncertainty takes place in a reception phase difference, influence of the multi-path waves and the phase uncertainty are removed, and a single transmitting main beam is formed only in the direction of a greatest received wave.

As shown in FIG. 18, the array antenna 1 comprises a plurality of N antenna elements A1 through AN and circulators CI-1 through CI-N which serve as transmission and reception separators. Each of receiver modules RM-1 through RM-N comprises a low-noise amplifier 2 and a down converter (D/C) 3 which frequency-converts a radio signal having a received radio frequency into an intermediate frequency signal having a predetermined intermediate frequency by means of a common first local oscillation signal outputted from a first local oscillator 11.

The receiver section of the present beam acquiring and tracking apparatus further comprises:

(a) N A/D converters AD-1 through AD-N;

(b) N quasi-synchronous detector circuits QD-1 through QD-N which subject the intermediate frequency signal obtained through an A/D conversion process to a quasi-synchronous detection process by means of a common second local oscillation signal outputted from a second local oscillator 12 so as to convert the resulting signal into a pair of baseband signals orthogonal to each other, wherein a pair of baseband signals is referred to as quadrature baseband signals hereinafter;

(c) the DBF section 104 which calculates reception weights $W_1^{RX}$, $W_2^{RX}$, . . . , $W_N^{RX}$ for the quadrature baseband signals such that the maximum ratio combining is achieved based on the transformed quadrature baseband signals, multiplies the quadrature baseband signals by the calculated reception weights $W_1^{RX}$, $W_2^{RX}$, . . . , $W_N^{RX}$, and thereafter, combines in phase the resulting signals to output the resulting signal to a demodulator 5;

(d) a transmission weighting coefficient calculation circuit 30 which calculates transmission weights $W_1^{TX}$, $W_2^{TX}$, . . . , $W_N^{TX}$ according to a method of the present invention based on the reception weights $W_1^{RX}$, $W_2^{RX}$, . . . , $W_N^{RX}$ calculated by the DBF section 104, and then, outputs the resulting signals to a transmission local oscillator 10; and (e) a demodulator 5 which effects synchronous detection or delayed detection in a predetermined baseband demodulation process from the baseband signal outputted from the DBF section 104, extracts desired digital data, and then, outputs the digital data as received data.

In the above-mentioned receiver section, lines extending from the antenna elements A1 through AN in the array antenna 1 to the DBF section 104 are connected in series in each antenna element system. The signal processing operation for each antenna element system in the present receiver section is executed in a similar manner, and therefore, the processing operation of the radio signal wave received by an antenna element Ai (one of the antenna elements A1 through AN is represented by Ai) will be described.

A radio signal wave received by the antenna element Ai is inputted via the circulator CI-i and the low-noise amplifier 2 of the receiver module RM-i to the down converter 3. The down converter 3 of the receiver module RM-i frequency-converts the inputted radio signal into an intermediate frequency signal having a predetermined intermediate frequency using the common first local oscillation signal outputted from the first local oscillator 11, and then, outputs the resulting signal to the quasi-synchronous detector circuit QD-i via the A/D converter AD-i. The quasi-synchronous detector circuit QD-i subjects the inputted intermediate frequency signal obtained through the A/D conversion process to a quasi-synchronous detection process using the common second local oscillation signal outputted from the second local oscillator 12 so as to convert the resulting signal into each pair of quadrature baseband signals $I_i$ and $Q_i$ orthogonal to each other, and then, outputs the signals to the DBF section 104.

The DBF section 104 calculates reception weights $W_1^{RX}$, $W_2^{RX}$, . . . , $W_N^{RX}$ for the quadrature baseband signals such that the maximum ratio combining is achieved based on the transformed quadrature baseband signals, multiplies the quadrature baseband signals by the calculated reception weights $W_1^{RX}$, $W_2^{RX}$, . . . , $W_N^{RX}$, and thereafter, combines in phase the resulting signals to output the same to the demodulator 5. Further, the transmission weighting coefficient calculation circuit 30 forms a transmitting beam in the direction of the direct wave according to a method of the present invention based on the reception weights $W_1^{RX}$, $W_2^{RX}$. . . , $W_N^{RX}$ calculated by the DBF section 104. Further, in an environment in which a plurality of multi-path waves come, or in a case where a phase uncertainty takes place in a reception phase difference, the circuit 30 calculates transmission weights $W_1^{TX}$, $W_2^{TX}$, . . . , $W_N^{TX}$ so that the influence of the multi-path waves and the phase uncertainty are removed and a single transmitting main beam is formed only in the direction of the greatest received wave, and then, outputs the resulting signals to the transmission local oscillator 10. The demodulator 5 effects synchronous detection or delayed detection in a predetermined baseband demodulation process from a baseband signal outputted from the DBF section 104, extracts the desired digital data, and then, outputs the digital data as the received data. The DBF section 104 and the transmission weighting coefficient calculation circuit 30 will be described in detail hereinafter.

Figure 19:
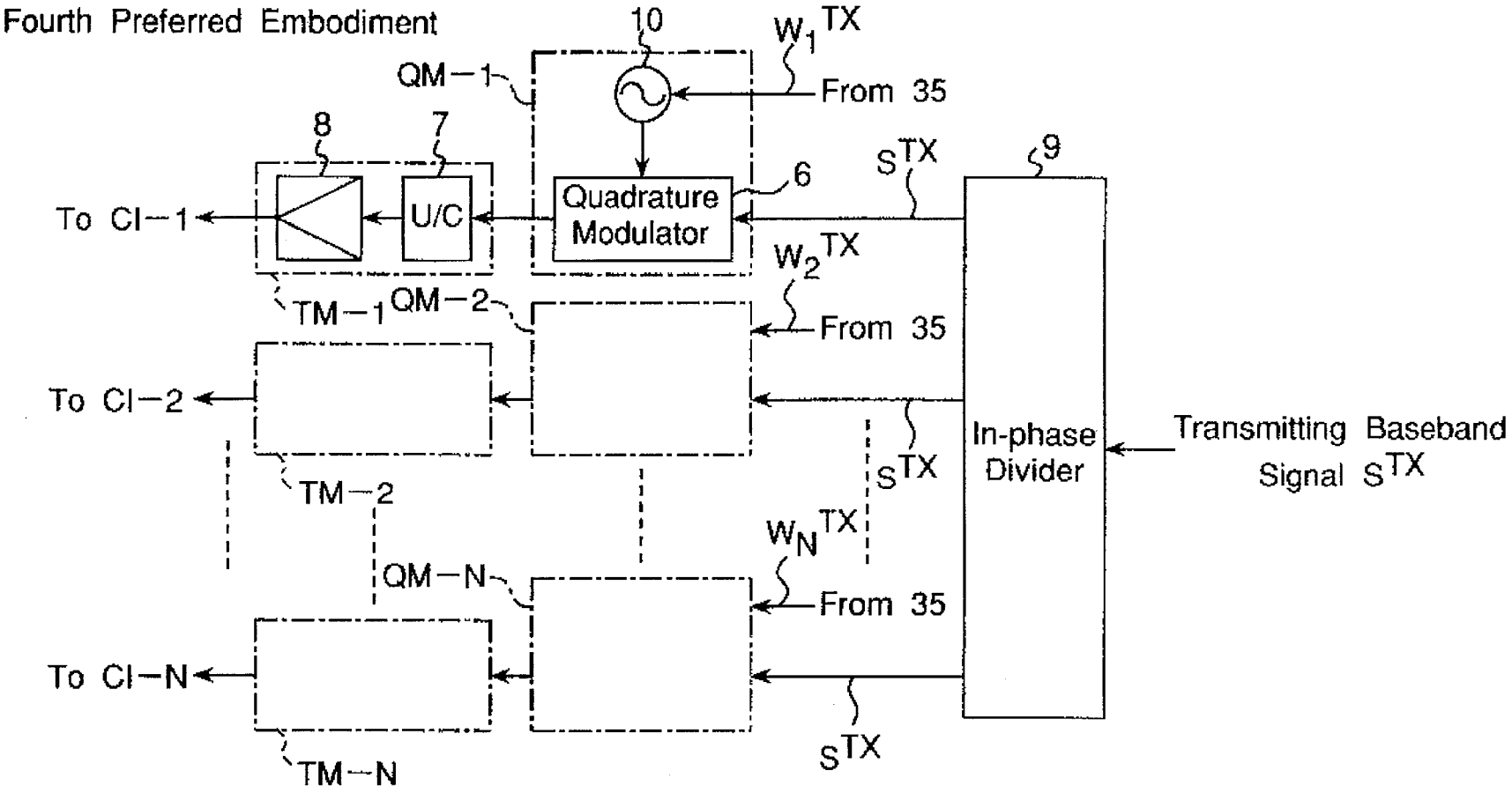
FIG. 19 is a block diagram of a transmitter section of the automatic beam acquiring and tracking apparatus of the array antenna for use in communications of the fourth preferred embodiment.

FIG. 19 is a block diagram of a transmitter section of the present beam acquiring and tracking apparatus.

Referring to FIG. 19, the transmitter section includes N transmitter modules TM-1 through TM-N, N quadrature modulator circuits QM-1 through QM-N, and an in-phase divider 9. In the present case, each of the quadrature modulator circuits QM-1 through QM-N comprises a quadrature modulator 6 and the transmitting local oscillator 10, while each of the transmitter modules TM-1 through TM-N comprises an up-converter (U/C) 7 for frequency-converting the inputted intermediate frequency signal into a transmitting signal having a predetermined transmitting radio frequency and a transmission power amplifier 8. In the present case, the transmitting local oscillator 10 of each of the quadrature modulator circuits QM-1 through QM-N is implemented by an oscillator using a DDS (Direct Digital Synthesizer) driven by an identical clock, and operates, based on the transmission weights $W_1^{TX}, W_2^{TX}, \ldots, W_N^{TX}$ inputted from the transmission weighting coefficient calculation circuit 30, to generate N transmitting local oscillation signals having phases corresponding to the weights.

A transmitting baseband signal $S^{TX}$, or transmitting data is inputted to the in-phase divider 9, and thereafter, the inputted transmitting baseband signal $S^{TX}$ is divided in phase, each divided signal being inputted to the quadrature modulator 6 of each of the quadrature modulator circuits QM-1 through QM-N. For instance, the quadrature modulator 6 of the quadrature modulator circuit QM-1 effects a quadrature modulation such as a QPSK or the like on the transmitting local oscillation signal generated by the transmitting local oscillator 10 according to the transmitting baseband signal $S^{TX}$ inputted from the in-phase divider 9, and thereafter, obtains the intermediate frequency signal through the quadrature modulation as a transmitting radio signal to the circulator CI-1 of the array antenna 1 via the up-converter 7 and the transmission power amplifier 8 of the transmitter module TM-1. In the present case, the quadrature modulator 6 subjects the inputted transmitting baseband signal $S^{TX}$ to a serial to parallel conversion process so as to convert the signal into a transmitting quadrature baseband signal, and thereafter, combines the transmitting local oscillation signals having a mutual phase difference of 90° according to the transmitting quadrature baseband signal so as to obtain the intermediate frequency signal. Then, the transmitting radio signal is radiately transmitted from the antenna element A1. Further, a similar signal processing operation is executed in each system of the transmitter section connected to the antenna elements A2 through AN. Consequently, transmitting signals weighted with the transmission weights $W_1^{TX}, W_2^{TX}, \ldots, W_N^{TX}$ are radiated from the antenna elements A1 through AN. In the present preferred embodiment, the transmitting signals transmitted from the antenna elements Ai are weighted with the transmission weights $W_1^{TX}, W_2^{TX}, \ldots, W_N^{TX}$ in a manner as described in detail hereinafter, when the signals are transmitted with same amplitudes with the phases thereof merely varied through the weighting.

In the present preferred embodiment, for example, N=16 antenna elements A1 through A16 are arranged at predetermined intervals in a lattice configuration. The above-mentioned interval is, as described hereinbefore, either half wavelength of the transmission frequency, half wavelength of the reception frequency, or half wavelength of the average value of them. Each of the antenna elements A1 through AN is, for example, a circular patch microstrip antenna. In a linear array antenna of a modification example, four antenna elements A1 through A4 are arranged in a line so as to be separated apart from each other at the above-mentioned intervals.

Figure 21:
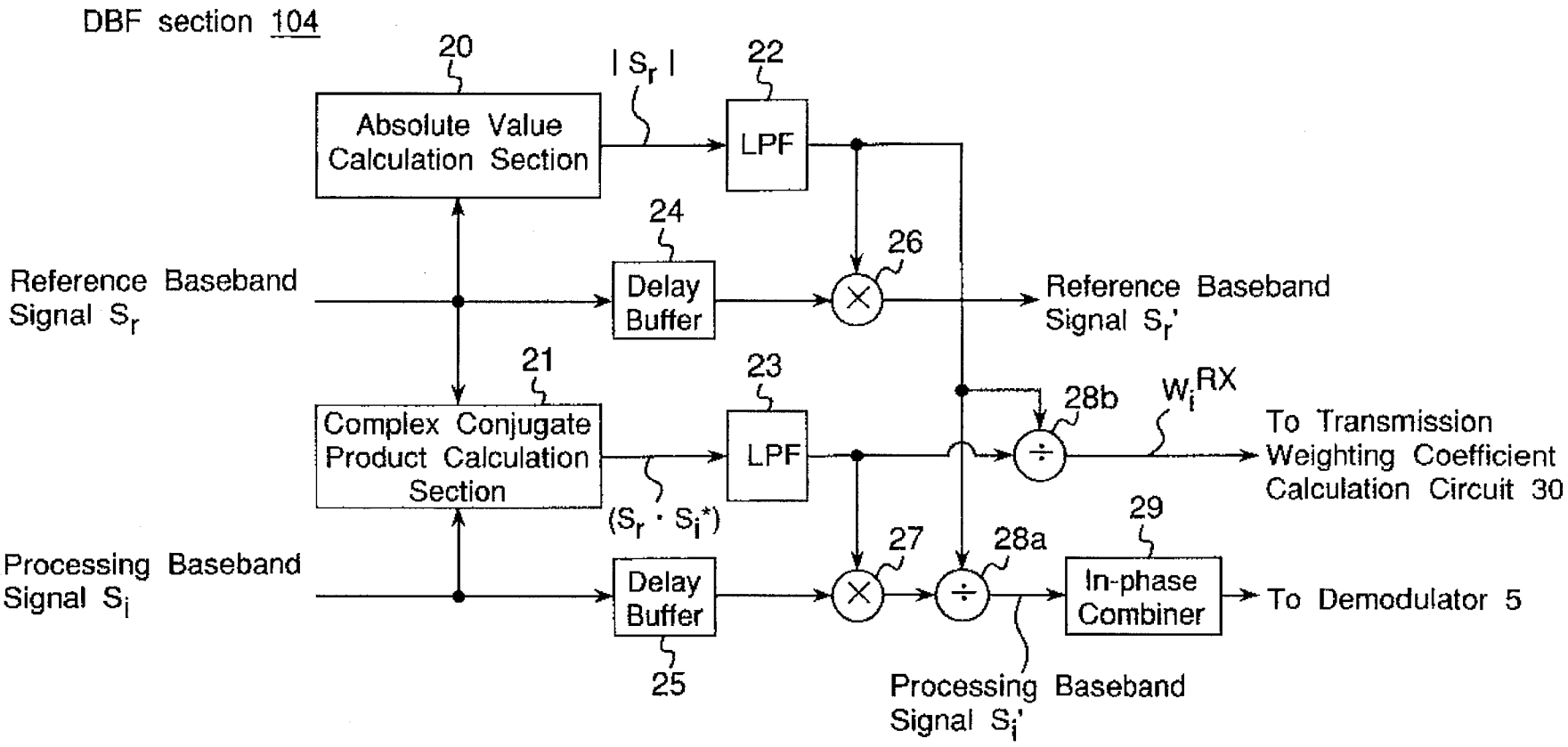
FIG. 21 is a block diagram of a digital beam forming section (DBF section) 104 shown in FIG. 18.

FIG. 21 is a block diagram showing a signal processing operation of the DBF section 104. The DBF section 104 of the present preferred embodiment effects the signal processing on a quadrature baseband signal comprised of an I component and a Q component obtained through the A/D conversion process and the quasi-synchronous detection process for each of the antenna elements A1 through AN. In the present case, assuming that the number of the antenna elements of the array antenna 1 is N, baseband signals $S_r$ and $S_i$ respectively of an antenna element Ar which serves as a phase reference and an arbitrary antenna element Ai ($1 \leqq r \leqq N$, $1 \leqq i \leqq N$) including the antenna element Ar are expressed by complex numbers as follows. In the present case, the baseband signal $S_r$ is referred to as a reference baseband signal, while the baseband signal $S_i$ is referred to as a processing baseband signal. The antenna element that serves as the phase reference (referred to as an antenna element Ar hereinafter) is a predetermined one of the N antenna elements. An antenna element that has received the baseband signal $S_i$ is referred to as an processing antenna element Ai.

$$\begin{aligned} Sr &= I_r + jQ_r \\ &= a_r \exp\{j(\phi_m + \theta_r)\}, \end{aligned} \tag{35}$$

and $$\begin{aligned} Si &= I_i + jQ_i \\ &= a_i \exp\{j(\phi_m + \theta_i)\} \\ &= a_i \exp\{j(\phi_m + \theta_r + \Delta\theta_{r,i})\} \end{aligned} \tag{36}$$

where $a_r$ is an amplitude component of the reference baseband signal, $a_i$ is an amplitude component of the processing baseband signal, and $\phi_m$ is a modulation phase. Further, $\theta_r$ is a phase difference between the reference baseband signal $S_r$ and the local oscillation signal generated by the second local oscillator 12, $\theta_i$ is a phase difference between the processing baseband signal $S_i$ and the local oscillation signal generated by the second local oscillator 12, and $\Delta\theta_{r,i}$ is a phase difference between the reference baseband signal $S_r$ and the processing baseband signal $S_i$.

In the present case, a reception signal power $|S_i|^2$ at the processing antenna element Ai can be expressed by the following Equation (37).

$$|S_i|^2 = I_i^2 + Q_i^2 = a_i^2 \tag{37}$$

In the present preferred embodiment, it is preferable to compare reception signal powers with each other obtained at the processing antenna elements Ai and determine the antenna element at which the maximum reception signal power is obtained as the phase reference for the in-phase combining in terms of in-phase combining accuracy. However, actually a phase skip occurs when the reference antenna element is changed in the course of communication, and therefore, the reference antenna element is predetermined and fixed. Then, $\phi_m$ and $\theta_r$ in the Equation (35) and the Equation (36) can be canceled by means of an operation or calculation expression of a complex conjugate product expressed by the following Equation (38).

$$S_r^* \cdot S_i = a_r a_i \cdot \exp(j\Delta\theta_{r,i}) \tag{38}$$

where * represents a complex conjugate. A complex conjugate product calculation section 21 as shown in FIG. 21 executes the operation or calculation of the Equation (38).

The real number component and the imaginary number component of the Equation (38) are expressed by the following Equations (39) and (40), respectively.

$$\begin{aligned} Re[S_r^* \cdot S_i] &= a_r a_i \cdot \cos\Delta\theta_{r,i} \\ &= I_r I_i + Q_r Q_i \end{aligned} \tag{39}$$

$$\begin{aligned} Im[S_r^* \cdot S_i] &= a_r a_i \cdot \sin\Delta\theta_{r,i} \\ &= I_r Q_i - I_i Q_r \end{aligned} \tag{40}$$

Therefore, by multiplying the complex conjugate $(S_r^* \cdot S_i)^*$ of $(S_r \cdot S_i)$ in the Equation (38) by the baseband signal $S_i$ of the antenna element Ai, the processing baseband signal $S_i$ is put in phase with the reference baseband signal $S_4$, and a processing baseband signal $S_i$, obtained through the in-phase combining process can be expressed by the following Equation (41).

$$\begin{aligned} S_i' &= (1/|S_r|)\cdot(S_r^*\cdot S_i)^*\cdot S_i \\ &= (1/|S_r|)\cdot(S_r\cdot S_i^*)\cdot S_i \\ &= a_i^2\exp\{j(\phi_m+\theta_r)\} \end{aligned} \tag{41}$$

where $$|S_r| = a_r = \sqrt{I_r^2+Q_r^2} \tag{42}$$

In the above-mentioned Equations, $|S_r|$ represents the amplitude of the reference baseband signal $S_r$ of the reference antenna element Ar. By multiplying the complex conjugate commonly by an inverse number of the amplitude for each antenna element Ai in a manner as shown in the Equation (41), the level of each processing baseband signal $S_i$ is standardized by the total reception power received by the array antenna 1. If the Equation (41) is expressed by a vector, the following Equation (43) holds.

$$\begin{bmatrix} I_i' \\ Q_i' \end{bmatrix} = \frac{1}{\sqrt{I_r^2+Q_r^2}}\begin{bmatrix} I_r\cdot I_i+Q_r\cdot Q_i & I_r\cdot Q_i-I_i\cdot Q_r \\ -(I_r\cdot Q_i-I_i\cdot Q_r) & I_r\cdot I_i+Q_r\cdot Q_i \end{bmatrix}\begin{bmatrix} I_i \\ Q_i \end{bmatrix} = a_i\begin{bmatrix} \cos(\Delta\theta_{r,i}) & \sin(\Delta\theta_{r,i}) \\ -\sin(\Delta\theta_{r,i}) & \cos(\Delta\theta_{r,i}) \end{bmatrix}\begin{bmatrix} I_i \\ Q_i \end{bmatrix} \tag{43}$$

By executing the above-mentioned vector rotating operation for every antenna element Ai, all the processing baseband signals $S_i$ are relatively put in phase with each other. The method of the present preferred embodiment of the present invention executes no $\tan^{-1}$ operation but uses the results of the Equation (39) and the Equation (40) directly as rotational matrix elements. Therefore, as evident from the Equation (43), the matrix is automatically multiplied by the amplitude $|a_i|$ of the processing baseband signal $S_i$ which serves as a coefficient. Therefore, to perform combining of the resultants for all the antenna elements Ai is to execute nothing but the maximum ratio combining (MRC). In actual communication, there is caused an error or amplitude fluctuation in putting signals in phase due to receiver noise, modulation components, band limitation and so forth, and according to these factors, each weight for the maximum ratio combining has a greater error. In order to suppress the influence of the above-mentioned factors, the Equation (43) is replaced by the following Equation 4 by means of low-pass filters 22 and 23 which are digital filters having a filter coefficient F(·).

$$\begin{bmatrix} I_i' \\ Q_i' \end{bmatrix} = \frac{1}{\sqrt{F(I_r^2+Q_r^2)}}\begin{bmatrix} F(I_r\cdot I_i+Q_r\cdot Q_i) & F(I_r\cdot Q_i-I_i\cdot Q_r) \\ -F(I_r\cdot Q_i-I_i\cdot Q_r) & F(I_r\cdot I_i+Q_r\cdot Q_i) \end{bmatrix}\begin{bmatrix} I_i \\ Q_i \end{bmatrix} \tag{44}$$

Cut-off frequencies of the low-pass filters 22 and 23 will be described hereinafter. The low-pass filters 22 and 23 shown in FIG. 21 are each implemented by a digital filter such as an FIR filter or an IIR filter. The higher the cut-off frequency is, the more the reception noises exert influence. Therefore, when the reception power per antenna element is relatively low, the acquiring and tracking accuracy tends to deteriorate. Conversely, the lower the cut-off frequency is, the less the reception noises exert influence. Therefore, acquisition and tracking can be performed even when the reception power per antenna element is low. However, the time constant of a band-pass filter increases accordingly as the bandwidth is made narrower, and therefore, this results in a dull or slow trackability with respect to an abrupt change of the direction in which the reception wave comes. A change of the direction in which the reception wave directly comes in normal mobile communication or the like is sufficiently slower than the calculating operation time for beam formation, and therefore, the reception noises are dominant. Therefore, the cut-off frequencies of the low-pass filters 22 and 23 can be determined depending on the received signal power to noise power ratio. When the reception power is relatively small as in satellite communications, it is preferable to set the cut-off frequencies of the low-pass filters 22 and 23 as low as possible within a permissible range of hardware. The cut-off frequencies of the low-pass filters 22 and 23 are each practically set to about one hundredth to one thousandth of the sampling frequency.

It is to be noted that delay buffer circuits 24 and 25 for adjusting timing so that two signals inputted to multipliers 26 and 27 are put in phase with each other are inserted into the DBF section 104 taking into account the delay effected by the low-pass filters 22 and 23.

Construction and operation of the above-mentioned DBF section 104 will be described hereinafter with reference to FIG. 21.

Referring to FIG. 21, the reference baseband signal $S_r$ is inputted to an absolute value calculation section 20 and a complex conjugate product calculation section 21, and also the reference baseband signal $S_r$ is inputted to the multiplier 26 via the delay buffer circuit 24. On the other hand, the processing baseband signal $S_i$ is inputted to the complex conjugate product calculation section 21 and is also inputted to the multiplier 27 via the delay buffer circuit 25. The absolute value calculation section 20 calculates the absolute value $|S_r|$ based on the reference baseband signal $S_r$, and then, outputs a signal representing the absolute value $|S_r|$ to dividers 28*a* and 28*b* via the low-pass filter (LPF) 22. On the other hand, the complex conjugate product calculation section 21 executes an operation of $(S_r\cdot S_i^*)$ based on the reference baseband signal $S_r$ and the processing baseband signal $S_i$, and then, outputs a signal representing the operation result to the multiplier 27 and the divider 28*b* via the low-pass filter 23. The multiplier 26 multiplies the inputted two signals by each other, and then, outputs a signal representing the multiplication result as a processed reference baseband signal $S_r'$. On the other hand, the multiplier 27 multiplies the inputted two signals by each other, and then, outputs a signal representing the multiplication result to the divider 28*a*. The divider 28*a* divides the signal inputted from the multiplier 27 by the signal inputted from the low-pass filter 22, and then, outputs a signal representing the division result as a processed in-phase processing baseband signal $S_i'$ to an in-phase combiner 29. The divider 28*b* divides the signal inputted from the low-pass filter 23 by the signal inputted from the low-pass filter 22, and then, outputs a signal representing the division result as a reception weight $W_i^{Rx}$ to a transmission weighting coefficient calculation circuit 30. Then, the in-phase combiner 29 combines in phase all of N processed in-phase processing baseband signals $S_i'$ (i=1, 2, . . . , N), and then, outputs the resulting signal to the demodulator 5. Therefore, as is apparent from FIG. 21 and the above description, weighting for the maximum ratio combining is automatically effected in the process of putting the signals in phase with each other, and therefore, the DBF section 104 has a very simple construction.

On the other hand, since a quasi-synchronous detection process is used for the detection of the baseband signals as shown in FIG. 18, the output signal of the DBF section 104 is not synchronized with the second local oscillation signal for reception. Therefore, it is required to connect the baseband processing type demodulator 5 in the stage subsequent to the DBF section 104 so as to synchronize the signal Phase with the carrier phase. Further, when symbol delay of a multi-path wave signal is significantly great, a further appropriate adaptive equalizer (EQL) (not shown) must be incorporated. As a result of these processing operations, the present apparatus of the present preferred embodiment simultaneously forms a plurality of main beams in the directions of the direct wave and a multi-path delayed wave (referred to as a multi-path wave hereinafter), combines the main beams appropriately in terms of carrier signal power to noise power ratio (reception CNR), and tracks the beams. Since the present apparatus uses no feedback loop for the beam formation, the apparatus can operate stably and speedily even at a low reception CNR similarly to the second prior art.

Next, retro-directive transmitting beam formation to be executed by the transmission weighting coefficient calculation circuit 30 shown in FIG. 23 will be described hereinafter. First of all, here is considered a case where the interval of the antenna elements of the transmission array antenna and the interval of the antenna elements of the reception array antenna are equal to each other in terms of wavelength. In the present case, in order to form a transmitting beam in the same direction as that of the received incoming beam, it is normally proper to use the reception weight $W_i^{RX}$ that is used on the reception side as a transmission weight $W_i^{TX}$, as follows.

$$S_i^{TX}=W_i^{TX}\cdot S^{TX}=(W_i^{RX})\cdot S^{TX} \tag{45}$$

$$W_i^{RX}=\{1/F(|S_r|)\}\cdot F(S_r\cdot S_i^*) \tag{46}$$

where $S^{TX}$ is a transmitting baseband signal inputted to the present apparatus, $Si^{TX}$ is a transmitting baseband signal supplied to the antenna element Ai, and $W_i^{TX}$ is a transmission weight for the antenna element Ai. As a result, a transmitting beam having a form identical to that of the received beam is to be formed. When a relatively great multi-path delayed wave exists, a beam is to be formed not only in the direction of the direct wave but also in the direction of delayed waves. When it is possible to assume that same frequencies are used and both paths are approximately equal to each other in reception and transmission in such a case as TDD (Time Division Duplex) by which reception and transmission are performed alternately at an identical frequency, the above-mentioned arrangement is enough, this allows a diversity transmission and reception system to be easily constructed. However, when there are used different frequencies in reception and transmission, the phase difference between the paths becomes unequal. Therefore, no diversity transmission and reception system can be constructed, and it is required to suppress transmission in the direction of the delayed waves as far as possible. Therefore, on an assumption that the direct wave has the greatest level among a plurality of multi-path waves, a method for forming a single main beam in the direction of the direct wave while eliminating the influence of the delayed waves will be described below.

According to the Equation (39) and the Equation (40), a reception phase difference $\Delta\theta_{r,i}$ between the reference antenna element Ar and the arbitrary antenna element Ai is expressed by the following Equation (47).

$$\Delta\theta_{r,i}=\tan^{-1}\{F(I_r\cdot Q_i-I_i\cdot Q_r)/F(I_r\cdot Q_i)\} \tag{47}$$

It is to be noted that $\Delta\theta_{r,i}$ obtained here is within a range of $-\tau$ to $+\tau$. Therefore, the phase difference rotates several times (i.e., becomes an integral multiple of $2\tau$) accordingly as the antenna element interval increases, and this causes a phase uncertainty. A method for removing the phase uncertainty will be described in detail hereinafter, however, it is assumed now that the phase uncertainty has been already removed. Assuming that there is neither delayed wave nor noise, the phase difference $\Delta\theta_{r,i}$ is to be in a certain linear phase plane. However, when there is a delayed wave or noise, the phase difference is to be dispersed about the plane. It is now considered that, by using a value formed by making the phase difference regress to the phase plane as an excitation phase and effect excitation with an identical amplitude, a single transmitting main beam is formed only in the direction in which the direct wave having the greatest level comes. As a method for making the phase difference regress to the linear phase plane, a regression analysis method using the least square method (LSR) can be used. First of all, a linear phase regression plane is set as follows.

$$\Delta\theta_{r,i}^{LSR}=ax+by+c \tag{48}$$

Figure 22:
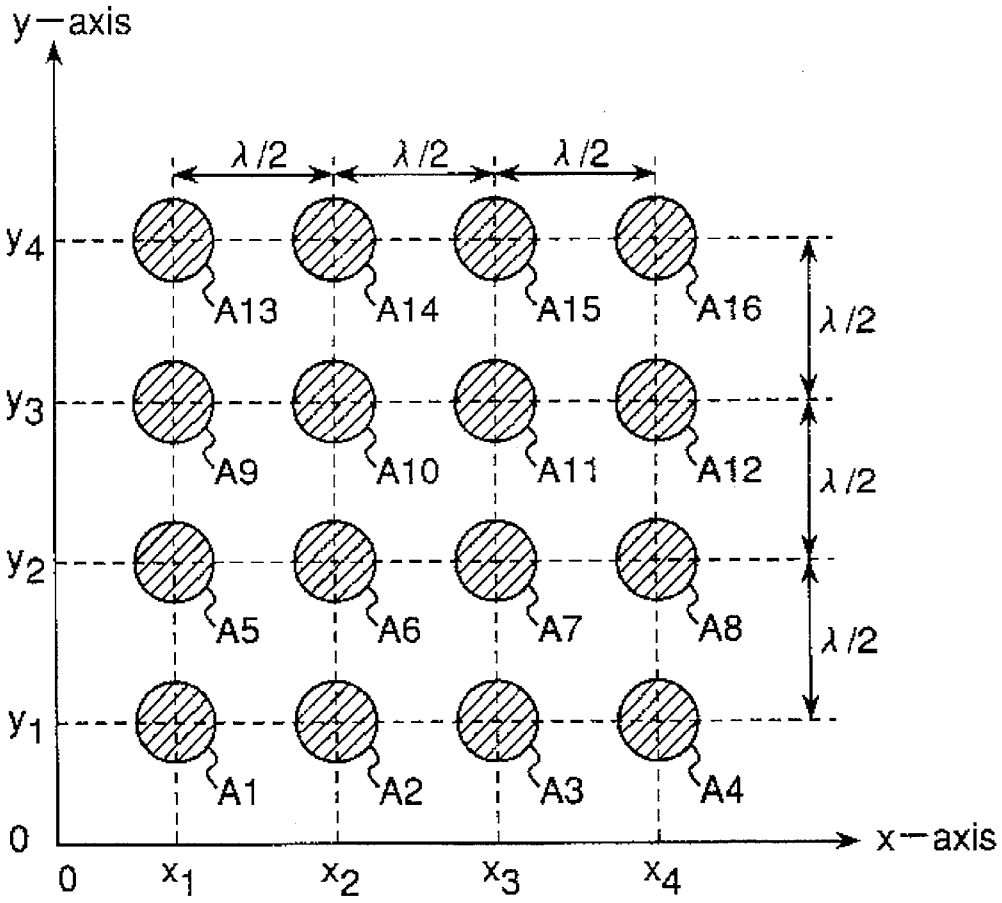
FIG. 22 is a plan view showing an arrangement of antenna elements in the preferred embodiments.

In the present case, the array antenna 1 is assumed to be located in an xy-plane of an xyz-coordinate system as shown in FIG. 22. The coefficients a, b and c can be obtained by solving the following Wiener-Hopf equation (49).

$$X^T\cdot X\cdot A=X^T\cdot\Theta \tag{49}$$

where $$X=\begin{bmatrix} x_1 & y_1 & 1 \\ x_2 & y_2 & 1 \\ \vdots & \vdots & \vdots \\ x_N & y_N & 1 \end{bmatrix} \tag{50}$$

$$A=\begin{bmatrix} a \\ b \\ c \end{bmatrix} \tag{51}$$

$$\Theta=\begin{bmatrix} \Delta\theta_{r,i} \\ \Delta\theta_{r,2} \\ \vdots \\ \Delta\theta_{r,N} \end{bmatrix} \tag{52}$$

In the present case, the coordinates of the antenna element Ai of the array antenna 1 are $(x_i, y_i)$ (i=1, 2, . . . , N), where x is a matrix depending on the arrangement of the antenna element Ai, A is a matrix comprised of the coefficients a, b and c representing the above-mentioned linear phase regression plane, $\Theta$ is a matrix comprised of the phase difference $\Delta\theta_{r,i}$ of the antenna elements Ai. The matrix A in the Equation (49) can be expressed by the following Equation (53) by rewriting the Equation (49).

$$A=(X^T\cdot X)^{-1}\cdot X^T\cdot\Theta \tag{53}$$

In the Equation (53), $(X^T \cdot X)^{-1} \cdot X^T$ represents a matrix of 3×N depending on the element arrangement of the array antenna 1, and therefore, $(X^T \cdot X)^{-1} \cdot X^T$ can be preparatorily calculated. The parameter A of the regression plane can be obtained by executing a product-sum operation every N times from the phase matrix Θ obtained according to the Equation (47). On the other hand, the phase difference $\Delta\theta_{r,i}$ obtained according to the Equation (47) in a manner as described above has a phase uncertainty. When such an uncertainty exists, even when the least square regression process is executed, the correct phase regression plane cannot always be obtained. Therefore, the following three ways of phase uncertainty and phase correction in the cases are put into execution.

(a) Correction case (I):

$$\Delta\theta'_{i-1,i}=\Delta\theta_{i-1,i} \text{ (no correction)} \tag{54}$$

(b) Correction case (II):

$$\text{if } \Delta\theta_{i-1,i}<-k,\ \Delta\theta'_{i-1,i}=\Delta\theta_{i-1,i}+2\pi$$

otherwise, $$\Delta\theta'_{i-1,i}=\Delta\theta_{i-1,i} \text{ (no correction)} \tag{55}$$

(c) Correction case (III):

$$\text{if } k\leqq\Delta\theta_{i-1,i},\ \Delta\theta'_{i-1,i}=\Delta\theta_{i-1,i}-2\pi$$

otherwise, $$\Delta\theta'_{i-1,i}=\Delta\theta_{i-1,i} \text{ (no correction)} \tag{56}$$

where the phase difference $\Delta\theta_{i-1,i}$ represents a phase difference between most adjacent antenna elements of each combination, and is expressed by the following Equation (57).

$$\Delta\theta_{i-1,i}=\Delta\theta_{r,i}-\Delta\theta_{r,i-1} \tag{57}$$

On the other hand, k exists within a range of $0<k<\pi$, and is a phase threshold value representing a degree of disorder or disturbance of the reception phase difference due to a multi-path wave, the value is set according to an estimated intensity of the multi-path wave. Setting of the phase threshold value k in checking the reception phase uncertainty will be described below.

Figure 30:
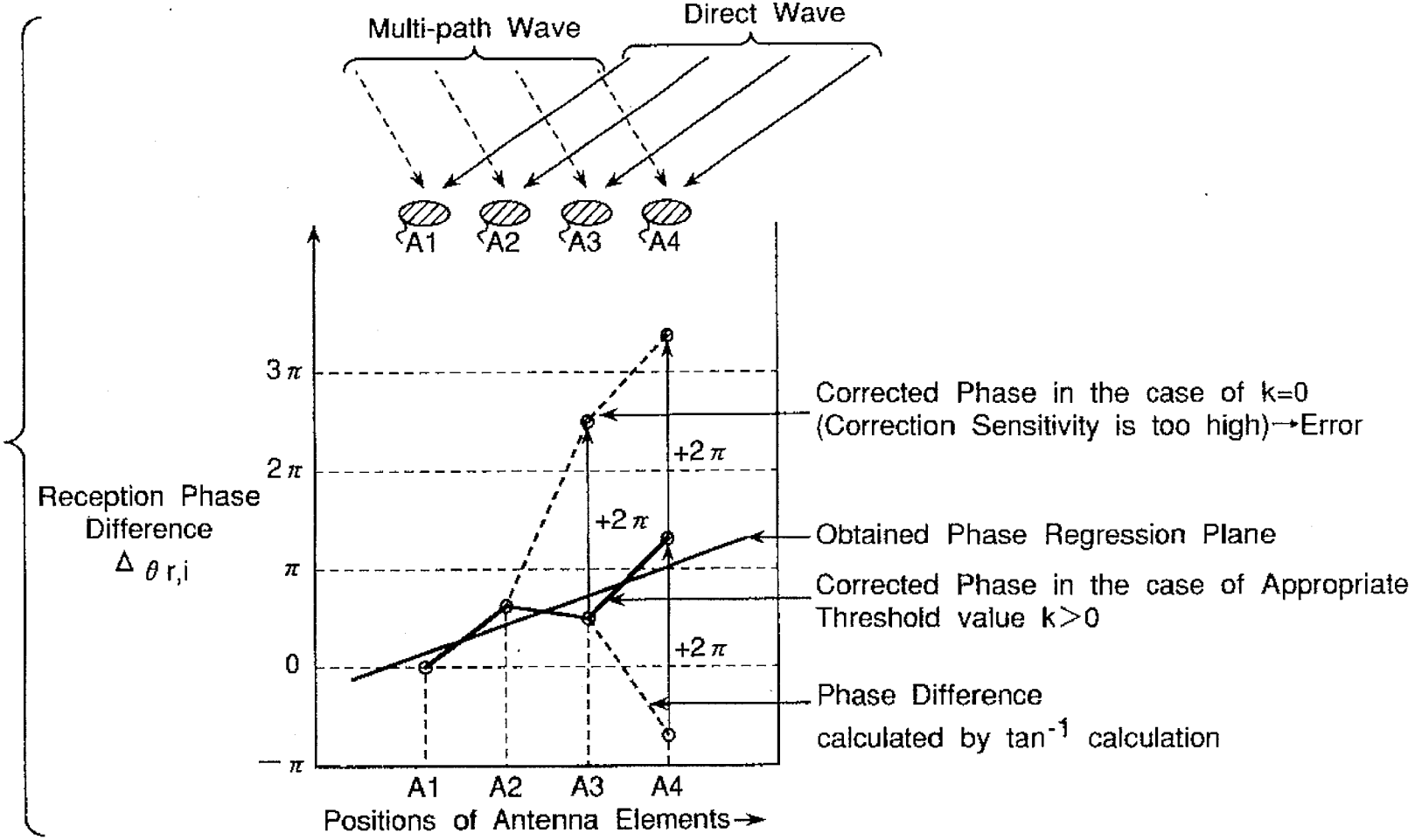
FIG. 30 is an explanatory view of setting of a phase threshold value k in check of uncertainty of reception phase in the transmitting weighting coefficient calculation circuit 30 shown in FIG. 23.

In the present preferred embodiment, the three ways of phase uncertainty and phase correction processes are executed according to the Equation (54) through the Equation (56), and the positive phase threshold value k (>0) is set therein. The positive phase threshold value K becomes a parameter for determining a sensitivity of the phase correction. That is, the smaller the value k is, the higher the correction sensitivity becomes, and the maximum sensitivity is achieved when k=0. Conversely, the greater the value k is, the lower the correction sensitivity becomes, and almost no phase correction is effected when k is not smaller than π. Therefore, when the received signal wave is only the direct incoming wave and the reception intensity of the multi-path incoming wave is sufficiently smaller than that of the direct incoming wave, it is preferable that k≈0. However, when the reception intensity of the multi-path incoming wave is great and the direction in which the direct wave comes is close to the front of the antenna, a correction error may occur due to the fact that the reception phase plane is not flat as shown in FIG. 30. The above is because the correction sensitivity is too high. Therefore, by making the correction sensitivity slightly dull by setting the value k to a value within a range of k>0, the correct correction phase is to be obtained. By setting the phase threshold value k to about π/6, correct phase correction can be achieved even when a multi-path incoming wave having the same level as that of the direct incoming wave is received. Therefore, in the present preferred embodiment, the phase threshold value k is preferably set to π/6.

When the array antenna 1 is arranged in the xy-coordinate system as shown in FIG. 22, the phase plane is expressed by the following Equation (58).

$$\Delta\theta_{r,i}^{LSR}=ax+by+c \tag{58}$$

In the present case, there are three correction methods (I) through (III) in the x-axis direction, while there are three correction methods (I) through (III) in the y-axis direction. Therefore, a total of nine types of phase regression planes are obtained. Hereinbelow, for example, a correction case (I-II) represents a phase regression plane in a case where the correction case (I) is effected in the x-axis direction (practically no correction is effected) and the correction case (II) is effected in the y-axis direction. Each axis corresponds to three types of phase uncertainty, and totally nine phase regression planes expressed by the following Equations (59) are obtained.

(a) In the correction case (I-I), $$\Delta\theta_{r,i}^{LSR(I\text{-}I)}=a_Ix+b_Iy+c$$

(b) In the correction case (I-II), $$\Delta\theta_{r,i}^{LSR(I\text{-}II)}=a_Ix+b_{II}y+c$$

(c) In the correction case (I-III), $$\Delta\theta_{r,i}^{LSR(I\text{-}III)}=a_Ix+b_{III}y+c$$

(d) In the correction case (II-I), $$\Delta\theta_{r,i}^{LSR(II\text{-}I)}=a_{II}x+b_Iy+c$$

(e) In the correction case (II-II), $$\Delta\theta_{r,i}^{LSR(II\text{-}II)}=a_{II}x+b_{II}y+c$$

(f) In the correction case (II-III), $$\Delta\theta_{r,i}^{LSR(II\text{-}III)}=a_{II}x+b_{III}y+c$$

(g) In the correction case (III-I), $$\Delta\theta_{r,i}^{LSR(III\text{-}I)}=a_{III}x+b_Iy+c$$

(h) In the correction case (III-II), $$\Delta\theta_{r,i}^{LSR(III\text{-}II)}=a_{III}x+b_Iy+c$$

(i) In the correction case (III-III), $$\Delta\theta_{r,i}^{LSR(III\text{-}III)}=a_{III}x+b_{III}y+c \tag{59}$$

In the present case, residual sums of squares are defined by the following Equations (60).

(a) In the correction case (I-I), $$SS_{(I-I)}=\sum_{i=1}^{N}(\Delta\theta_{r,i}-\Delta\theta_{r,i}^{LSR(I-I)})^2$$

(b) In the correction case (I-II), $$SS_{(I-II)}=\sum_{i=1}^{N}(\Delta\theta_{r,i}-\Delta\theta_{r,i}^{LSR(I-II)})^2$$

(c) In the correction case (I-III), $$SS_{(I-III)}=\sum_{i=1}^{N}(\Delta\theta_{r,i}-\Delta\theta_{r,i}^{LSR(I-III)})^2$$

(d) In the correction case (II-I), $$SS_{(II-I)}=\sum_{i=1}^{N}(\Delta\theta_{r,i}-\Delta\theta_{r,i}^{LSR(II-I)})^2$$

(e) In the correction case (II-II), $$SS_{(II-II)}=\sum_{i=1}^{N}(\Delta\theta_{r,i}-\Delta\theta_{r,i}^{LSR(II-II)})^2$$

(f) In the correction case (II-III), $$SS_{(II-III)}=\sum_{i=1}^{N}(\Delta\theta_{r,i}-\Delta\theta_{r,i}^{LSR(II-III)})^2$$

(g) In the correction case (III-I), $$SS_{(III-I)}=\sum_{i=1}^{N}(\Delta\theta_{r,i}-\Delta\theta_{r,i}^{LSR(III-I)})^2$$

(h) In the correction case (III-II), $$SS_{(III-II)}=\sum_{i=1}^{N}(\Delta\theta_{r,i}-\Delta\theta_{r,i}^{LSR(III-II)})^2$$

(i) In the correction case (III-III), $$SS_{(III-III)}=\sum_{i=1}^{N}(\Delta\theta_{r,i}-\Delta\theta_{r,i}^{LSR(III-III)})^2 \quad (60)$$

Figure 25:
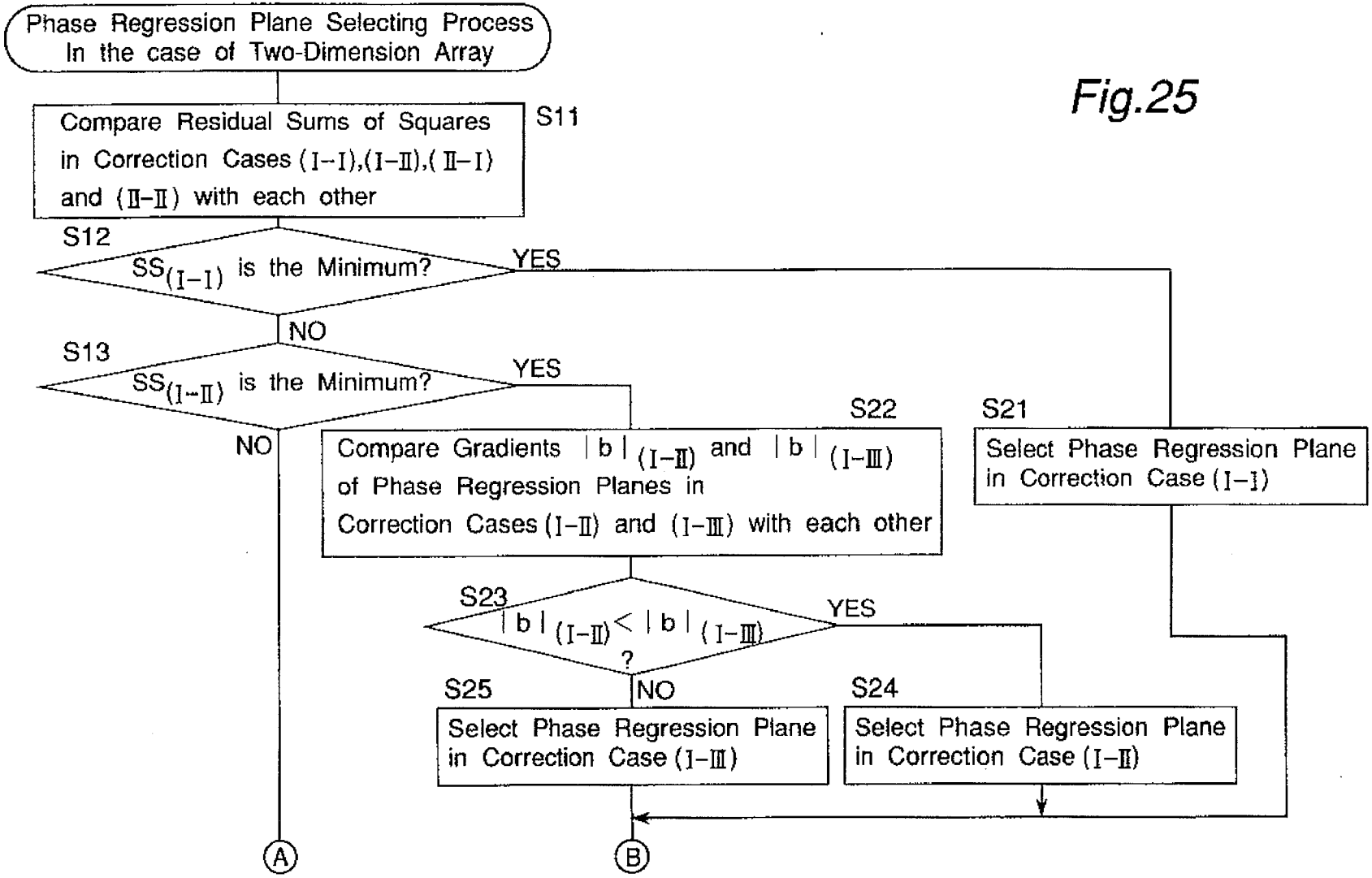
FIG. 25 is a flowchart of the first part of a phase regression plane selecting process in a case where the antenna elements are arranged in a two-dimensional array (preferred embodiment) executed by the phase regression plane selecting section 33 shown in FIG. 23.
Figure 26:
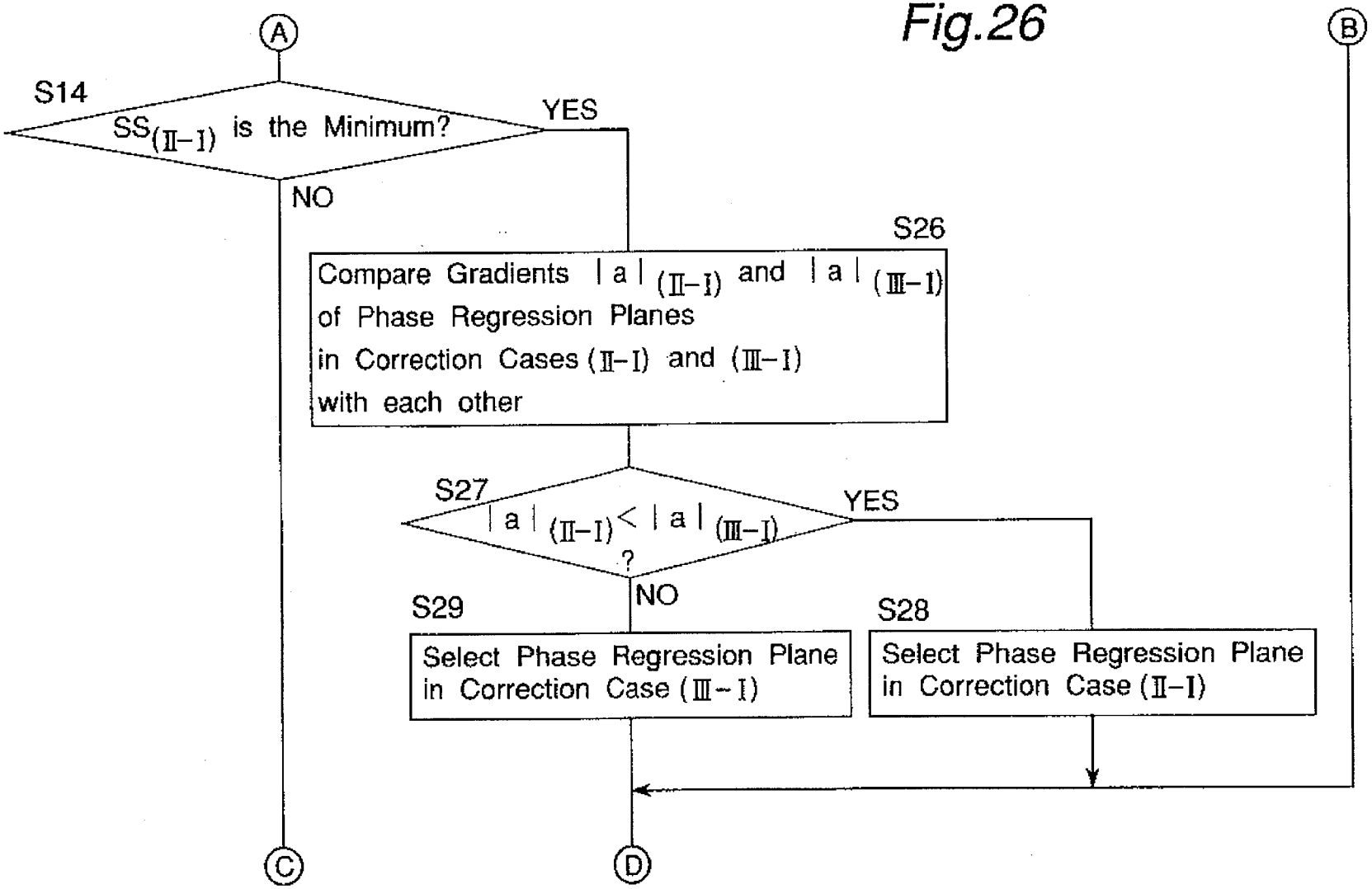
FIG. 26 is a flowchart of the second part of the phase regression plane selecting process in the case where the antenna elements are arranged in the two-dimensional array (preferred embodiment) executed by the phase regression plane selecting section 33 shown in FIG. 23.
Figure 27:
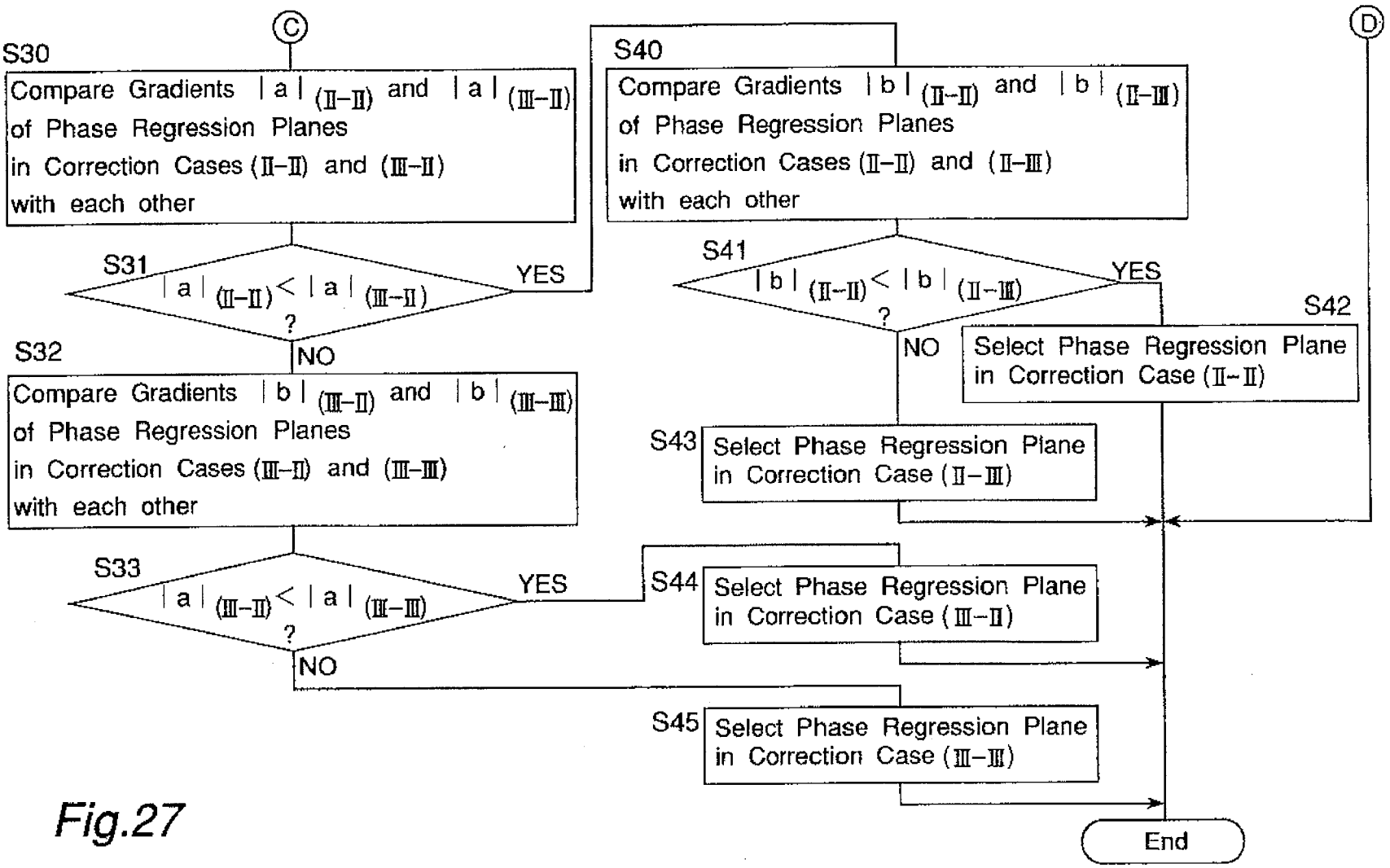
FIG. 27 is a flowchart of the third part of the phase regression plane selecting process in the case where the antenna elements are arranged in the two-dimensional array (preferred embodiment) executed by the phase regression plane selecting section 33 shown in FIG. 23.

According to the above-mentioned equations, the phase uncertainty is removed through a phase regression plane selecting process shown in FIGS. 25 through 27 by means of the residual sum of squares $SS=\Sigma(\Delta\theta_{r,i}-\Delta\theta_{r,i}^{LSR})^2$ and phase gradients |a| and |b| of the regression plane, so that one equi-phase regression plane is selected.

The phase regression plane selecting process in a two-dimensional array will be described hereinafter with reference to flowcharts of FIGS. 25 through 27.

Referring to FIG. 25, in step S11, residual sums of squares $SS_{(I-I)}$, $SS_{(I-II)}$, $SS_{(II-I)}$ and $SS_{(II-II)}$ in the correction cases (I-I), (I-II), (II-I) and (II-II) are compared with each other. When the residual sum of squares $SS_{(I-I)}$ is the minimum in step S12, the phase regression plane in the correction case (I-I) is selected in step S21, and then, the present process is completed. When the residual sum of squares $SS_{(I-II)}$ is the minimum in step S13, gradients $|b|_{(I-II)}$ and $|b|_{(I-III)}$ of the regression planes in the correction cases (I-II) and (I-III) are compared with each other in step S22. Subsequently, when $|b|_{(I-II)}<|b|_{(I-III)}$ in step S23, the phase regression plane in the correction case (I-II) is selected in step S24, and then, the present process is completed. When $|b|_{(I-II)}\geqq|b|_{(I-III)}$ in step S23, the phase regression plane in the correction case (I-III) is selected in step S25, and then, the present process is completed.

When the answer in step S13 is negative or NO and when the residual sum of squares $SS_{(II-I)}$ is the minimum in step S14 in FIG. 26, gradients $|a|_{(II-I)}$ and $|a|_{(III-I)}$ of the regression planes in the correction cases (II-I) and (III-I) are compared with each other in step S26. Subsequently, when $|a|_{(II-I)}<|a|_{(III-I)}$ in step S27, the phase regression plane in the correction case (II-I) is selected in step S28, and then, the present process is completed. When $|a|_{(II-I)}\geqq|a|_{(III-I)}$ in step S27, the phase regression plane in the correction case (III-I) is selected in step S29, and the then, present process is completed.

When the answer in step S14 is NO, gradients $|a|_{(II-II)}$ and $|a|_{(III-II)}$ of the regression planes in the correction cases (II-II) and (III-II) are compared with each other in step S30 in FIG. 27. Subsequently, when $|a|_{(II-II)}<|a|_{(III-II)}$ in step S31, gradients $|b|_{(II-II)}$ and $|b|_{(II-II)}$ of the regression planes in the correction cases (II-II) and (II-III) are compared with each other in step S40. Subsequently, when $|b|_{(II-II)}<|b|_{(II-III)}$ in step S41, the phase regression plane in the correction case (II-II) is selected in step S42, and then, the present process is completed. When $|b|_{(II-II)}\geqq|b|_{(II-III)}$ in step S41, the phase regression plane in the correction case (II-III) is selected in step S43, and then, the present process is completed.

Further, when $|a|_{(II-II)}\geqq|a|_{(III-II)}$ in step S31, gradients $|b|_{(III-II)}$ and $|b|_{(III-III)}$ of the regression planes in the correction cases (III-II) and (III-III) are compared with each other in step S32. Subsequently, when $|b|_{(III-II)}$ in step S33, the phase regression plane in the correction case (III-II) is selected in step S44, and then, the present process is completed. When $|b|_{(III-II)}\geqq|b|_{(III-III)}$ in step S33, the phase regression plane in the correction case (III-III) is selected in step S45, and then, the present process is completed.

Next, a method for removing the phase uncertainty will be described based on a case of a linear array antenna (modification example) for simplicity. That is, when N antenna elements Ai are arranged in line, the phase plane is expressed by the following Equation (61).

$$\Delta\theta_{r,i}^{LSR}=ax+c \quad (61)$$

In the present case, by applying the Equation (61) to each of the cases of the Equation (54) through the Equation (56), the following three phase regression planes can be obtained.

(a) In correction case (I), $$\Delta\theta_{r,i}^{LSR(I)}=a_I X+c_I$$

(b) In correction case (II), $$\Delta\theta_{r,i}^{LSR(II)}=a_{II} X+c_{II}$$

(c) In correction case (III), $$\Delta\theta_{r,i}^{LSR(III)}=a_{III} X+c_{III} \quad (62)$$

In the present case, residual sums of squares of the correction cases are defined by the following Equations (63).

(a) In correction case (I), $$SS_{(I)}=\sum_{i=1}^{N}(\Delta\theta_{r,i}-\Delta\theta_{r,i}^{LSR(I)})^2$$

(b) In correction case (II), $$SS_{(II)} = \sum_{i=1}^{N} (\Delta\theta_{r,i} - \Delta\theta_{r,i}^{LSR(II)})^2$$

(c) In correction case (III), $$SS_{(III)} = \sum_{i=1}^{N} (\Delta\theta_{r,i} - \Delta\theta_{r,i}^{LSR(III)})^2 \quad (63)$$

Figure 24:
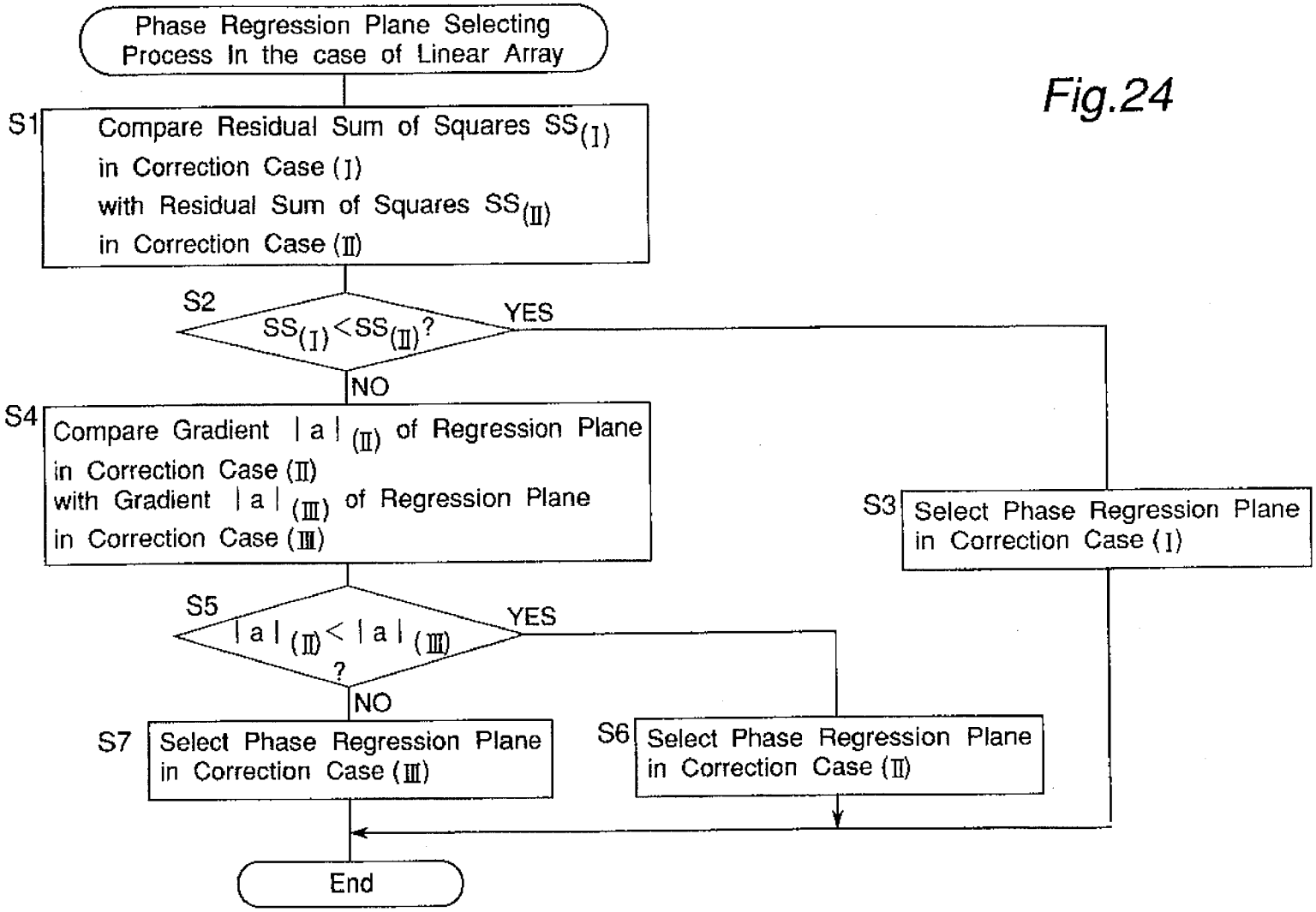
FIG. 24 is a flowchart of a phase regression plane selecting process in the case where the antenna elements are arranged in a linear array (modification example) executed by a phase regression plane selecting section 33 shown in FIG. 23.

With the above-mentioned arrangement, the phase uncertainty is removed through the phase regression plane selecting process shown in FIG. 24 by means of the residual sum of squares $SS=\Sigma(\Delta\theta_{r,i}-\Delta\theta_{r,i}^{LSR})^2$ and the phase gradient |a| of the regression plane, so that one equi-phase regression plane is selected.

The phase regression plane selecting process in the case of the linear array will be described hereinafter with reference to FIG. 24.

Referring to FIG. 24, the residual sums of squares $SS_{(I)}$ and $SS_{(II)}$ in the correction cases (I) and (II) are compared with each other in step S1. When $SS_{(I)}<SS_{(II)}$ in step S2, the phase regression plane in the correction case (I) is selected in step S3, and then, the present process is completed. When $SS_{(I)} \geqq SS_{(II)}$ in step S2, gradients $|a|_{(II)}$ and $|a|_{(III)}$ in the correction cases (II) and (III) are compared with each other in step S4. When $|a|_{(II)}<|a|_{(III)}$ in step S5, the phase regression plane in the correction case (II) is selected in step S6, and then, the present process is completed. When $|a|_{(II)} \geqq |a|_{(III)}$ in step S5, the phase regression plane in the correction case (III) is selected in step S7, and then, the present process is completed.

Figure 28:
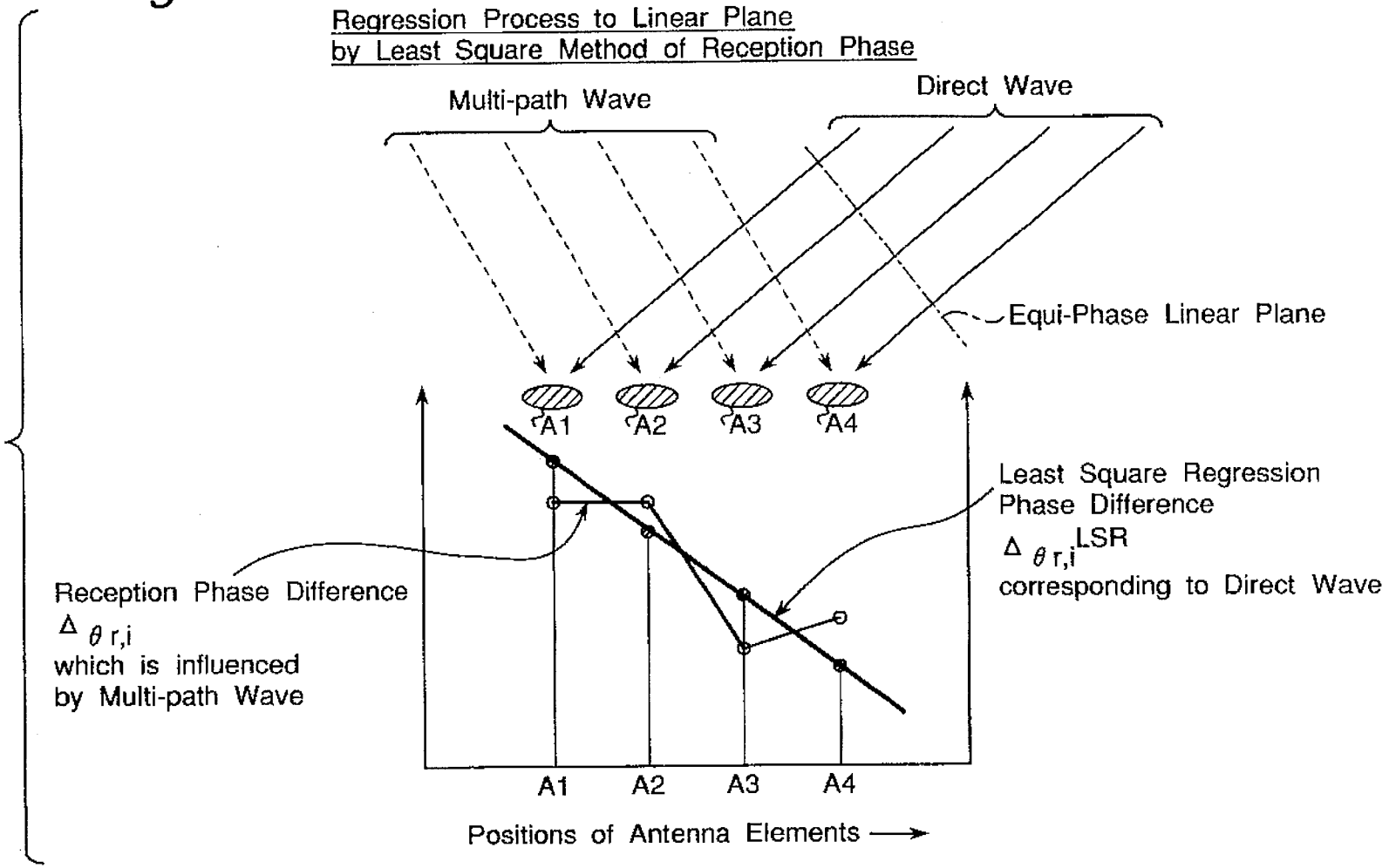
FIG. 28 is an explanatory view of a regression process to a linear plane by least square method of reception phase in a transmitting weighting coefficient calculation circuit 30 shown in FIG. 23.

FIG. 28 shows an explanatory view of a regression process to linear plane by the least square method of reception phase, while FIG. 29 is an explanatory view of check and removal of phase uncertainty in the above-mentioned case.

Referring to FIG. 28, when only the direct wave is received, the reception phase difference $\Delta\theta_{r,i}$ between antenna elements Ai of each combination is located in a line depending on the position of the antenna elements Ai. However, when a multi-path wave is further received, the reception phase difference deviates from the line.

Referring to FIG. 29, there is shown a case where the phase regression plane of the correction case (II) is selected when the program flow reaches step S6.

Through the above-mentioned phase regression plane selecting process, the phase plane corresponding to the direction of the direct wave having the greatest intensity can be estimated and detected. In any other phase plane, the residual sum of squares increases and the phase gradient is steep. From the thus-determined reception phase difference $\Delta\theta_{r,i}^{LSR}$, the transmission weight $W_i^{TX}$ can be calculated according to the following Equation (64).

$$\begin{aligned} W_i^{TX} &= \exp(j\theta_i^{TX}) \\ &= \exp(-j\Delta\theta_{r,i}^{LSR}) \end{aligned} \quad (64)$$

In the present case, the amplitude component of the transmission weight is made to 1 commonly for all the antenna elements Ai so as to uniform the wave source distribution. Further, when the array antenna 1 is used commonly for transmission and reception, and different frequencies are used in transmission and reception, a transmitting main beam can be formed correctly in the direction of the direct incoming wave by multiplying the excitation phase by a frequency ratio. That is, the above-mentioned operation or calculation can be expressed by the following Equation (65), where $f^{TX}$ and $f^{RX}$ are transmission frequency and reception frequency, respectively.

$$\begin{aligned} W_i^{TX} &= \exp(j\theta_i^{TX}) \\ &= \exp\{-j(f^{TX}/f^{RX})\Delta\theta_{r,i}^{LSR}\} \end{aligned} \quad (65)$$

FIG. 23 is a block diagram showing a transmitting weighting coefficient calculation circuit 30 for executing the above-mentioned processes.

Referring to FIG. 23, a phase difference calculation section 31-i (i=1, 2, . . . , N) calculates a phase difference $\Delta\theta_{r,i}$ by executing a $\tan^{-1}$ operation of the reception weight $W_i^{RX}$ based on the reception weight $W_i^{RX}$ inputted from the DBF section 104, and then, outputs the resultant to a least square regression processing section 32-j (j=1, 2, . . . , 9). The least square regression processing section 32-j (j=1, 2, . . . , 9) is provided with nine processing sections corresponding to the nine phase regression planes expressed by the Equation (59). Each least square regression processing section 32-j calculates the coefficients a, b and c of the phase plane set therefor by solving the Wiener-Hopf equation expressed by the Equation (49), calculates the reception phase difference $\Delta\theta r,i^{LSR}$ (i=1, 2, . . . , N) on the phase regression plane by substituting the calculated coefficients a, b and c into the Equation (59), and then, outputs the resultant to a selector 34. On the other hand, a phase regression plane selecting section 33 executes the phase regression plane selecting process shown in FIGS. 25 through 27 based on the phase regression planes calculated by the least square regression processing sections 32-j to determine the phase regression plane to be selected, and then, outputs information of the phase regression plane determined to be selected to the selector 34. The selector 34 selects only N reception phase differences $\Delta\theta_{r,i}^{LSR}$ inputted from the least square regression processing section 32-k corresponding to the phase regression plane determined to be selected, and then, outputs the resultant to a transmission weighting coefficient calculation section 35. In response to the above-mentioned operation or calculation, the transmission weighting coefficient calculation section 35 calculates the transmission weight $W_i^{TX}$ (i=1, 2, . . . , N) by executing the calculation of the Equation (65) based on the inputted N reception phase differences $\Delta\theta_{r,i}^{LSR}$.

A result of simulation on the apparatus having the above-mentioned construction performed by the present inventor will be further described below. In order to evaluate the apparatus of the present preferred embodiment, a numerical simulation was performed under the conditions shown in Table 2. As the array antenna 1, a basic four-element half-wavelength interval linear array antenna of a modification example was used, and a modulation system was assumed to be a quarterly phase shift keying modulation QPSK (transmission rate: 16 kbps). Further, as the low-pass filters 22 and 23 for putting received signals in phase with each other, a secondary narrow-band IIR (Infinite Impulse Response) filter was used.

TABLE 2

| Simulation specifications | |
|---|---|
| Modulation system | 16-kbps QPSK with differential encoded synchronous detection |
| Modulation frequency | 32 kHz (used as intermediate frequency) |
| Sampling frequency | 128 kHz (16 samples/symbol) |
| A/D resolution | 8 bits |

TABLE 2-continued

| Simulation specifications | |
|---|---|
| Added noise | Gauss noise |
| Antenna | 4-element linear array with a point radiation source |
| Antenna element interval | Half wavelength of carrier wavelength |
| Roll-off filter | 10-tap FIR filter, roll-off rate: 50%, cut-off frequency: 8 kHz |
| Transmission band-pass filter | Bandwidth bit length product BT = 2 |
| Reception band-pass filter | Bandwidth bit length product BTm = 1 |
| Carrier regenerating method | Feed-forward phase estimation |
| Clock generating method | Decision directed method |

Figure 31:
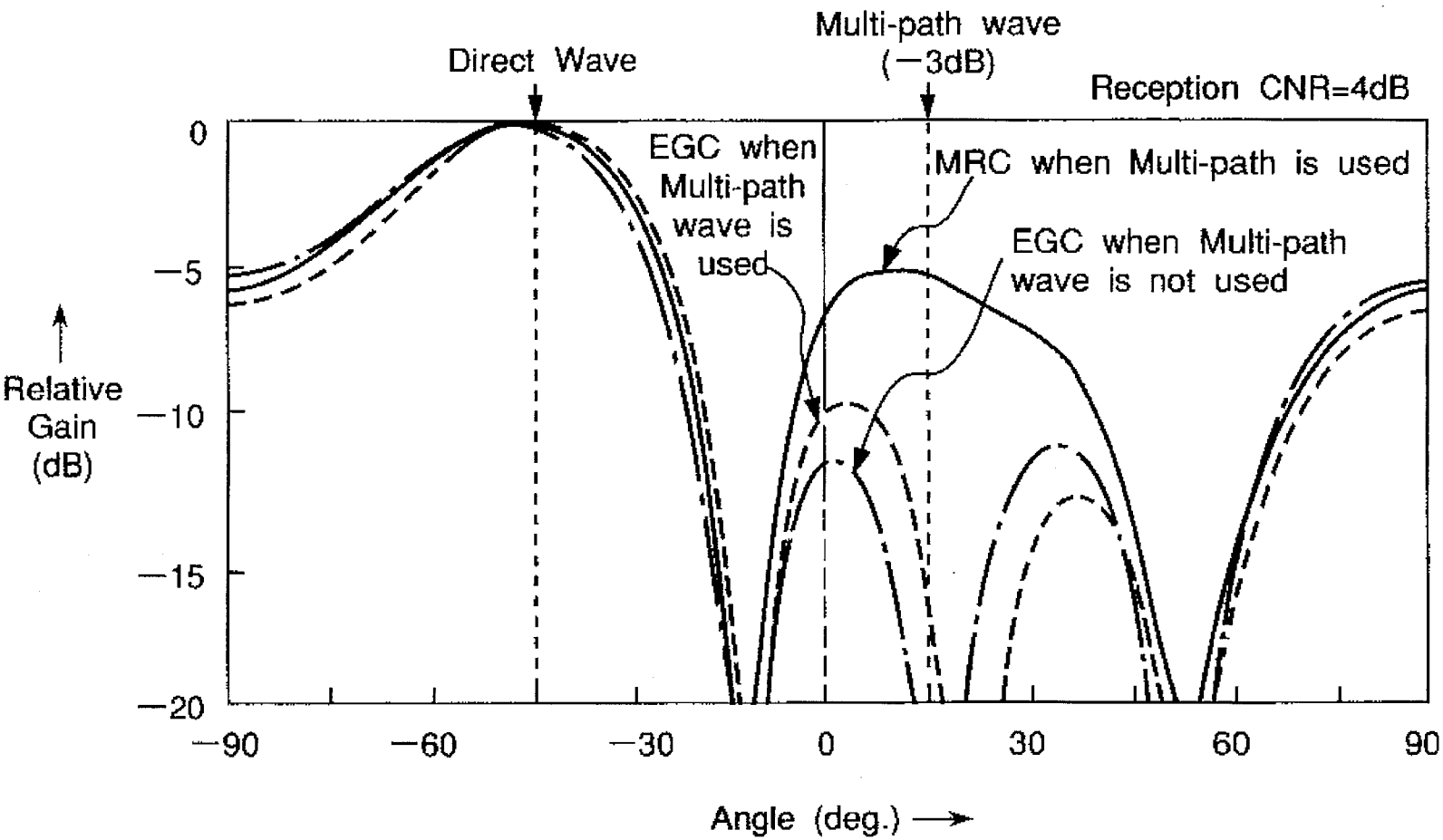
FIG. 31 is a graph showing a directivity pattern of beam formation by maximum ratio combining reception as a simulation result of the automatic beam acquiring and tracking apparatus of the array antenna for communication use shown in FIGS. 18 and 19.

FIG. 31 shows a comparison of a directivity pattern obtained through maximum ratio combining (MRC) reception in a case where a direct wave comes in the direction of −45° and a multi-path wave having a level of −3 dB and a phase difference of $\pi/2$ (at the center of the array antenna 1) with respect to the direct wave comes in the direction of +15° between a case of equal gain combining (EGC) in which received signals received by the antenna elements Ai are combined with each other with equal gain and a case where no multi-path wave exists. The reception carrier signal power to noise power ratio (referred to as a reception CNR hereinafter) of the direct wave is 4 dB. In the equal gain combining process, the multi-path wave exerts less influence on the directivity pattern. However, in the maximum ratio combining process, a beam is formed in the direction in which the multi-path wave comes. Consequently, it can be found that directional diversity for taking in both the direct wave and the multi-path wave and recombining them is achieved.

Figure 32:
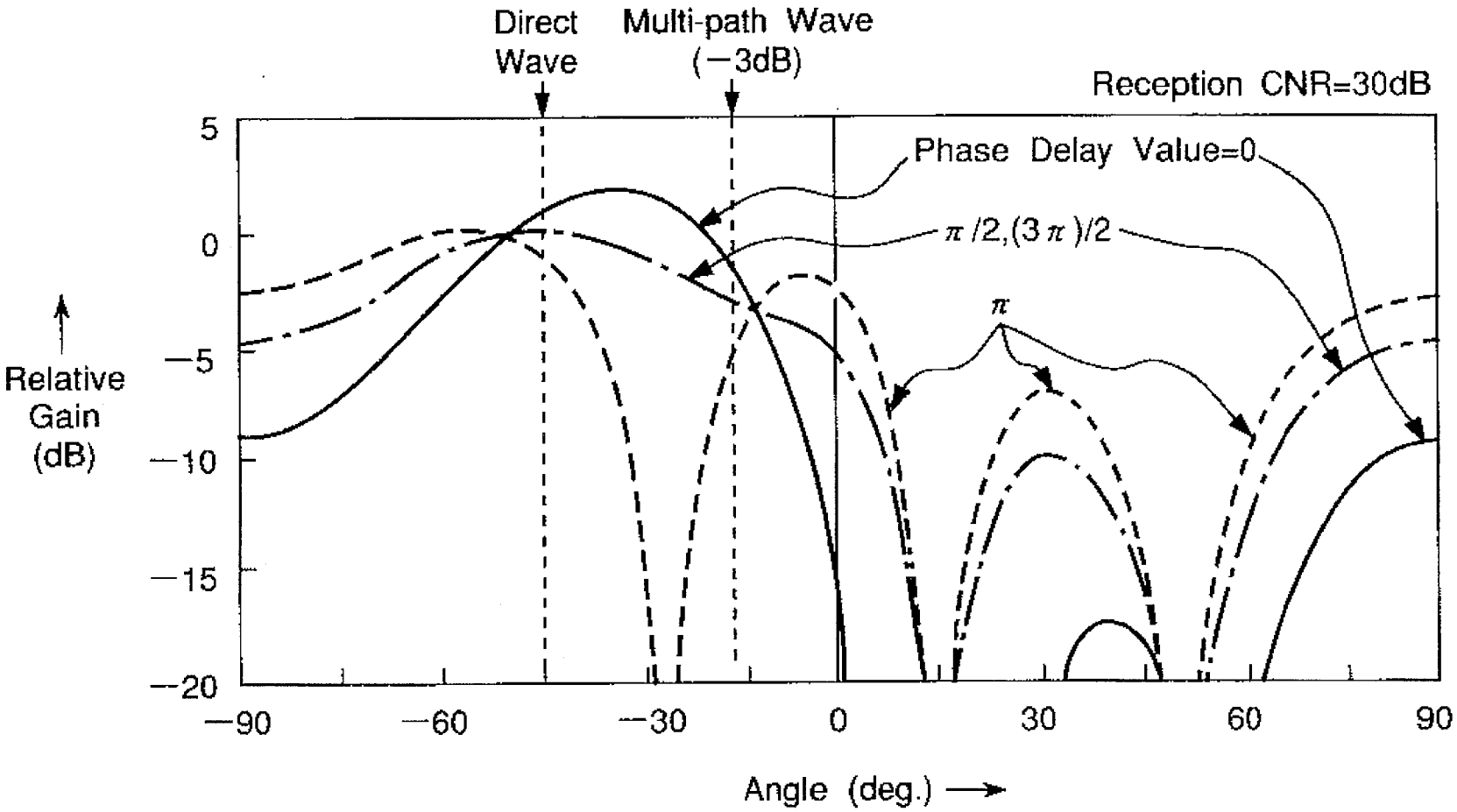
FIG. 32 is a graph showing a directivity pattern in a case where an angle of direction in which a multi-path wave comes is 15° as a simulation result of the automatic beam acquiring and tracking apparatus of the array antenna for use in communications shown in FIGS. 18 and 19.
Figure 33:
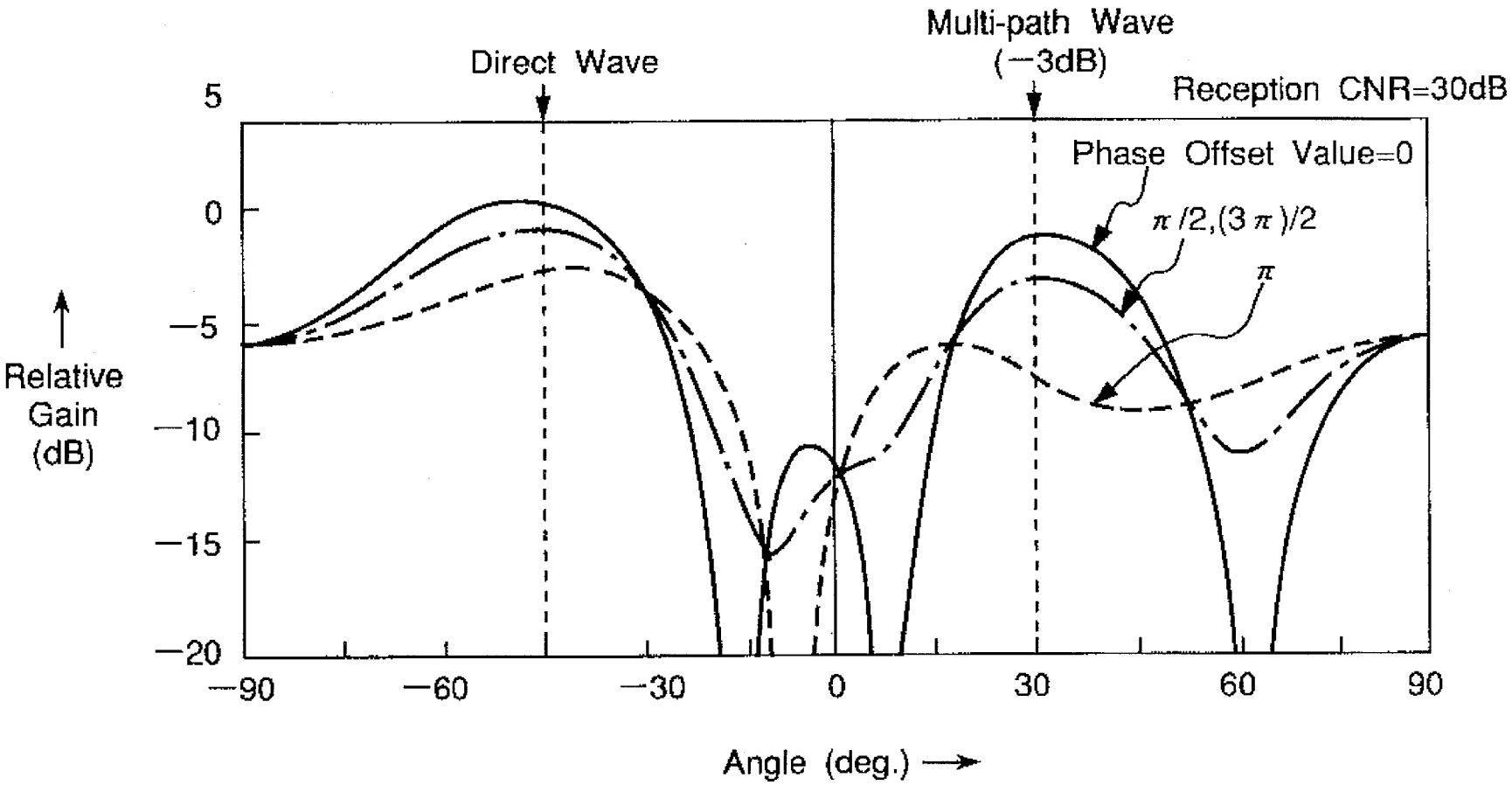
FIG. 33 is a graph showing a directivity pattern in a case where an angle of direction in which a multi-path wave comes is 30° as a simulation result of the automatic beam acquiring and tracking apparatus of the array antenna for use in communications shown in FIGS. 18 and 19.

FIGS. 32 and 33 show directivity patterns when the phase of the multi-path wave varies relative to that of the direct wave, where a phase delay value is at 0, $\pi/2$ or $(3\pi)/2$, and $\pi$. The fact that the phase delay value=0 means that the phases of the two waves are in phase at the center of the antenna. In order to clarify the characteristic of the directivity pattern, the reception CNR of the direct wave is set at 30 dB. In the case of FIG. 32 where the direction of the direct wave and that of the multi-path wave are relatively close to each other (when the direction in which the multi-path wave comes is −15°), it can be found that the two waves are acquired by an identical beam when the phase delay value=0, whereas the waves are acquired by adjacent beams when the phase delay value=$\pi$ (anti-phase) in beam formation. On the other hand, in the case of FIG. 33 where the incident directions of the two waves are separated apart from each other (when the direction in which the multi-path wave comes is 30°), it can be found that there is a shift by one beam of the beam used for acquisition between the case where the waves are incident in phase and the case where the waves are incident in anti-phase, however, the beam formation is achieved in the direction in which the waves are effectively acquired within the range of the limited degree of freedom of the antenna. In other words, directional diversity for combining the direct wave with the multi-path wave by giving both of them directivities corresponding to the powers thereof is achieved.

Figure 34:
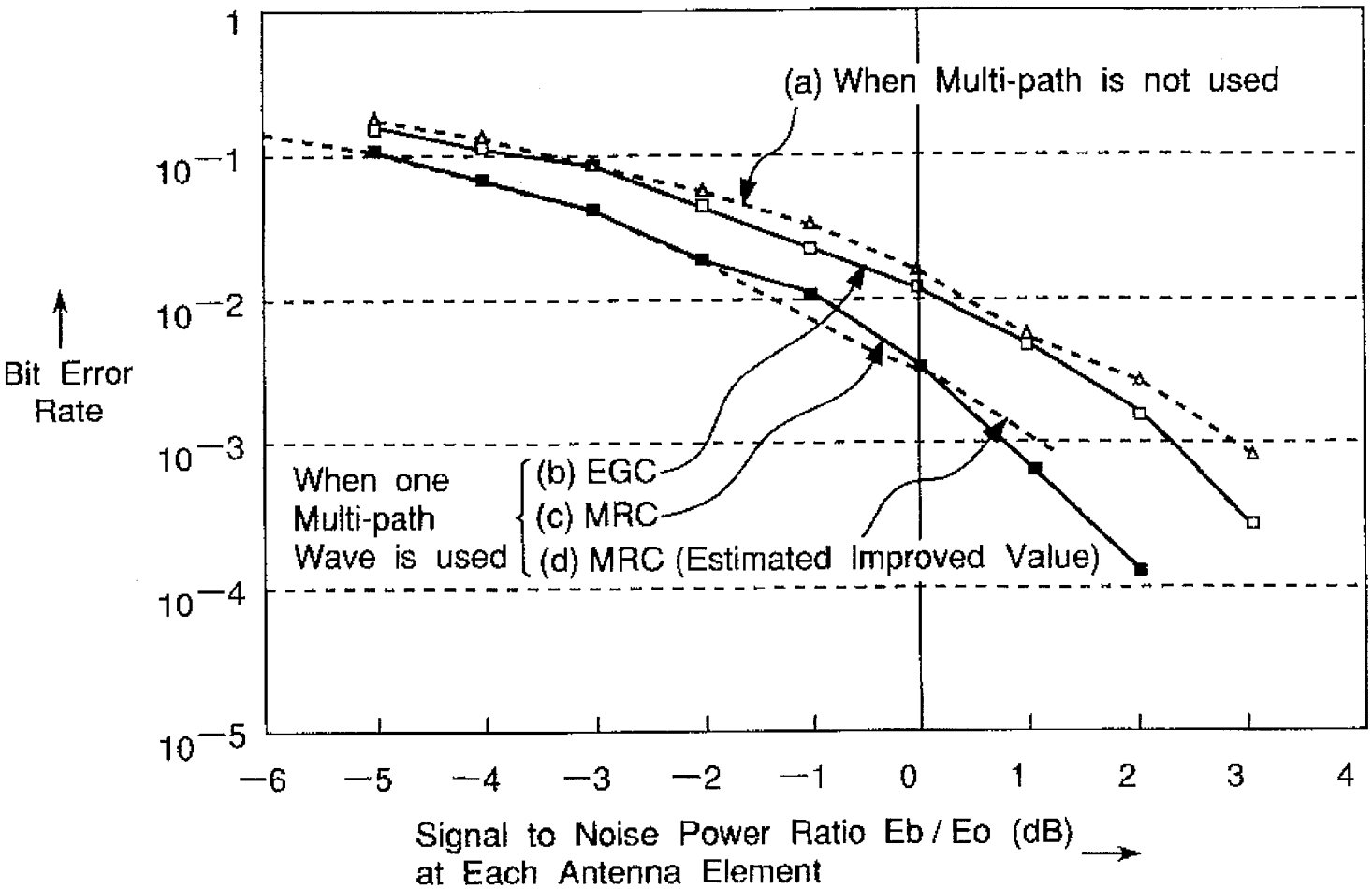
FIG. 34 is a graph showing a bit error rate characteristic in the maximum ratio combining reception as a simulation result of the automatic beam acquiring and tracking apparatus of the array antenna for use in communications shown in FIGS. 18 and 19.

FIG. 34 shows a simulation result of a bit error rate (BER) in the maximum ratio combining reception process under the same conditions as those of FIG. 31. It is assumed that the symbol delay of the multi-path wave relative to the direct wave can be ignored. It can be found that the bit error rate (BER) in a case where one multi-path wave comes is improved by a degree of about 1.5 dB in comparison with a case where only the direct wave comes, and the value of the degree of improvement comes close to a theoretically expected value (about 1.8 dB) through the maximum ratio combining process.

Figure 35:
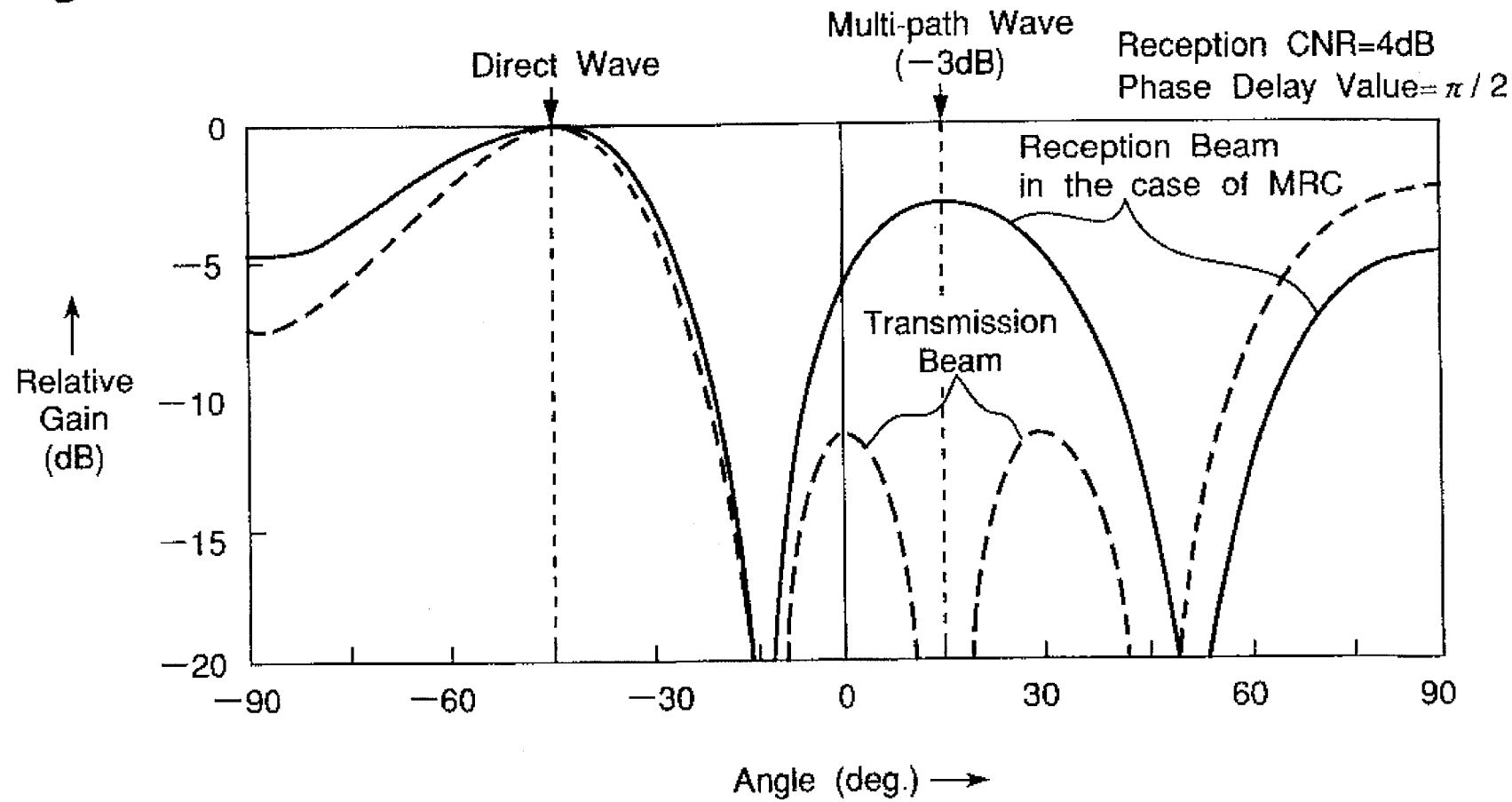
FIG. 35 is a graph showing a directivity pattern in forming a transmission beam and a reception beam in a case where angles of directions in which a direct wave and a multi-path wave come are respectively −45° and +15° as a simulation result of the automatic beam acquiring and tracking apparatus of the array antenna for use in communications shown in FIGS. 18 and 19.
Figure 36:
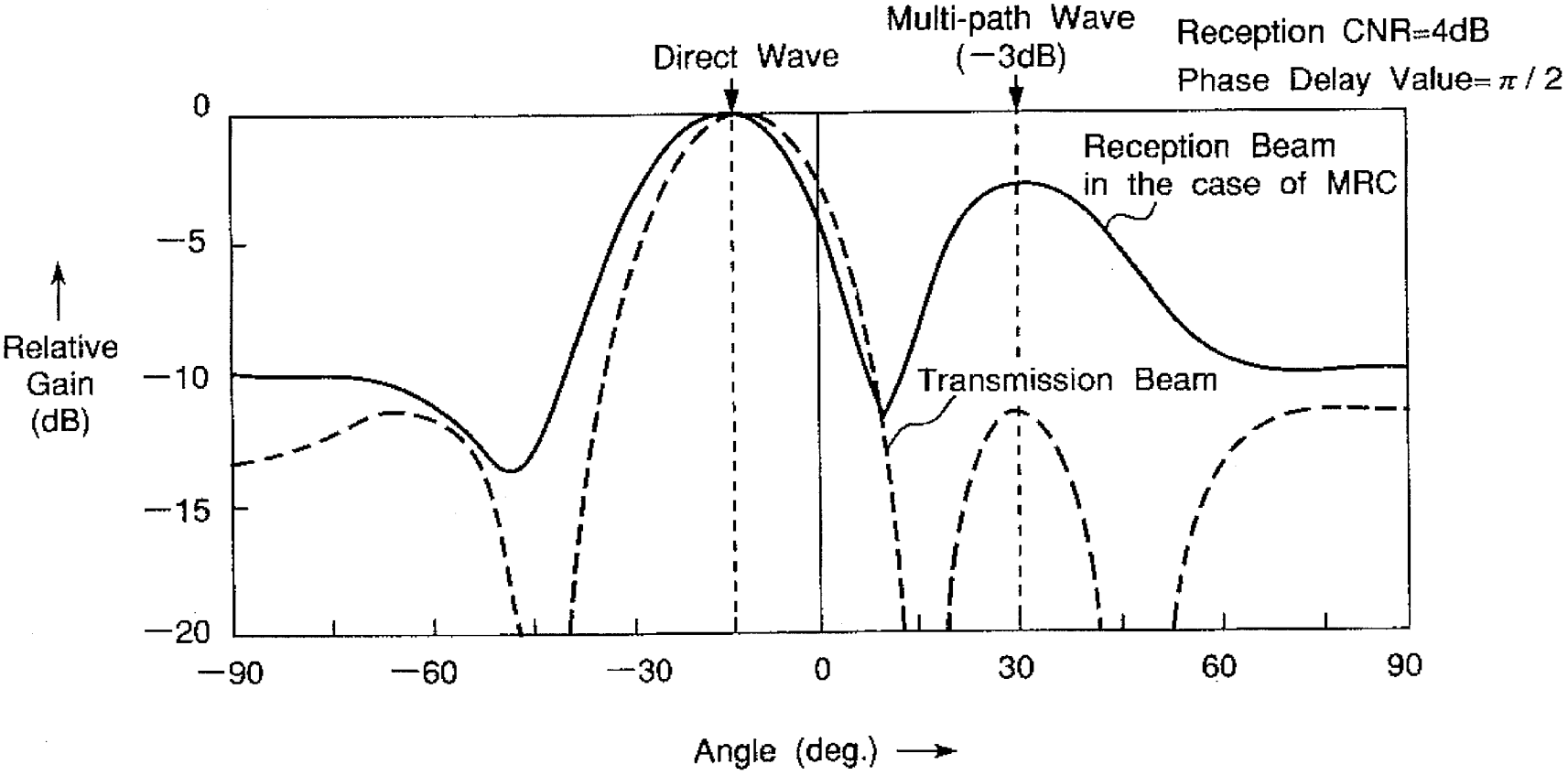
FIG. 36 is a graph showing a directivity pattern in forming a transmission beam and a reception beam in a case where angles of directions in which a direct wave and a multi-path wave come are respectively −15° and +30° as a simulation result of the automatic beam acquiring and tracking apparatus of the array antenna for use in communications shown in FIGS. 18 and 19.

Next, a simulation result of transmitting beam formation will be described. FIGS. 35 and 36 show a case where a transmitting beam is formed when two waves of a direct wave and a multi-path wave come by means of the apparatus of the present preferred embodiment. In the present case, there are shown two cases where the directions in which the two waves come are changed. FIG. 35 shows a case where the directions in which the direct wave and the multi-path wave come are −45° and +15°, respectively. FIG. 36 shows a case where the directions in which the direct wave and the multi-path wave come are −15° and +30°, respectively. The array antenna 1 is commonly used for transmission and reception, and the transmission frequency is 1.066 times as great as reception frequency. In each case, it can be found that the transmitting main beam is formed only in the direction of the direct wave while receiving no influence of the multi-path wave, and radiation in the direction of the multi-path wave is suppressed to about the side lobe level at most.

As described above, the present preferred embodiments of the present invention have distinctive advantageous effects as follows.

(1) Since neither a special azimuth sensor nor position data of the remote station of the other party as in the first prior art is required, the present apparatus of the present preferred embodiments receives no influence of the environmental magnetic turbulence, accumulation of azimuth detection errors and the like. Further, when the remote station of the other party moves, a transmitting beam can be automatically formed in the direction of the incoming wave transmitted from the remote station of the other party, while allowing downsizing and cost reduction to be achieved.

(2) Instead of directly frequency-converting the reception phase difference of the reception antenna to make it a transmission phase difference as in the second prior art, the removal of the phase uncertainty is effected based on the least square method and the influence of the multi-path waves except for the greatest received wave is removed. Therefore, even when the greatest received wave comes in whichever direction in the multi-path wave environment, the transmitting beam can be surely formed in the direction in which the greatest received wave comes. Furthermore, even when there is a difference between the transmission frequency and the reception frequency, the possible interference exerted on the remote station of the other party can be reduced.

(3) As shown in the apparatus of the preferred embodiment, there can be achieved a construction free of any mechanical drive section for the antenna and any feedback loop in forming the transmitting beam. Therefore, upon obtaining a received baseband signal, the transmission weight can be immediately decided, so that the transmitting beam can be formed rapidly in real time.

(4) Further, as shown in the apparatus of the preferred embodiment, the determination of the transmission weight can be executed in a digital signal processing manner.

Therefore, by executing the transmitting beam formation in a digital signal processing manner, the baseband processing including modulation can be entirely integrated into a digital signal processor. When a device having a high degree of integration is used, the entire system can be compacted with cost reduction.

Fifth preferred embodiment

Figure 20:
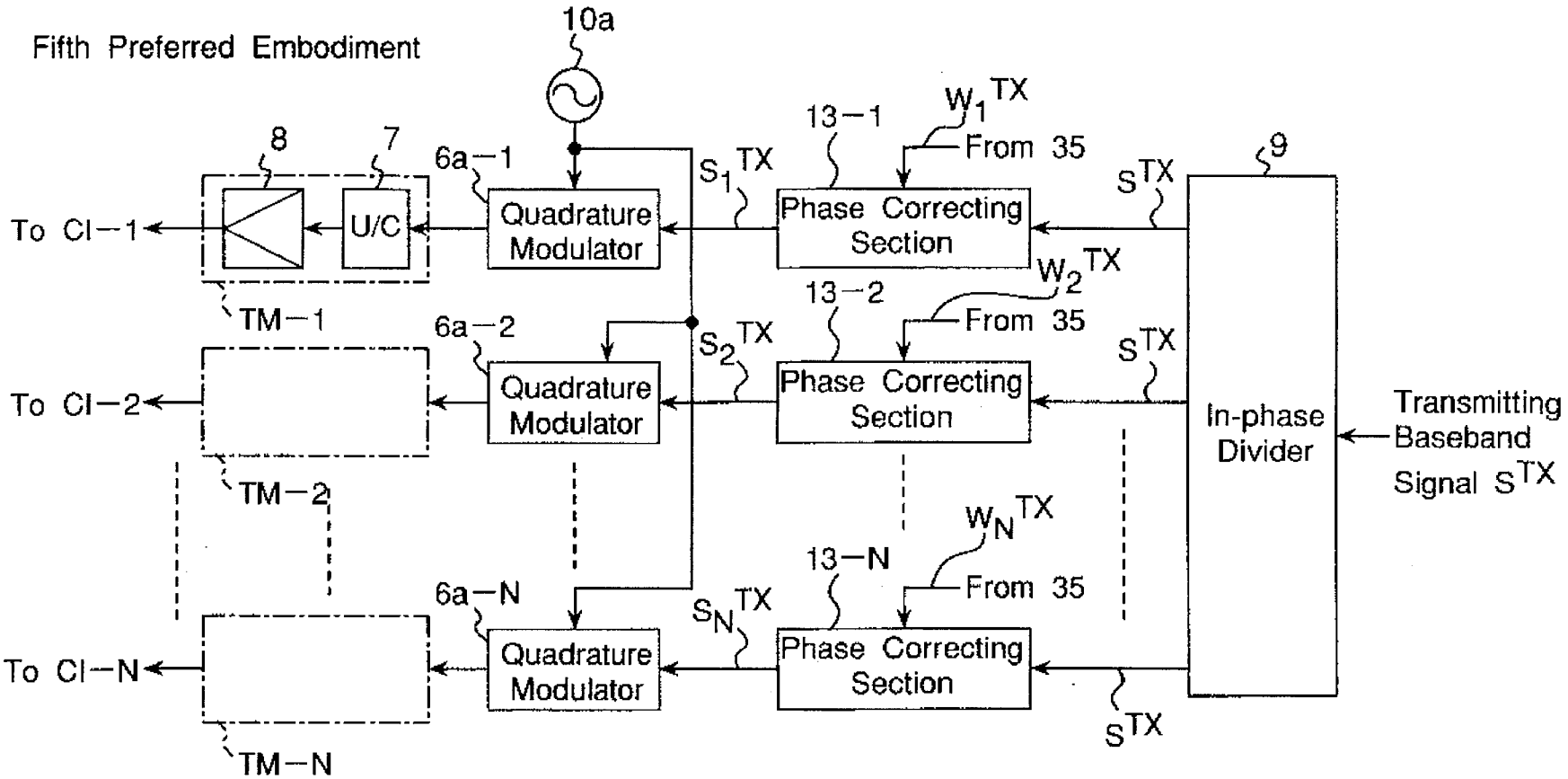
FIG. 20 is a block diagram of a transmitter section of an automatic beam acquiring and tracking apparatus of an array antenna for use in communications according to the fifth preferred embodiment of the present invention.

FIG. 20 is a block diagram of a transmitter section of an automatic beam acquiring and tracking apparatus of an array antenna for use in communications according to the fifth preferred embodiment of the present invention. The other components are constructed similarly to those of the fourth preferred embodiment. A point different from that of the fourth preferred embodiment shown in FIG. 19 will be described in detail below.

Referring to FIG. 20, a transmitting local oscillator 10*a* is, for example, an oscillator using a DDS (Direct Digital Synthesizer) driven by an identical clock, and operates to generate a transmitting local oscillation signal having a predetermined frequency. On the other hand, a transmitting baseband signal $S^{TX}$, or transmission data is inputted to the in-phase divider 9 to be divided in phase into N transmitting baseband signals $S^{TX}$, and then, the signals are inputted respectively to phase correcting sections 13-1 through 13-N. Each phase correcting section 13-i (i=1, 2, . . . , N) multiplies the inputted transmitting baseband signal $S^{TX}$ by the transmission weights $W_1^{TX}$, $W_2^{TX}$, . . . , $W_N^{TX}$, and then, outputs a transmitting baseband signal $S_i^{TX}$ (i=1, 2, . . . , N) of the multiplication result to a quadrature modulator 6*a–i*. The quadrature modulator 6*a–i* subjects the inputted transmitting baseband signal to a serial to parallel conversion process so as to convert the signal into a transmitting quadrature baseband signal, and then, combines the transmitting local oscillation signals having a mutual phase difference of 90° according to the transmitting quadrature baseband signal through a quadrature modulation process so as to obtain the above-mentioned intermediate frequency signal. Then, the intermediate frequency signal obtained through the quadrature modulation process is inputted as a transmitting radio signal to the circulator CI-i in the array antenna 1 via the up-converter 7 and the transmission power amplifier 8 in the transmitter module TM-i. Then, the transmitting radio signal is radiated from the antenna element Ai. Consequently, transmitting signals weighted by the transmission weights $W_1^{TX}$, $W_2^{TX}$, . . . , $W_N^{TX}$ are radiated from the antenna elements A1 through AN. Therefore, the transmitter section of the fifth preferred embodiment operates similarly to that of the fourth preferred embodiment, while producing a similar effect.

FIG. 37 shows a transmission weighting coefficient calculation circuit 30*a* of a modification of the preferred embodiment.

Referring to FIG. 37, an operation of the circuit 30*a* will be described below. In the Equation (47), r is replaced with i, and then, based on the following Equation (66), there is calculated the phase difference between the antenna elements A(i–1) and the Ai, namely, the phase difference $\Delta\theta_{i-1,i}$ between the adjacent antenna elements A(i–1) and Ai.

$$\begin{aligned}\Delta\theta_{i-1,i} &= \arg(S_{i-1}^{*}\cdot S_i) \\ &= \tan^{-1}\frac{F(I_{i-1}\cdot Q_i - I_i\cdot Q_{i-1})}{F(I_{i-1}\cdot I_i + Q_{i-1}\cdot Q_i)},\end{aligned} \tag{66}$$

where $S_i=I_i+jQ_i$, i=1, 2, . . . , N, (N is the number of the antenna elements) is a reception baseband signal received by the antenna element Ai. This processing is performed by phase difference calculation sections 31*a*-1 through 31*a*-(N–1). Then by using adders 36-1 through 36-(N–2), the output signals from the phase difference calculation sections 31*a*-1 through 31*a*-(N–1) are accumulatively added sequentially, according to the following Equations (67) so as to obtain the phase difference $\Delta\theta_{1,i}$ between the antenna elements A1 and Ai.

$$\Delta\theta_{1,i} = \sum_{k=1}^{i-1}\Delta\theta_{k,k+1},\ i=2,3,\ldots N, \tag{67}$$

$$\Delta\theta_{1,1} = 0,$$

Since the distance between the adjacent antenna elements is often set to half the wavelength, normally, the phase difference Δθi–1,idoes not include any phase uncertainty. Due to this, the accumulatively added phase difference $\Delta\theta_{1,i}$ also does not include any phase uncertainty. In this preferred embodiment, the phase plane regression correction using the least square method is performed to this phase difference $\Delta\theta_{1,i}$ by a least square regression processing section 32. That is, in a manner similar to that of the Equation (48), the linear plane regression plane is now expressed by the following Equation (68).

$$\Delta\theta_{i,i}^{LSR}=ax+by+c \tag{68}$$

Then the matrix A is calculated according to the Equation (53), this results in obtaining the parameters a, b and c of the regression plane, and also obtaining the regression-corrected phase difference $\Delta\theta_{1,i}^{LSR}$. It is noted that the matrixes X, A and Θ can be calculated, respectively, according to the Equations (50) and (51) and the following Equation (69).

$$\Theta = \begin{bmatrix}\Delta\theta_{1,i}\\ \Delta\theta_{1,2}\\ \vdots\\ \vdots\\ \vdots\\ \vdots\\ \Delta\theta_{1,N}\end{bmatrix} \tag{69}$$

The matrix X is a known matrix which has been previously determined by the arrangement or portion information of the antenna elements, and therefore, the matrix X is previously inputted to the least square regression processing section 32.

The regression-corrected phase differences $\Delta\theta_{1,i}^{LSR}$ are inputted to the transmission weighting coefficient calculation section 35, which performs the following calculations in a manner similar to that of the Equations (64) and (65), and then outputs the transmission weighting coefficients $W_i^{TX}$ (i=1, 2, . . . N).

That is, in the case where the transmission frequency is equal to the reception frequency and the transmission and reception antennas are commonly used as one antenna, and in the case where the transmission frequency is different from the reception frequency, the transmission antenna is provided separately from the reception antenna, the distances between the adjacent antenna elements are equal to each other between the transmission and reception in terms of wavelength, the transmission weighting coefficients $W_i^{TX}$ are calculated according to the following Equation (70).

$$W_i^{TX}=\exp(j\theta_i^{TX})=_i^{TX}\exp(-j\Delta\theta_{1,i}^{LSR}) \tag{70}$$

Further, in the case where the transmission frequency is different from the reception frequency and the transmission and reception antennas are commonly used as one antenna, the transmission weighting coefficients $W_i^{TX}$ are calculated according to the following Equation (71).

$$W_i^{TX}=a_i\exp(-j(f^{TX}/f^{RX})\Delta\theta_{1,i}^{LSR}) \tag{71}$$

where $a_i^{TX}$ is a transmission excited amplitude in the antenna element Ai. Normally, $a_i^{TX}$ is set to one, however, it can be set to any distribution for the purpose of side-lobe suppression.

The results of the transmission beam forming by this method becomes equal to those of the phase correction method using the condition branch according to the fifth preferred embodiment. However, it is noted that the weighting coefficients $W_i^{RX}$ obtained by the receiver side can not be utilized, and it is necessary to again calculate the value of the above-mentioned Equation (66) based on the reception baseband signal $S_i=I_i+jQ_i$. In this case, the calculation amount is decreased. Further, the above-mentioned processing can be performed in a similar manner in both cases when the array antenna is a linear array antenna and when the array antenna is a two-dimension plane array antenna.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. An apparatus for controlling an array antenna comprising a plurality of antenna elements arranged so as to be adjacent to each other in a predetermined arrangement configuration, the apparatus comprising:

transforming means for transforming a plurality of received signals received by said antenna elements of said array antenna into respective pairs of quadrature baseband signals, respectively, using a common local oscillation signal, respective quadrature baseband signals of the pairs of quadrature baseband signals being orthogonal to each other;

in-phase putting means, comprising a noise suppressing filter having a predetermined transfer function, said in-phase putting means using a predetermined first axis and a predetermined second axis which are orthogonal to each other and a transformation matrix for putting in phase received signals obtained from each two antenna elements of each combination of said plurality of antenna elements being expressed by a two-by-two transformation matrix including (a) second data on said second axis proportional to a product of a sine value of a phase difference between the received signals obtained from said each two antenna elements of each combination, and respective amplitude values of the received signals thereof, and (b) first data on said first axis proportional to a product of a cosine value of a phase difference between the received signals obtained from said each two antenna elements of each combination, and respective amplitude values of the received signals thereof, said in-phase putting means calculating said first data and said second data based on each pair of transformed quadrature baseband signals, passing the calculated first data and the calculated second data through said noise suppressing filter so as to filter said first and second data and output filtered first and second data, calculating respective element values of said transformation matrix based on the filtered first data and the filtered second data, and putting in phase said received signals obtained from said each two antenna elements of each combination based on said transformation matrix including said calculated transformation matrix elements; and combining means for combining in phase said plurality of received signals which are put in phase by said in-phase putting means, and outputting an in-phase combined received signal.

2. The apparatus as claimed in claim 1, wherein said combining means comprises:

calculating means for calculating respective correction phase amounts such that said plurality of received signals are put in phase based on said filtered first data and said filtered second data filtered by said in-phase putting means;

first phase shifting means for shifting phases of said plurality of received signals respectively based on said respective correction phase amounts calculated by said calculating means; and first in-phase combining means for combining in phase said plurality of received signals whose phases are shifted by said first phase shifting means, and outputting an in-phase combined received signal.

3. The apparatus as claimed in claim 2, wherein said combining means further comprises:

correcting means for subjecting said respective correction phase amounts calculated by said calculating means to a regression correcting process so that, based on said arrangement configuration of said array antenna, said respective correction phase amounts are made to regress to a predetermined plane of said arrangement configuration, and outputting respective regression-corrected correction phase amounts, wherein said first phase shifting means shifts the phases of said plurality of received signals respectively by said respective regression-corrected correction phase amounts outputted from said correcting means.

4. The apparatus as claimed in claim 1, wherein said combining means comprises:

in-phase transforming means for transforming one of respective two received signals of each combination of said plurality of received signals so that said one of said received signals is put in phase with another one of said received signals thereof, using said transformation matrix including said transformation matrix elements calculated by said in-phase combining means;

second in-phase combining means for combining in phase said respective two received signals of each combination comprised of a received signal which is not transformed by said in-phase transforming means, and another received signal which is transformed by said in-phase transforming means, and outputting an in-phase combined received signal; and control means for repeating the processes of said in-phase transforming means and said second in-phase combining means until one resulting received signal is obtained, and outputting the one resulting received signal combined in phase.

5. The apparatus as claimed in claim 1, further comprising:

multi-beam forming means operatively provided between said transforming means and said in-phase putting means, for calculating a plurality of beam electric field values based on said plurality of received signals received by respective antenna elements of said array antenna, directions of respective main beams of a predetermined plural number of beams to be formed which are predetermined so that a desired wave can be received within a range of radiation angle, and a predetermined reception frequency of said received signals, and outputting a plurality of beam signals respectively having said beam electric field values; and beam selecting means operatively provided between said transforming means and said in-phase putting means, for selecting a predetermined number of beam signals having greater beam electric field values including a beam signal having a greatest beam electric field value among said plurality of beam signals outputted from said multi-beam forming means, and determining said beam signal having the greatest beam electric field value to be a reference received signal, said in-phase putting means puts in phase with said reference received signal, the other ones of said plurality of received signals selected by said beam selecting means, using said transformation matrix including said calculated transformation matrix elements.

6. The apparatus as claimed in claim 1, further comprising:

amplitude correcting means operatively provided before said combining means, for amplifying said plurality of received signals which are put in phase by said in-phase putting means respectively with a plurality of gains proportional to signal levels of said plurality of received signals, thereby effecting amplitude correction.

7. The apparatus as claimed in claim 1, wherein said in-phase putting means calculates elements of said transformation matrix by directly expressing said first data and said second data as the elements of said transformation matrix, and puts the other ones of said plurality of received signals except for one predetermined received signal in phase with said one predetermined received signal, using said transformation matrix including said calculated transformation matrix elements.

8. The apparatus as claimed in claim 4, wherein said in-phase putting means calculates elements of said transformation matrix by directly expressing said first data and said second data as the elements of said transformation matrix, and puts respective two received signals of each combination in phase with each other, using said transformation matrix including said calculated transformation matrix elements.

9. The apparatus as claimed in claim 3, further comprising:

distributing means for distributing in phase a transmitting signal into a plurality of transmitting signals;

transmission phase shifting means for shifting phases of said plurality of transmitting signals respectively by either one of said respective correction phase amounts calculated by said calculating means and said respective regression-corrected correction phase amounts outputted from said correcting means; and transmitting means for transmitting said plurality of transmitting signals whose phases are shifted by said transmission phase shifting means, from said plurality of antenna elements.

10. A method for controlling an array antenna comprising a plurality of antenna elements arranged so as to be adjacent to each other in a predetermined arrangement configuration, the method including the steps of:

a) transforming a plurality of received signals received by said antenna elements of said array antenna into respective pairs of quadrature baseband signals, respectively, using a common local oscillation signal, respective quadrature baseband signals of the pairs of quadrature baseband signals being orthogonal to each other;

b) putting in phase received signals obtained from each two antenna elements of each combination of said plurality of antenna elements by using a predetermined first axis and a predetermined second axis which are orthogonal to each other and a transformation matrix being expressed by a two-by-two transformation matrix including second data on said second axis proportional to a product of a sine value of a phase difference between the received signals obtained from said each two antenna elements of each combination, and respective amplitude values of the received signals thereof, and first data on said first axis proportional to a product of a cosine value of a phase difference between the received signals obtained from said each two antenna elements of each combination, and respective amplitude values of the received signals thereof, said step b) of putting in phase received signals including b1) calculating said first data and said second data based on each pair of transformed quadrature baseband signals, b2) filtering the calculated first data and the calculated second data with a predetermined transfer function so as to provide filtered first and second data, b3) calculating respective element values of said transformation matrix based on the filtered first data and the filtered second data, and b4) putting in phase said received signals obtained from said each two antenna elements of each combination based on said transformation matrix including said calculated transformation matrix elements; and c) combining in phase said plurality of received signals which are put in phase, and providing an in-phase combined received signal.

11. The method as claimed in claim 10, wherein said step c) of combining comprises the steps of:

c1) calculating respective correction phase amounts such that said plurality of received signals are put in phase based on said filtered first data and said filtered second data;

c2) shifting phases of said plurality of received signals respectively by said calculated respective correction phase amounts; and c3) combining in phase said plurality of received signals whose phases are shifted, and providing an in-phase combined received signal.

12. The method as claimed in claim 11, wherein said step c) of combining further comprises the steps of:

c4) subjecting said calculated respective correction phase amounts to a regression correcting process so that, based on said arrangement configuration of said array antenna, said respective calculated correction phase amounts are made to regress to a predetermined plane of said arrangement configuration; and c5) providing respective regression-corrected correction phase amounts, said shifting step including shifting the phases of said plurality of received signals respectively by said respective regression-corrected correction phase amounts.

13. The method as claimed in claim 10, wherein said step c) of combining comprises the steps of:

c1) transforming one of respective two received signals of each combination of said plurality of received signals so that said one of said received signals is put in phase with another one of said received signals thereof, using said transformation matrix including said calculated transformation matrix elements;

c2) combining in phase said respective two received signals of each combination comprised of a received signal which is not transformed, and another received signal which is transformed, and providing an in-phase combined received signal; and c3) repeating the processes of said step c1) of transforming and said step c2) of combining until one resulting received signal is obtained, and providing the one resulting received signal combined in phase.

14. The method as claimed in claim 10, further comprising the steps of:

d) calculating a plurality of beam electric field values based on said plurality of received signals received by respective antenna elements of said array antenna, directions of respective main beams of a predetermined plural number of beams to be formed which are predetermined so that a desired wave can be received within a range of radiation angle, and a predetermined reception frequency of said received signals, and providing a plurality of beam signals respectively having said beam electric field values, said step d) of calculating occurring after said step a) of transforming and before said step b) of putting in phase; and e) selecting a predetermined number of beam signals having greater beam electric field values including a beam signal having a greatest beam electric field value among said plurality of beam signals outputted at said multi-beam forming step, and determining said beam signal having the greatest beam electric field value to be a reference received signal, said step e) of selecting occurring after said step a) of transforming and before said step) b) of putting in phase, said combining step including putting in phase with said reference received signal, the other ones of said plurality of selected received signals, using said transformation matrix including said calculated transformation matrix elements.

15. The method as claimed in claim 10, further comprising the step of:

amplifying said plurality of received signals which are put in phase in said step b) respectively with a plurality of gains proportional to signal levels of said plurality of received signals, prior to said step c) of combining, thereby effecting amplitude correction.

16. The method as claimed in claim 10, wherein said step b) of putting in phase comprises the steps of:

calculating elements of said transformation matrix by directly expressing said first data and said second data as the elements of said transformation matrix; and putting the other ones of said plurality of received signals except for one predetermined received signal in phase with said one predetermined received signal, using said transformation matrix including said calculated transformation matrix elements.

17. The method as claimed in claim 13, wherein said step b) of putting in phase comprises the steps of:

calculating elements of said transformation matrix by directly expressing said first data and said second data as the elements of said transformation matrix; and putting respective two received signals of each combination in phase with each other, using said transformation matrix including said calculated transformation matrix elements.

18. The method as claimed in claim 12, further comprising the steps of:

d) distributing in phase a transmitting signal into a plurality of transmitting signals;

e) shifting phases of said plurality of transmitting signals respectively by either one of said calculated respective correction phase amounts and said respective regression-corrected correction phase amounts; and f) transmitting said plurality of transmitting signals whose phases are shifted, from said plurality of antenna elements.

19. An apparatus for controlling an array antenna comprising a plurality of antenna elements arranged so as to be adjacent to each other in a predetermined arrangement configuration, the apparatus comprising:

transforming means for transforming a plurality of received signals received by said antenna elements of said array antenna into respective pairs of quadrature baseband signals, using a common local oscillation signal, respective quadrature baseband signals of the pairs of quadrature baseband signals being orthogonal to each other;

phase difference calculating means, based on said transformed two quadrature baseband signals transformed by said transforming means, for calculating (a) first data proportional to a product of a cosine value of a phase difference between two received signals obtained from a predetermined reference antenna element and another arbitrary antenna element, and respective amplitude values of said two received signals thereof, (b) second data proportional to a product of a sine value of a phase difference between two received signals obtained from said each two antenna elements of each combination, and respective amplitude values of said two received signals thereof, and c) a reception phase difference between said each two antenna elements of each combination based on the calculated first data and the calculated second data;

correcting means for correcting said reception phase difference so that a phase uncertainty generated such that the calculated reception phase difference between each of said two antenna elements of each combination calculated by said phase difference calculating means is limited within a range from $-\pi$ to $+\pi$ is removed from said reception phase difference, according to a predetermined phase threshold value representing a degree of disorder of a reception phase difference due to a multipath wave, and for converting a corrected reception phase difference into a transmission phase difference by inverting a sign of said corrected reception phase difference; and transmitting means for transmitting a transmitting signal from said antenna elements with the transmission phase difference between said each two antenna elements of each combination converted by said correcting means and with the same amplitudes, thereby forming a transmitting main beam only in a direction of a greatest received signal.

20. The apparatus as claimed in claim 19, wherein said correcting means calculates a reception phase difference between adjacent two antenna elements of each combination, calculates a plurality of equi-phase linear regression planes corresponding to all proposed phases of the phase uncertainty of the reception phase difference between said two adjacent antenna elements of each combination according to a least square method, removes said phase uncertainty using a sum of squares of a residual between said reception phase difference and each of said equi-phase linear regression planes and a gradient coefficient of each of said equi-phase linear regression planes, and corrects said reception phase difference by specifying only one equi-phase linear regression plane corresponding to the greatest received wave.

21. The apparatus as claimed in claim 20, wherein said correcting means derives an equation representing said equi-phase linear regression plane corresponding to all the proposed phases of said phase uncertainty by solving a Wiener-Hopf equation according to the least square method using a matrix comprised of reception phase differences corresponding to all the proposed phases of the phase uncertainty of the reception phase difference between said two adjacent antenna elements of each combination and a matrix comprised of position coordinates of the plurality of antenna elements of said array antenna, and calculates the plurality of equi-phase linear regression planes corresponding to all the proposed phases of said phase uncertainty.

22. The apparatus as claimed in claim 20, wherein said correcting means determines a transmission phase difference by multiplying a reception phase difference calculated from said equi-phase linear regression plane from which said phase uncertainty is removed by a ratio of a transmission frequency to a reception frequency, thereby converting said reception phase difference into said transmission phase difference.

23. A method for controlling an array antenna comprising a plurality of antenna elements arranged so as to be adjacent to each other in a predetermined arrangement configuration, the method comprising the steps of:

a) transforming a plurality of received signals received by said antenna elements of said array antenna into respective pairs of quadrature baseband signals, using a common local oscillation signal, respective quadrature baseband signals of the pairs of quadrature baseband signals being orthogonal to each other;

b) calculating based on said transformed two quadrature baseband signals first data proportional to a product of a cosine value of a phase difference between two received signals obtained from a predetermined reference antenna element and another arbitrary antenna element, and respective amplitude values of said two received signals thereof, second data proportional to a product of a sine value of a phase difference between two received signals obtained from said each two antenna elements of each combination, and respective amplitude values of said two received signals thereof, and a reception phase difference between said each two antenna elements of each combination based on the calculated first data and the calculated second data;

c) correcting said reception phase difference so that a phase uncertainty generated such that the calculated reception phase difference between each of said two antenna elements of each combination is limited within a range from $-\pi$ to $+\pi$ is removed from said reception phase difference, according to a predetermined phase threshold value representing a degree of disorder of a reception phase difference due to a multi-path wave;

d) converting a corrected reception phase difference into a transmission phase difference by inverting a sign of said corrected reception phase difference; and e) transmitting a transmitting signal from said antenna elements with said converted transmission phase difference between said each two antenna elements of each combination and with the same amplitudes, thereby forming a transmitting main beam only in a direction of a greatest received signal.

24. The method as claimed in claim 23, wherein said step c) of correcting comprises the steps of:

c1) calculating a reception phase difference between adjacent two antenna elements of each combination;

c2) calculating a plurality of equi-phase linear regression planes corresponding to all proposed phases of the phase uncertainty of the reception phase difference between said two adjacent antenna elements of each combination according to a least square method;

c3) removing said phase uncertainty using a sum of squares of a residual between said reception phase difference and each of said equi-phase linear regression planes and a gradient coefficient of each of said equi-phase linear regression planes; and c4) correcting said reception phase difference by specifying only one equi-phase linear regression plane corresponding to the greatest received wave.

25. The method as claimed in claim 24, wherein said step c4) correcting comprises the steps of:

deriving an equation representing said equi-phase linear regression plane corresponding to all the proposed phases of said phase uncertainty by solving a Wiener-Hopf equation according to the least square method using a matrix comprised of reception phase differences corresponding to all the proposed phases of the phase uncertainty of the reception phase difference between said two adjacent antenna elements of each combination and a matrix comprised of position coordinates of the plurality of antenna elements of said array antenna; and calculating the plurality of equi-phase linear regression planes corresponding to all the proposed phases of said phase uncertainty.

26. The method as claimed in claim 24, wherein said step c4) correcting comprises a step of determining a transmission phase difference by multiplying a reception phase difference calculated from said equi-phase linear regression plane from which said phase uncertainty is removed by a ratio of a transmission frequency to a reception frequency, thereby converting said reception phase difference into said transmission phase difference.

* * * * *